US006730468B1

(12) United States Patent
Yamashita et al.

(10) Patent No.: US 6,730,468 B1
(45) Date of Patent: May 4, 2004

(54) SILVER HALIDE PHOTOGRAPHIC EMULSION AND PHOTOGRAPHIC LIGHT-SENSITIVE MATERIAL USING THE SAME

(75) Inventors: Katsuhiro Yamashita, Kanagawa (JP); Katsumi Kobayashi, Kanagawa (JP); Takanori Hioki, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/612,272

(22) Filed: Jul. 7, 2000

(30) Foreign Application Priority Data

Jul. 8, 1999 (JP) ..... P. 11-194714
Apr. 27, 2000 (JP) ..... P. 2000-128039

(51) Int. Cl.[7] ..... G03C 1/005; G03C 1/08

(52) U.S. Cl. ..... 430/569; 430/572; 430/574

(58) Field of Search ..... 430/574, 572, 430/570, 605, 569

(56) References Cited

U.S. PATENT DOCUMENTS 5,491,057 A 2/1996 Hioki
5,609,978 A 3/1997 Giorgianni et al.
6,143,486 A * 11/2000 Parton et al. ..... 430/574
6,180,332 B1 * 1/2001 Yamashita et al. ..... 430/574

FOREIGN PATENT DOCUMENTS

EP 0 838 719 A2 4/1998
EP 0866364 A1 9/1998
JP A-10-123650 5/1998

* cited by examiner

*Primary Examiner*—Thorl Chea
(74) *Attorney, Agent, or Firm*—Sughrue Mion, PLLC

(57) ABSTRACT

An object of the present invention is to provide a silver halide photographic light-sensitive material which is reduced in the various problems ascribable to the multilayer adsorption of a sensitizing dye. A silver halide photographic emulsion comprising a silver halide grain having adsorbed on the surface thereof a sensitizing dye in multiple layers is described, wherein the variation coefficient of the light absorption strength distribution among the grains is 100% or less.

4 Claims, No Drawings

SILVER HALIDE PHOTOGRAPHIC EMULSION AND PHOTOGRAPHIC LIGHT-SENSITIVE MATERIAL USING THE SAME

FIELD OF THE INVENTION

The present invention relates to a photographic light-sensitive material using a spectrally sensitized silver halide photographic emulsion.

BACKGROUND OF THE INVENTION

Heretofore, a great deal of efforts have been made for attaining high sensitivity of silver halide photographic light-sensitive materials. In silver halide photographic emulsions, a sensitizing dye adsorbed to the surface of a silver halide grain absorbs light entered into a light-sensitive material and the light energy is transmitted to the silver halide grain, thereby obtaining light sensitivity. Accordingly, in the spectral sensitization of silver halide, it is considered that by increasing the light absorption factor per the unit grain surface area of silver halide grains, the light energy transmitted to silver halide can be increased and in turn high spectral sensitivity can be achieved. The light absorption factor on the surface of the silver halide grain may be improved by increasing the amount of the spectral sensitizing dye adsorbed per the unit grain surface area.

However, the amount of the sensitizing dye adsorbed to the surface of a silver halide grain is limited and the dye chromophore cannot be adsorbed in excess of the single layer saturation adsorption (namely, one layer adsorption). Therefore, individual silver halide grains are obliged to show a low absorption factor for the quantum of incident light in the spectral sensitization region at present.

To solve these problems, the following methods have been proposed.

In *Photographic Science and Engineering,* Vol. 20, No. 3, page 97 (1976), P. B. Gilman, Jr. et al. disclose a technique where a cationic dye is adsorbed to the first layer and an anionic dye is adsorbed to the second layer using an electrostatic force.

In U.S. Pat. No. 3,622,316, G. B. Bird et al. disclose a technique where a plurality of dyes are adsorbed in multiple layers to silver halide and the Forster-type excitation energy transfer is allowed to contribute to the sensitization.

In JP-A-63-138341 (the term "JP-A" as used herein means an "unexamined published Japanese patent application") and JP-A-64-84244, Sugimoto et al. disclose a technique of performing the spectral sensitization using the energy transfer from a light-emitting dye.

In *Photographic Science and Engineering*, Vol. 27, No. 2, page 59 (1983), R. Steiger et al. disclose a technique of performing the spectral sensitization using the energy transfer from a gelatin-substituted cyanine dye.

In JP-A-61-251842, Ikegawa et al. disclose a technique of performing the spectral sensitization using the energy transfer from a cyclodextrin-substituted dye.

Furthermore, in EP-A-0985964, EP-A-0985965 and EP-A-0985966, Richard Parton et al. disclose a technique where a combination of a cationic dye and an anionic dye is adsorbed in multiple layers with an attempt to attain high sensitivity using the energy transfer from the dye in the second or upper layer to the dye in the first layer.

In these methods, however, the degree of adsorption of sensitizing dyes in multiple layers on the surface of a silver halide grain is actually insufficient and neither the light absorption factor per the unit grain surface area of silver halide grains nor the sensitivity can be sufficiently highly increased. A technique capable of intensifying the interaction between dye molecules and thereby realizing practically effective multilayer adsorption is demanded.

On the other hand, when the interaction between molecules is intensified and the practically effective multilayer adsorption is realized, the following unexpected problems are found to occur:

(1) reduction of sensitivity and softening of contrast due to non-uniform distribution of the dye adsorbed amount among grains, (2) reduction of sensitivity and deterioration of graininess due to island-like adsorption, and (3) reduction of image quality due to small change in the absorption spectrum between before and after the photographic processing.

These phenomena are described below.

When the interaction between dye molecules is intensified so as to realize the multilayer adsorption, it is found that the distribution of the dye adsorbed amount is liable to be non-uniform among grains. In the ordinary single layer adsorption, as the amount of the sensitizing dye adsorbed increases, the distribution of the dye adsorbed amount becomes more uniform among grains, therefore, the above-described non-uniform distribution of the dye adsorbed amount in the case of multilayer adsorption is quite an unexpected result. Moreover, as compared with the single layer adsorption, the problems incurred by the non-uniform distribution of the dye adsorbed amount are extremely serious and this is also an unexpected phenomenon.

Also, when the interaction between dye molecules is intensified so as to realize the multilayer adsorption, it is found that the dyes in the second and upper layers do not grow in the layer form and fail to be present in the layer state but grow like islands and are present in the island state. In the ordinary single layer adsorption, it is known that as the amount of the sensitizing dye adsorbed increases, the dye grows in the layer form on a silver halide grains and is finally present in the layer state. Therefore, the behavior of the dyes in the second and upper layers in the case of multilayer adsorption such that they grow like islands and are present in the island state is a phenomenon not anticipated. Moreover, in the case where the dyes in the second and upper layers grow like islands and are present in the island state, it is found that not only the light absorption strength and the sensitivity are reduced but also the image quality is deteriorated, and these are problems beyond the expectation. The interaction for establishing the multilayer adsorption structure fundamentally includes two interactions, namely, (1) the interaction between the dye molecule in the first layer and the dye molecule in the second layer and (2) the interaction between dye molecules in the second layer. As a result of analysis, it is found that if the ratio of (b) the interaction between dye molecules in the second layer increases, the distribution of the dye adsorbed amount is broadened among the grains and also the island-like adsorption is liable to occur.

Furthermore, although the cause is not known, it is found that in the case of an emulsion grown through multilayer adsorption and having high light absorption strength, if the change in the absorption wave form between before and after the photographic processing is small, the image quality seriously decreases. These phenomena are not anticipated because they do not occur in the conventional single layer adsorption.

SUMMARY OF THE INVENTION

The object of the present invention is to provide a silver halide photographic light-sensitive material having capability of complementing the entrance of incident photons by allowing a sensitizing dye to adsorb in multiple layers onto a surface of a silver halide grain and at the same time reduced in various problems accompanying the multilayer adsorption of a sensitizing dye.

As a result of extensive investigations, the above-described object can be attained by the following matters (1) to (21).

(1) A silver halide photographic emulsion comprising a silver halide grain having adsorbed on the surface thereof a sensitizing dye in multiple layers, wherein the variation coefficient of the light absorption strength distribution among the grains is 100% or less.

(2) A silver halide photographic emulsion comprising a silver halide grain having adsorbed on the surface thereof a sensitizing dye in multiple layers, wherein assuming that the maximum value of the spectral absorption ratio by the sensitizing dye is Amax, the variation coefficient of the wavelength distance distribution between the shortest wavelength and the longest wavelength out of the wavelengths showing 50% of the Amax among the grains is 50% or less.

(3) A silver halide photographic emulsion comprising a silver halide grain having adsorbed on the surface thereof a sensitizing dye in multiple layers, wherein grains corresponding to 50% or more of the projected area of all silver halide grains in the emulsion have a variation width of the spectral absorption maximum wavelength, of 10 nm or less.

(4) A silver halide photographic emulsion comprising a silver halide grain having adsorbed on the surface thereof a sensitizing dye in multiple layers, wherein the sensitizing dyes in the second and upper layers each is present in the layer state.

(5) A silver halide photographic emulsion comprising a silver halide grain having adsorbed on the surface thereof a sensitizing dye in multiple layers, wherein assuming that the optical density at a spectral absorption maximum wavelength before the photographic processing is G0 and the optical density at a spectral absorption maximum wavelength after the photographic processing is G1, A represented by A=G1/G0 is 0.9 or less.

(6) The silver halide photographic emulsion as described in (5), wherein A is 0.5 or less.

(7) A silver halide photographic emulsion comprising a silver halide grain having adsorbed on the surface thereof a sensitizing dye in multiple layers, wherein the sensitizing dyes in the second and upper layers each has an adsorption energy ($\Delta G$) of 20 kJ/mol or more.

(8) A silver halide photographic emulsion comprising a silver halide grain having adsorbed on the surface thereof a sensitizing dye in multiple layers, wherein the interaction energy between the sensitizing dye in the first layer and the sensitizing dye in the second or upper layer is 10% or more of the entire adsorption energy of the dyes in the second and upper layers.

(9) The silver halide photographic emulsion as described in (1) to (8), comprising a silver halide grain having adsorbed on the surface thereof a sensitizing dye in multiple layers, wherein the sensitizing dye in the first layer and the sensitizing dyes in the second and upper layers each is not a sensitizing dye linked through a covalent bond.

(10) The silver halide photographic emulsion as described in (1) to (9), which contains a silver halide grain having a spectral absorption maximum wavelength of less than 500 nm and a light absorption strength of 60 or more or having a spectral absorption maximum wavelength of 500 nm or more and a light absorption strength of 100 or more.

(11) The silver halide photographic emulsion as described in (1) to (10), wherein assuming that the maximum value of the spectral absorption ratio by the sensitizing dye is Amax, the wavelength distance between the shortest wavelength and the longest wavelength out of the wavelengths showing 50% of the Amax is 120 nm or less.

(12) The silver halide photographic emulsion as described in (1) to (11), wherein assuming that the maximum value of the spectral sensitivity by the sensitizing dye is Smax, the wavelength distance between the shortest wavelength and the longest wavelength out of the wavelengths showing 50% of the Smax is 120 nm or less.

(13) The silver halide photographic emulsion as described in (11) or (12), wherein the longest wavelength showing a spectral absorption ratio corresponding to 50% of the Amax is in the range of from 460 to 510 nm, from 560 to 610 nm or from 640 to 730 nm.

(14) The silver halide photographic emulsion as described in (11) or (12), wherein the longest wavelength showing a spectral sensitivity corresponding to 50% of the Smax is in the range of from 460 to 510 nm, from 560 to 610 nm or from 640 to 730 nm.

(15) The silver halide photographic emulsion as described in (1) to (14), wherein the excitation energy of the sensitizing dye in the second or upper layer makes an energy transfer to the sensitizing dye in the first layer at an efficiency of 10% or more.

(16) The silver halide photographic emulsion as described in (1) to (15), wherein the sensitizing dye in the first layer and the sensitizing dye in the second or upper layer both show the J-band absorption.

(17) The silver halide photographic emulsion as described in (1) to (16), which contains a sensitizing dye having at least one aromatic group.

(18) The silver halide photographic emulsion as described in (1) to (17), which contains a sensitizing dye having a basic nucleus resulting from the condensation of three or more rings.

(19) The silver halide photographic emulsion as described in (1) to (18), wherein tabular grains having an aspect ratio of 2 or more are present in a proportion of 50% (area) or more of all silver halide grains in the emulsion.

(20) The silver halide photographic emulsion as described in (1) to (19), which is subjected to selenium sensitization.

(21) The silver halide photographic emulsion as described in (1) to (20), which contains a silver halide adsorptive compound other than a sensitizing dye.

(22) A silver halide photographic light-sensitive material comprising at least one layer of the silver halide photographic emulsion described in (1) to (21).

DETAILED DESCRIPTION OF THE INVENTION

The present invention is described in detail below.

The present invention relates to an emulsion freed from the problems encountered in the multilayer adsorption of a practically effective sensitizing dye on the surface of a silver halide grain.

In the present invention, the term "a sensitizing dye in the second or upper layer is present in the layer state" means that at least a part of the sensitizing dyes in the second and upper layers is present in the layer state. In this case, preferably 10% or more, more preferably 30% or more, still more preferably 50% or more, yet still more preferably 70% or more, particularly preferably 90% or more and most preferably 100% or more of the sensitizing dyes in the second and upper layers are present in the layer state.

The condition that a sensitizing dye is present in the layer state is described below.

Generally, when a thin film grows on a substrate surface, namely, when a sensitizing dye adsorbs in multiple layers in the present invention, the following three modes are considered.

1. Layer growth (layer-by-layer growth, Frank-van der Merwe type growth)
2. Island growth or growth by tertiary nucleation (nucleation and growth, Volmer-Weber type growth)
3. Mixture growth (nucleation and layer growth, Stranski-Krastanov type growth)

These growths are described in P. Bennema and G. H. Gilmer, *Crystal Growth: An Introduction,* edited by P. Hartman, North-Holland Publishing Company, Amsterdam, London, pp. 282–310 (1973), Yoshihiko Goto, *Kotai Butsuri* (*Solid Physics*), Vol. 18, No. 7, page 380 (1983), Yoshihiko Goto and Shozo Ino, *Kotai Butsuri* (*Solid Physics*), Vol. 18, No. 3, page 121 (1983), Akio Ito (compiler), *Hakumaku Zairyo Nyumon* (*Introduction of Thin Film Materials*), Shokabo (1998), Mitsumasa Iwamoto, *Yuki Cho-Hakumaku Electronics* (*Organic Ultrathin Electronics*), Baifukan (1993), Akira Yabe et al., *Yuki Cho-Hakumaku Nyumon* (*Introduction of Organic Ultrathin Film*), Baifukan (1989), *Nippon Hyomen Kagakukai Shusai Dai* 1-*Kai Hakumaku Kiso Koza Yoshi Shu* (*Summary Collection of* 1*st Elemental Lecture on Thin Film at Meeting by Japan Surface Science*), November 12/13, Tokyo (1998) and the like.

The layer growth means that out of the sensitizing dyes forming the multilayer adsorption, the sensitizing dyes in the second and upper layers grow while piling one on another in the layer form on the sensitizing dye in the first layer on a silver halide grain. This occurs when the sensitizing dye in the lower layer has a strong binding force.

The island growth means that a cluster (aggregate) of sensitizing dyes in the second and upper layers form nuclei on the sensitizing dye in the first layer and the nuclei grow like islands. This occurs when the binding force between sensitizing dyes in the second and upper layers is stronger than the constraining force from the sensitizing dye in the lower layer.

The mixture growth means that the layer growth takes place in a few layers of second and upper layers at the initial stage but thereafter, the growth changes into the island growth. This may be caused by the distortion energy accumulated in the film due to the inconsistency between the sensitizing dye in the second or upper layer and the sensitizing dye in the lower layer.

In the case where the dye in the second or upper layer forms a two-dimensional association product, the two-dimensional association product itself has a liability to grow in the layer form, therefore, even if the interaction energy with the lower dye layer adjacent thereto is relatively small, the layer adsorption is easily achieved. Therefore, the formation of a two-dimensional association product is preferred. The two-dimensional association product may have any aggregation form, however, the formation of J-association product which is described later is preferred.

In the present invention, for allowing the sensitizing dyes in the second and upper layers to be present in the layer state, the sensitizing dye preferably grows by the layer growth or mixture growth, more preferably the layer growth, out of the above-described growth modes.

In the multilayer adsorption according to conventional techniques, the sensitizing dyes in the second and upper layers are present in the island form and both the effect of improving the light absorption factor and the effect of increasing the sensitivity are not satisfied by any means.

The state how the sensitizing dyes in the second and upper layers are present may be observed by using any method, but microscopic spectrometry, STM method, AFM method, proximate site optical microscopic method, cathode luminescence method, fluorescent microscopic method, imaging SIMS method, SEM method, TEM method and the like are preferably used.

Whether or not the dye adsorbed in multiple layers is adsorbed in the layer form can be determined by the presence or absence of the fluctuation depending on the place (site) in the number of adsorbed dye layers formed on the surface of a silver halide grain or the dye amount. In the present invention, when the fluctuation depending on the place (site) in the number of adsorbed dye layers or the dye amount is within 5 times the fluctuation in the single layer adsorption, the adsorption is regarded as the layer adsorption. Of course, the smaller fluctuation reveals better layer adsorption. The fluctuation can be expressed by the standard deviation or variation coefficient (standard deviation/average) of the number of adsorbed dye layers or the dye amount every each place (site) on the silver halide grain. When the state how the sensitizing dye is present is observed using the above-described measuring method, the number of the adsorbed dye layers or the dye amount can be quantitated every each place (site) on the grain surface, therefore, by examining the fluctuation thereof, the layer adsorption or not can be determined.

With respect to the adsorbing force between sensitizing dyes, preferred conditions are described below.

The adsorption energy ($\Delta G$) of the sensitizing dyes in the second and upper layers) is preferably 20 kJ/mol or more, more preferably 30 kJ/mol or more, still more preferably 40 kJ/mol or more, yet still more preferably 42 kJ/mol or more, yet still more preferably 50 kJ/mol or more, yet still more preferably 60 kJ/mol or more, yet still more preferably 70 kJ/mol or more, and yet still more preferably 80 kJ/mol or more.

The upper bound is not particularly limited but it is preferably 5000 kJ/mol or less, more preferably 1000 kJ/mol or less.

The interaction as a source of the adsorption energy may be any bonding force but examples thereof include van der Waals force (more particularly, this is classified into orientation force working between permanent dipole and permanent dipole, induction force working between permanent dipole and induced dipole, and dispersion force working between temporary dipole and induced dipole), charge transfer (CT) force, Coulomb force (electrostatic force) hydrophobic bond force, hydrogen bond force, chemical bond force and coordinate bond force. Only one of these bonding forces may be used or a plurality of freely selected bonding forces may be used. A covalent bond is not contained only when it is described that the adsorption energy of the sensitizing dye as the dye in the second or upper layer is quantitatively 20 kJ/mol or more, which is one of the characteristic features of the present invention. The covalent bond is known to have an adsorption energy of 104 kJ/mol or more at the lowest. With respect to the case where the dye in the first layer and the dye in the second layer are linked through a covalent bond, Japanese Patent Application Nos. 11-34444, 11-34463 and 11-34462 describe linked dyes each having a specific structure. Since the dye in the second layer and the dye in the first layer are of course linked through a covalent bond, those dyes each has an adsorption energy of 104 kJ/mol or more at the lowest. The present invention has been accomplished based on the finding that an excellent effect can be obtained when the adsorption energy of the sensitizing dye in the second or upper layer exclusive of a covalent bond is 20 kJ/mol or more. However, even a linked dye may be used if the adsorption energy of the dye in the second or upper layer exclusive of a covalent bond force is 20 kJ/mol or more. Needless to say, the linked dye is included in various factors of the present invention. For example, when factors of the interaction preferred for the distribution among grains or the layer adsorption are described, the covalent bond force is duly included.

Among those, preferred are van der Waals force, charge transfer force, Coulomb force, hydrophobic bond force, hydrogen bond force and coordinate bond force, more preferred are van der Waals force, charge transfer force (CT), Coulomb force, hydrophobic bond force and hydrogen bond force, more preferred are van der Waals force, charge transfer force (CT) and Coulomb force, particularly preferred are van der Waals force and Coulomb force, and most preferred is van der Waals force.

The dye and the stabilization energy, which the interaction coming to an adsorption energy of the dye in the second or upper layer preferably works with or works at, are described below.

The case of R-layer adsorption in the second or upper layer is described below.

In this case, the stabilization energy of the interaction as a source of the adsorption force of the i-th layer dye can be divided into a stabilization energy of the interaction between the i-th layer dye and the (i−1)-th layer dye ($\Delta Gi(i-1)$), the stabilization energy of the interaction between the i-th layer dye and the i-th layer dye (Gii), and the stabilization energy of the interaction between the i-th layer dye and the (i+1)-th layer dye ($\Delta Gi(i+1)$) (wherein i is 2 or more).

At this time, the following 1, 2 and 3 are preferred in this order. In the case of i=R (namely, the uppermost layer), $\Delta Gi(i+1)$ is not present.

1. $\Delta Gi(i-1)>(Xi(i-1))$ kJ/mol and/or $\Delta Gii>(Xii)$ kJ/mol and/or $\Delta Gi(i+1)>(Xi(i+1))$ kJ/mol.
2. $\Delta Gi(i-1)>(Xi(i-1))$ kJ/mol and $\Delta Gii>(Xii)$ kJ/mol and $\Delta Gi(i+1)>(Xi(i+1))$ kJ/mol.
3. In 1 and 2, further $\Delta Gi(i-1)>\Delta Gii$, $\Delta Gi(i+1)>\Delta Gii$.

The values of Xi(i−1), Xii and Xi(i+1) each is preferably 10, 20, 30, 40, 50, 60, 70 and 80 in this order.

An interaction is present also between the i-th layer dye and the (i−2)-th layer dye, between the i-th layer dye and the (i+2)-th layer dye, between the i-th layer dye and a silver halide grain, and the like, however, these are a long-distance interaction and can be neglected.

The sensitizing dye in the first layer is also preferably present in the layer state. In general, the interaction between a silver halide grain and the sensitizing dye in the firs layer is strong, therefore, the first layer grows in the layer form to exist in the layer state in many cases.

The adsorption energy of a dye and the stabilization energy of an interaction as a source of the adsorption energy may be measured by any method.

For example, the adsorption energy of a dye may be measured by a thermodynamic determination method according to a method using a dye desorbing agent, which is described later (the method using a dye desorbing agent is described in a report by Asanuma et al., *Journal of Physical Chemistry B,* Vol. 101, pp. 2149–2153 (1997)), by a method of determining the adsorption energy from an adsorption isotherm (this method is described, for example, in W. West, *Journal of Physical Chemistry,* Vol. 56, page 1054 (1952), however, as described later, a method of dissolving silver halide grains precipitated and determining the dye adsorbed amount is useful) according to a method of determining the adsorbed amount of a dye which is described later, or a method of determining the adsorption energy using a calorimeter (a method described, for example, in Asanuma et al., *Journal of Physical Chemistry B,* Vol. 101, pp. 2149–2153 (1997)). In addition, computational chemistry such as calculation of molecular orbital and calculation of molecular force field may also be used.

The stabilization energy of the interaction as a source of the adsorption energy can also be determined using the above-described methods.

For example, in the case of two-layer adsorption, the adsorption energy of the second layer dye can be determined by the above-described method. Then, the stabilization energy of the interaction between the dyes in the second layer is determined. With respect to the method therefor, the stabilization energy can be experimentally determined using, for example, a method by Matsubara and Tanaka (see, *Nippon Shashin Gakkai Shi* (*Journal of Japan Photographic Society*), Vol. 52, page 395 (1989)). More specifically, the stabilization energy can be obtained from the change in the absorption ascribable to the association of the dyes in the second layer with each other occurred when the concentration of the second layer dye is variously changed at various temperatures in a gelatin solution where only silver halide grains are removed from the emulsion used. Also, computational chemistry such as calculation of molecular orbital and calculation of molecular force field may be used.

At this time, the (stabilization energy of interaction between first layer dye and second layer dye) can be obtained from the formula: (adsorption energy of second layer dye)=(stabilization energy of interaction between first layer dye and second layer dye)+(stabilization energy of interaction between dyes in the second layer).

In the case of three-layer adsorption, the stabilization energy of the interaction as a source of the adsorption energy of the third layer dye can be determined in the same manner as that of the second layer dye. At this time, a formula: (adsorption energy of second layer dye)=(stabilization energy of interaction between first layer dye and second layer dye)+(stabilization energy of interaction between dyes in the second layer)+(the stabilization energy of interaction between second layer dye and third layer dye) is established and since the (stabilization energy of interaction between second layer dye and third layer dye) is the same as (stabilization energy of interaction between third layer dye and second layer dye), all can be obtained.

In the case of adsorption in four or more layers, all can also be obtained in the same manner.

The preferred conditions of the adsorption energy between sensitizing dyes are described below by another expression.

Assuming that the surface energy density of the sensitizing dye in the first layer is $\sigma 1$ and the surface energy density of the sensitizing dye in the second layer grown on the first layer is $\sigma 2$, the interface energy density $\sigma 21$ on their adhesion is defined by $\sigma 21=\sigma 2+\sigma 1-\gamma$. $\gamma$ is an adhesion energy density of the sensitizing dye in the second layer to the sensitizing dye in the first layer.

With $\gamma<0$, the sensitizing dye in the second layer does not adsorb to the sensitizing dye in the first layer in many cases, failing in forming multilayer adsorption. With $\gamma>0$, the interfacial surface energy decreases due to the adsorption, therefore, the sensitizing dye in the second layer grows on the sensitizing dye in the first layer. When $\sigma21 \leqq \sigma1-\sigma2$ is satisfied, layer growth is advantageous, whereas when $\sigma1-\sigma2<\sigma21<\sigma2+\sigma1$ is satisfied, island growth is advantageous. Accordingly, in the present invention, $\sigma21 \leqq \sigma1-\sigma2$ is preferably satisfied.

In the present invention, the light absorption strength is an integrated strength of light absorption by a sensitizing dye per the unit grain surface area and defined as a value obtained, assuming that the quantity of light incident on the unit surface area of a grain is $I_0$ and the quantity of light absorbed into a sensitizing dye on the surface is I, by integrating the optical density $\mathrm{Log}(I_0/(I_0-I))$ with respect to the wave number ($cm^{-1}$). The integration range is from 5,000 $cm^{-1}$ to 35,000 $cm^{-1}$.

The silver halide photographic emulsion of the present invention preferably contains a silver halide grain having a light absorption strength of 100 or more in the case of a grain having a spectral absorption maximum wavelength of 500 nm or more, or having a light absorption strength of 60 or more in the case of a grain having a spectral absorption maximum wavelength of less than 500 nm, in a proportion of a half or more of the entire projected area of all silver halide grains. In the case of a grain having a spectral absorption maximum wavelength of 500 nm or more, the light absorption strength is preferably 150 or more, more preferably 170 or more, still more preferably 200 or more. In the case of a grain having a spectral absorption maximum wavelength of less than 500 nm, the light absorption strength is preferably 90 or more, more preferably 100 or more, still more preferably 120 or more. The upper bound is not particularly limited but it is preferably 2,000 or less, more preferably 1,000 or less, still more preferably 500 or less.

The spectral absorption maximum wavelength of a grain having a spectral absorption maximum wavelength of less than 500 nm is preferably 350 nm or more.

One example of the method for measuring the light absorption strength is a method using a microspectrophotometer. The microspectrophotometer is a device capable of measuring the absorption spectrum of a microscopic area and can measure the transmission spectrum of one grain. The measurement of absorption spectrum of one grain by the microspectrometry is described in the report by Yamashita et al. (Nippon Shashin Gakkai, 1996 *Nendo Nenji Taikai Ko'en Yoshi Shu* (*Lecture Summary at Annual Meeting of Japan Photographic Association in* 1996), page 15). From this absorption spectrum, an absorption strength per one grain can be obtained, however, the light transmitting the grain is absorbed on two surfaces of upper surface and lower surface, therefore, the absorption strength per unit on the grain surface can be obtained as a half (½) of the absorption strength per one grain obtained by the above-described method. At this time, the segment for the integration of absorption spectrum is from 5,000 to 35,000 $cm^{-1}$ in the definition, however, in experiments, the segment for the integration may contain the region of 500 $cm^{-1}$ shorter or longer than the segment having absorption by the sensitizing dye.

The light absorption strength is a value indiscriminately determined by the oscillator strength of sensitizing dye and the number of molecules adsorbed per unit area, therefore, it is possible to obtain the oscillator strength of sensitizing dye, the amount of dye adsorbed and the surface area of grain and convert these into the light absorption strength.

The oscillator strength of sensitizing dye can be experimentally obtained as a value in proportion to the absorption integrated strength (optical density×$cm^{-1}$) of a sensitizing dye solution. Therefore, assuming that the absorption integrated strength of a dye per 1 M is A (optical density×$cm^{-1}$), the amount of sensitizing dye adsorbed is B (mol/mol-Ag) and the surface area of grain is C ($m^2$/mol-Ag), the light absorption strength can be obtained according to the following formula within an error of about 10%:

$$0.156 \times A \times B/C$$

The light absorption strength calculated from this formula is substantially the same as the light absorption strength measured based on the above-described definition (a value obtained by the integration of $\mathrm{Log}(I_0/(I_0-I))$ with respect to the wave number ($cm^{-1}$)).

For increasing the light absorption strength, a method of allowing a dye chromophore to adsorb in one or more layers onto the grain surface, a method of increasing the molecular extinction coefficient of dye and a method of reducing the dye occupation area may be used. Any of these methods may be used but preferred is the method of allowing a dye chromophore to adsorb in one or more layers onto the grain surface.

Here, the state where a dye chromophore is adsorbed in one or more layers onto the grain surface means that the dye bounded to the vicinity of a silver halide grain is present in one or more layers. Dyes present in the dispersion medium is not included. Also, even in the case where a dye chromophore is linked with a substance adsorbed to the grain surface through a covalent bond, if the linking group is very long and the dye chromophore is present in the dispersion medium, this is not regarded as the adsorption in one or more layers because the effect of increasing the light absorption strength is small. In the case of so-called multilayer adsorption where a dye chromophore is adsorbed in one or more layers onto the grain surface, spectral sensitization need be generated by the dye not directly adsorbed to the grain surface and to this purpose, an excitation energy must be transmitted from the dye not directly adsorbed to silver halide to the dye directly adsorbing to a grain. Therefore, excitation energy transmission which is required to pass through over 10 stages is not preferred because the transmission efficiency of excitation energy finally decreases. One example of such a case is a polymer dye described in JP-A-2-113239 where a majority of dye chromophores are present in a dispersion medium and the excitation energy must be transmitted through over 10 stages.

In the present invention, the number of stages necessary for the dye to form a color per one molecule is preferably from 1 to 3, more preferably from 1 to 2.

The "chromophore" as used herein is defined in *Rikagaku Jiten* (*Physicochemical Dictionary*), 4th ed., pp. 985–986, Iwanami Shoten (1987) and means an atomic group which works out to a main cause for the absorption band of a molecule. Any atomic group, for example, an atomic group having an unsaturated bond such as C═C or N═N, may be used.

Examples thereof include cyanine dyes, styryl dyes, hemicyanine dyes, merocyanine dyes, trinuclear merocyanine dyes, tetranuclear merocyanine dyes, rhodacyanine dyes, complex cyanine dyes, complex merocyanine dyes, allopolar dyes, oxonol dyes, hemioxonol dyes, squarium dyes, croconium dyes, azamethine dyes, coumarin dyes, arylidene dyes, anthraquinone dyes, triphenylmethane dyes, azo dyes, azomethine dyes, spiro compounds, metallocene dyes, fluorenone dyes, fulgide dyes, perylene dyes, phenazine dyes, phenothiazine dyes, quinone dyes, indigo dyes, diphenylmethane dyes, polyene dyes, acridine dyes, acridinone dyes, diphenylamine dyes, quinacridone dyes, quinophthalone dyes, phenoxazine dyes, phthaloperylene dyes, porphyrin dyes, chlorophile dyes, phthalocyanine dyes and metal complex dyes.

Among these, preferred are cyanine dyes, styryl dyes, hemicyanine dyes, merocyanine dyes, trinuclear merocyanine dyes, tetranuclear merocyanine dyes, rhodacyanine dyes, complex cyanine dyes, complex merocyanine dyes, allopolar dyes, oxonol dyes, hemioxonol dyes, squarium dyes, croconium dyes and polymethine chromophores such as azamethine dyes, more preferred are cyanine dyes, merocyanine dyes, trinuclear merocyanine dyes, tetranuclear merocyanine dyes and rhodacyanine dyes, still more preferred are cyanine dyes, merocyanine dyes and rhodacyanine dyes, and most preferred are cyanine dyes.

These dyes are described in detain in F. M. Harmer, *Heterocyclic Compounds—Cyanine Dyes and Related Compounds,* John Wiley & Sons, New York, London (1964), D. M. Sturmer, *Heterocyclic Compounds—Special topics in heterocyclic chemistry,* Chap. 18, Section 14, pp. 482–515. Examples of the formulae of preferred dyes include the formulae described at pages 32 to 36 of U.S. Pat. No. 5,994,051 and the formulae described at pages 30 to 34 of U.S. Pat. No. 5,757,236. For cyanine dyes, merocyanine dyes and rhodacyanine dyes, formulae (XI), (XII) and (XIII) described in columns 21 to 22 of U.S. Pat. No. 5,340,694 are preferred (on the condition that the numbers of n12, n15, n17 and n18 are not limited and each is an integer of 0 or more (preferably 4 or less)).

The dye chromophore is preferably adsorbed to a silver halide grain in 1.5 or more layers, more preferably 1.7 or more layers, still more preferably in 2 or more layers. The upper bound is not particularly limited, however, it is preferably 10 or less layers, more preferably 5 or less layers.

In the present invention, the state where a chromophore is adsorbed in more than one layers onto the surface of a silver halide grain means a state where, by defining the saturation adsorbed amount per unit surface area achieved by a dye having a smallest dye occupation area on the surface of a silver halide grain out of the sensitizing dyes added to an emulsion as a single layer saturation coverage, the adsorbed amount of a dye chromophore per unit layer is larger than the single layer saturation coverage. The adsorbed layer number means an adsorbed amount based on the single layer saturation coverage. In the case of a dye where dye chromophores are linked through a covalent bond, the adsorbed layer number may be based on the dye occupation area of individual dyes in their unlinked state.

The dye occupation area can be obtained from an adsorption isotherm showing the relationship between the free dye concentration and the dye adsorbed amount, and a grain surface area. The adsorption isotherm may be obtained by referring, for example, to A. Herz et al., *Adsorption from Aqueous Solution, Advances in chemistry Series*), No. 17, page 173 (1968).

For determining the amount of a sensitizing dye adsorbed to an emulsion grain, two methods may be used, namely, one is a method of centrifuging an emulsion having adsorbed thereto a dye, separating the emulsion grains from the supernatant aqueous gelatin solution, measuring the spectral absorption of the supernatant to obtain a non-adsorbed dye concentration, and subtracting the concentration from the amount of dye added, thereby determining the dye adsorbed amount, and another is a method of drying the emulsion grains precipitated, dissolving a predetermined weight of the precipitate in a 1:1 mixed solution of aqueous sodium thiosulfate solution and methanol, and measuring the spectral absorption, thereby determining the dye adsorbed amount. In the case where a plurality of dyes are used, the adsorbed amount of individual dyes may also be determined using a means such as high-performance liquid chromatography. The method of determining the adsorbed dye amount by quantitating the amount of dye in the supernatant is described, for example, in W. West et al., *Journal of Physical Chemistry,* Vol. 56, page 1054 (1952). However, under the conditions that the amount of dye added is large, even non-adsorbed dyes may precipitate and exact determination of the adsorbed amount may not be obtained by the method of quantitating the dye concentration in the supernatant. On the other hand, according to the method of dissolving silver halide grains precipitated and measuring the adsorbed dye amount, the amount of only the dye adsorbed to grains can be exactly determined because the emulsion grain is by far higher in the precipitation rate and the grains can be easily separated from the precipitated dye. This method is most reliable for determining the adsorbed dye amount.

The amount of a photographically useful compound adsorbed to a grain can also be measured in the same manner as the sensitizing dye, however, since the absorption in the visible region is small, a quantitative method using high performance liquid chromatography is more preferred than the quantitative method by spectral absorption.

As one example of the method for measuring the surface area of a silver halide grain, a method of taking a transmission electron microscopic photograph by a replica process and calculating the shape and size of individual grains may be used. In this case, the thickness of a tabular grain is calculated from the length of a shadow of the replica. The transmission electron microscopic photograph may be taken by a method described, for example, in *Denshi Kenbikyo Shiryo Gijutsu Shu* (*Electron Microscopic Sample Technologies*), Nippon Denshi Kenbikyo Gakkai Kanto Shibu (compiler), Seibundo Shinko Sha (1970), and P. B. Hirsch et al., *Electron Microscopy of Thin Crystals,* Butterworths, London (1965).

Other examples of the measuring method are described in A. M. Kragin et al., *The Journal of Photographic Science,* Vol. 14, page 185 (1966), J. F. Paddy, *Transactions of the Faraday Society,* Vol. 60, page 1325 (1964), S. Boyer et al., *Journal de Chimie Physique et de Physicochimie Biologique,* Vol. 63, page 1123 (1963), W. West et al., *Journal of Physical Chemistry,* Vol. 56, page 1054 (1952), E. Klein et al., *International Colloquium,* compiled by H. Sauvernier, and *Scientific Photography,* Liege (1959).

The dye occupation area of individual grains may be experimentally determined by the above-described methods, however, the molecular occupation area of sensitizing dyes used is usually present almost in the vicinity of 80 $Å^2$, therefore, the adsorbed layer number can be roughly estimated by a simple method of counting the dye occupation area of all dyes as 80 $Å^2$.

In the present invention, when a dye chromophore is adsorbed in multiple layers onto a silver halide grain, the dye chromophore directly adsorbing to the silver halide grain, namely, the dye chromophore in the first layer, and the dye chromophore in the second or upper layer may have any reduction potential and any oxidation potential, however, the reduction potential of the dye chromophore in the first layer is preferably higher than the value obtained by subtracting 0.2 V from the reduction potential of the dye chromophore in the second or upper layer. The phrase "the reduction potential of the dye chromophore is higher" as used herein means that "the dye chromophore is apt to be reduced".

The reduction potential and the oxidation potential can be measured by various methods, however, these are preferably measured by phase discrimination-type second harmonic a.c. polarography for obtaining exact values. The method for measuring the potential by phase discrimination-type second harmonic a.c. polarography is described in *Journal of Imaging Science,* Vol. 30, page 27 (1986).

The dye chromophore in the second or upper layer is preferably a light-emitting dye. The light-emitting dye preferably has a skeleton structure of dyes used for dye laser. These are described, for example, in Mitsuo Maeda, *Laser Kenkyu* (*Study of Laser*), Vol. 8, page 694, page 803 and page 958 (1980), ibid., Vol. 9, page 85 (1981), and F. Schaefer, *Dye Lasers,* Springer (1973).

The absorption maximum wavelength of the dye chromophore in the first layer in a silver halide photographic light-sensitive material is preferably longer than the absorption maximum wavelength of the dye chromophore in the second or upper layer. Furthermore, the light emission of the dye chromophore in the second or upper layer preferably overlaps the absorption of the dye chromophore in the first layer. In addition, the dye chromophore in the first layer preferably forms J-association product. In order to have absorption and spectral sensitivity in a desired wavelength range, the dye chromophore in the second or upper layer also preferably forms a J-association product.

The excitation energy of the second layer dye preferably has an energy transfer efficiency to the first layer dye of 30% or more, more preferably 60% or more, still more preferably 90% or more. The term "excitation energy of the second layer dye" as used herein means the energy of a dye in the excited state produced as a result of the second layer dye and upper layer dye absorbing light energy. When excitation energy of a certain molecule transfers to another molecule, the excitation energy is considered to transfer through excitation electron transfer mechanism, Forster model energy transfer mechanism, Dextor model energy transfer mechanism or the like. Therefore, it is also preferred for the multilayer adsorption system of the present invention to satisfy the conditions for causing an efficient excitation energy transfer achievable by these mechanisms, more preferably to satisfy the conditions for causing Forster model energy transfer mechanism. In order to elevate the efficiency of the Forster model energy transfer, reduction in the reflectance in the vicinity of the surface of an emulsion grain is effective.

The efficiency of the energy transfer from the second layer dye and upper layer dye to the first layer dye can be obtained as the spectral sensitization efficiency at the excitation of the second layer dye/spectral sensitization efficiency at the excitation of the first layer dye.

The meanings of the terms used in the present invention are described below.

Dye Occupation Area:

An occupation area per one dye molecule. This can be experimentally determined from the adsorption isotherm. In the case of a dye where dye chromophores are linked through a covalent bond, the dye occupation area of unlinked individual dyes is used as a base. This is simply 80 $Å^2$.

Single Layer Saturation Coverage:

An adsorbed dye amount per unit grain surface area at the time of single layer saturation covering. A reciprocal of the minimum dye occupation area among dyes added.

Multilayer Adsorption:

A state where the adsorbed amount of a dye chromophore per unit grain surface area is larger than the single layer saturation coverage.

Adsorbed Layer Number:

An adsorbed amount of a dye chromophore per unit grain surface area based on the single layer saturation coverage.

The distribution of the light absorption strength among grains can be expressed as a variation coefficient of the light absorption strength of 100 or more grains randomly measured by the microspectrometry. The variation coefficient can be obtained as 100×standard deviation/average (%). The light absorption strength is a value in proportional to the adsorbed dye amount, therefore, the distribution of the light absorption strength among grains can be said in other words as the distribution of the adsorbed dye amount among grains. The variation coefficient of the distribution of the light absorption strength among grains is preferably 60% or less, more preferably 30% or less, still more preferably 10% or less.

The variation coefficient of the distribution among grains of the distance between the shortest wavelength showing 50% of the maximum absorption (Amax) of a sensitizing dye and the longest wavelength showing 50% of Amax is preferably 30% or less, more preferably 10% or less, still more preferably 5% or less.

With respect to the absorption maximum wavelength of the sensitizing dye every each grain, grains in a proportion preferably of 70% or more, more preferably 90% or more of the projected area have an absorption maximum at a wavelength range of 10 nm or less. In a more preferred embodiment of the absorption maximum wavelength of the sensitizing dye every each grain, grains in a proportion preferably of 50% or more, more preferably 70% or more, still more preferably 90% or more have an absorption maximum at a wavelength range of 5 nm or less.

The distribution among grains of the light absorption strength (namely, dye adsorbed amount) is known to become uniform as the dye adsorbed amount increases in the case of single layer adsorption where the adsorption site is fixed to the surface of a silver halide grain. However, in the case of multilayer adsorption of the present invention, it has been found that when not only two-layer adsorption but also adsorption in several layers can be attained, the adsorption site is not limited and a distribution is very readily generated among grains, for example, single-layer adsorption for a certain grain and three-layer adsorption for another grain. As a result of analysis, it has been clarified that as the ratio of the interaction energy between dyes in the second layer increases based on the entire adsorption energy of the second layer dye (in other words, the ratio of the interaction energy between the first layer dye molecule and the second layer dye molecule relatively decreases), the multilayer adsorption system is liable to have non-uniformity in the adsorbed dye amount among grains. The interaction energy between the first layer dye molecule and the second layer dye molecule is preferably 20% or more, more preferably 40% or more, based on the entire adsorption energy of the second layer dye.

In order to intensify the interaction between the first layer dye and the second layer dye, it is preferred to use an electrostatic interaction between the first layer dye molecule and the second layer dye molecule, van der Waals interaction, a hydrogen bond, a coordinate bond or a composite interaction force thereof. Although the main interaction between two layer dyes is preferably van der Waals interaction between dye chromophores, it is also preferred to use an electrostatic interaction, van der Waals interaction, a hydrogen bond, a coordinate bond or a composite interaction force thereof.

The ratio of the interaction energy between the first layer dye molecule and the second layer molecule to the entire adsorption energy of the second layer dye can be measured by the same method described with respect to the layer adsorption.

The distribution of the adsorbed dye amount among grains is also affected by the adding conditions of the dye. A method of adding a dye at a low temperature and thereafter elevating the temperature is preferred.

In the emulsion containing a silver halide photographic emulsion grain having a light absorption strength of 60 or more or 100 or more, the distance between the shortest wavelength showing 50% of a maximum value Amax of the spectral absorption factor by a sensitizing dye and showing 50% of a maximum value Smax of the spectral sensitivity and the longest wavelength showing 50% of Amax and 50% of Smax is preferably 120 nm or less, more preferably 100 nm or less.

The distance between the shortest wavelength showing 80% of Amax and 80% of Smax and the longest wavelength showing 80% of Amax and 80% of Smax is preferably 20 nm or more, more preferably 100 nm or less, still more preferably 80 nm or less, particularly preferably 50 nm or less.

The distance between the shortest wavelength showing 20% of Amax and 20% of Smax and the longest wavelength showing 20% of Amax and 20% of Smax is preferably 180 nm or less, more preferably 150 nm or less, still more preferably 120 nm or less, most preferably 100 nm or less.

The longest wavelength showing 50% of Amax and 50% of Smax is preferably from 460 to 510 nm, from 560 nm to 610 nm, or from 640 to 730 nm.

For realizing a silver halide grain having a spectral absorption maximum wavelength of less than 500 nm and a light absorption strength of 60 or more or having a spectral absorption maximum wavelength of 500 nm or more and a light absorption strength of 100 or more, a first preferred method is a method of using a specific dye described below.

For example, a method of using a dye having an aromatic group or using a cationic dye having an aromatic group and an anionic dye in combination described in JP-A-10-239789, JP-A-8-269009, JP-A-10-123650 and JP-A-8-328189, a method of using a dye having a polyvalent electric charge described in JP-A-10-171058, a method of using a dye having a pyridinium group described in JP-A-10-104774, a method of using a dye having a hydrophobic group described in JP-A-10-186559, a method of using a dye having a coordinate bond group described in JP-A-10-197980, and a method of using a specific dye described in Japanese Patent Application Nos. 11-63588, 11-80141, 11-159731, 11-159730, 11-171324, 11-221479, 11-265769, 11-260643, 11-331571, 1-331570, 11-311039, 11-331567, 11-347781 and 2000-18966 are preferred.

Among these, preferred is a method of using a dye having at least one aromatic group, and more preferred is a method of using only a positively charged dye, a dye cancelled in the electric charge within the molecule or a dye having no electric charge, or a method of using a positively charged dye and a negatively charged dye in combination where at least one of the positively charged dye and the negatively charged dye is a dye having at least one aromatic group as a substituent.

The aromatic group is described in detail below. The aromatic group includes a hydrocarbon aromatic group and a heterocyclic aromatic group. The group may have a polycyclic condensation structure obtained by condensing a hydrocarbon aromatic ring or a heterocyclic aromatic ring to each other or a polycyclic condensation structure obtained by combining an aromatic hydrocarbon group and an aromatic heterocyclic ring, and may be substituted by a substituent V which will be described later. Examples of the aromatic ring which is preferably contained in the aromatic group include benzene, naphthalene, anthracene, phenanthrene, fluorene, triphenylene, naphthacene, biphenyl, pyrrole, furan, thiophene, imidazole, oxazole, thiazole, pyridine, pyrazine, pyrimidine, pyridazine, indolizine, indole, benzofuran, benzothiophene, isobenzofuran, quinolizine, quinoline, phthalazine, naphthylidine, quinoxaline, quinoxazoline, quinoline, carbazole, phenanthridine, acridine, phenanthroline, thianthrene, chromene, xanthene, phenoxathine, phenothiazine and phenazine.

Among these, preferred are the hydrocarbon aromatic rings, more preferred are benzene and naphthalene, and most preferred is benzene.

Examples of the dye include the dyes described above as examples of the dye chromophore. Among these, preferred are dyes described above as examples of the polymethine dye chromophore.

More preferred are cyanine dyes, styryl dyes, hemicyanine dyes, merocyanine dyes, trinuclear merocyanine dyes, tetranuclear merocyanine dyes, rhodacyanine dyes, complex cyanine dyes, complex merocyanine dyes, allopolar dyes, oxonol dyes, hemioxonol dyes, squarium dyes, croconium dyes and azamethine dyes, still more preferred are cyanine dyes, merocyanine dyes, trinuclear merocyanine dyes, tetranuclear merocyanine dyes and rhodacyanine dyes, particularly preferred are cyanine dyes, merocyanine dyes and rhodacyanine dyes, and most preferred are cyanine dyes.

Particularly preferred methods are described in detail below by referring to structural formulae.

The methods (1) and (2) are preferred. Of the methods (1) and (2), the method (2) is more preferred.

(1) A method of using at least one cationic, betaine or nonionic methine dye represented by the following formula (I); and (2) A method of simultaneously using at least one cationic methine dye represented by the following formula (I) and at least one anionic methine dye represented by the following formula (II):

(I)

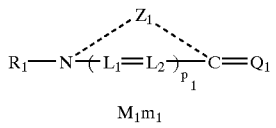

wherein $Z_1$ represents an atomic group necessary for forming a nitrogen-containing heterocyclic ring, provided that a ring may be condensed to $Z_1$, $R_1$ represents an alkyl group, an aryl group or a heterocyclic group, $Q_1$ represents a group necessary for allowing the compound represented by formula (I) to form a methine dye, $L_1$ and $L_2$ each represents a methine group, $p_1$ represents 0 or 1, provided that $Z_1$, $R_1$, $Q_1$, $L_1$ and $L_2$ each has a substituent which allows the methine dye represented by formula (I) as a whole to form a cationic dye, a betaine dye or a nonionic dye and in the case where formula (I) is a cyanine dye or a rhodacyanine dye, $Z_1$, $R_1$, $Q_1$, $L_1$ and $L_2$ each preferably has a substituent which allows the methine dye represented by formula (I) as a whole to form a cationic dye, $M_1$ represents a counter ion for balancing the electric charge, and $m_1$ represents a number of 0 or more necessary for neutralizing the electric charge of the molecule;

(II)

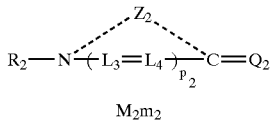

wherein $Z_2$ represents an atomic group necessary for forming a nitrogen-containing heterocyclic ring, provided that a ring may be condensed to $Z_2$, $R_2$ represents an alkyl group, an aryl group or a heterocyclic group, $Q_2$ represents a group necessary for allowing the compound represented by formula (II) to form a methine dye, $L_3$ and $L_4$ each represents a methine group, $p_2$ represents 0 or 1, provided that $Z_2$, $R_2$, $Q_2$, $L_3$ and $L_4$ each has a substituent which allows the methine dye represented by formula (II) as a whole to form an anionic dye, $M_2$ represents a counter ion for balancing the electric charge, and $m_2$ represents a number of 0 or more necessary for neutralizing the electric charge of the molecule.

In the case of using the compound represented by formula (I) alone, $R_1$ is preferably a group having an aromatic ring.

In the case of using the compound represented by formula (I) and the compound represented by formula (II) in combination, preferably, at least one of $R_1$ and $R_2$ is a group having an aromatic ring, and more preferably, $R_1$ and $R_2$ both are a group having an aromatic ring.

The cationic dye for use in the present invention may be any as long as the electric charge of the dye exclusive of the counter ion is cationic, but a dye having no anionic substituent is preferred. The anionic dye for use in the present invention may be any as long as the electric charge of the dye exclusive of the counter ion is anionic, but a dye having one or more anionic substituent is preferred. The betaine dye for use in the present invention is a dye having an electric charge within the molecule, where, however, an inner salt is formed and the molecule as a whole has no electric charge. The nonionic dye for use in the present invention is a dye not having an electric charge at all within the molecule.

The term "anionic substituent" as used herein means a substituent having a negative charge. Examples thereof include a proton-dissociative acidic group having a dissociation ratio of 90% or more at a pH of from 5 to 8. Specific examples thereof include a sulfo group, a carboxyl group, a sulfate group, a phosphoric acid group, a boric acid group and a group from which a proton dissociates depending on the pKa thereof and the pH in the environment, such as —$CONHSO_2$— group (e.g., sulfonylcarbamoyl group, carbamoylsulfamoyl group), —CONHCO— group (e.g., carbonylcarbamoyl group), —$SO_2NHSO_2$— group (e.g., sulfonylsulfamoyl group) and phenolic hydroxyl group. Among these, preferred are a sulfo group, a carboxyl group, —$CONHSO_2$— group, —CONHCO— group and —$SO_2NHSO_2$— group.

From the —$CONHSO_2$— group, the —CONHCO— group and the —$SO_2NHSO_2$— group, a proton may not dissociates depending on the pKa thereof and the pH in the environment. In such a case, these groups are not included in the anionic substituent referred to herein. In other words, in the case where a proton does not dissociates, even if two of such groups are substituted, for example, to a dye represented by formula (I-1) which is described later, the dye can be regarded as a cationic dye.

Examples of the cationic substituent include a substituted or unsubstituted ammonium group and a pyridium group.

The dye represented by formula (I) is more preferably represented by the following formula (I-1), (I-2) or (I-3):

(I-1)

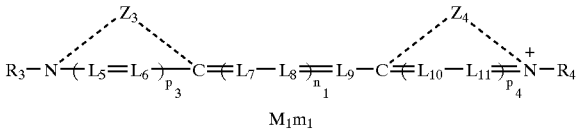

wherein $L_5$, $L_6$, $L_7$, $L_8$, $L_9$, $L_{10}$ and $L_{11}$ each represents a methine group, $p_3$ and $p_4$ each represents 0 or 1, $n_1$ represents 0, 1, 2, 3 or 4, $Z_3$ and $Z_4$ each represents an atomic group necessary for forming a nitrogen-containing heterocyclic ring, provided that a ring may be condensed to $Z_3$ and $Z_4$, $R_3$ and $R_4$ each represents an alkyl group, an aryl group or a heterocyclic group, and $M_1$ and $m_1$ have the same meanings as in formula (I), provided that $R_3$, $R_4$, $Z_3$, $Z_4$ and $L_5$ to $L_{11}$ each has no anionic substituent when the dye (I-1) is a cationic dye, and has one anionic substituent when the dye (I-1) is a betaine dye;

(I-2)

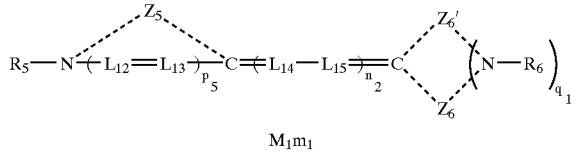

wherein $L_{12}$, $L_{13}$, $L_{14}$ and $L_{15}$ each represents a methine group, $p_5$ represents 0 or 1, $q_1$ represents 0 or 1, $n_2$ represents 0, 1, 2, 3 or 4, $Z_5$ represents an atomic group necessary for forming a nitrogen-containing heterocyclic ring, $Z_6$ and $Z_6'$ each represents an atomic group necessary for forming a heterocyclic ring or acyclic acidic terminal group together with $(N—R_6)_{q1}$, provided that a ring may be condensed to $Z_5$, $Z_6$ and $Z_6'$, $R_5$ and $R_6$ each represents an alkyl group, an aryl group or a heterocyclic group, and $M_1$ and $m_1$ have the same meanings as in formula (I), provided that $R_5$, $R_6$, $Z_5$, $Z_6$, $Z_6'$ and $L_{12}$ to $L_{15}$ each has a cationic substituent when the dye (I-2) is a cationic dye, has one cationic substituent and one anionic substituent when the dye (I-2) is a betaine dye, and has neither cationic substituent nor anionic substituent when the dye (I-2) is a nonionic dye;

(I-3)

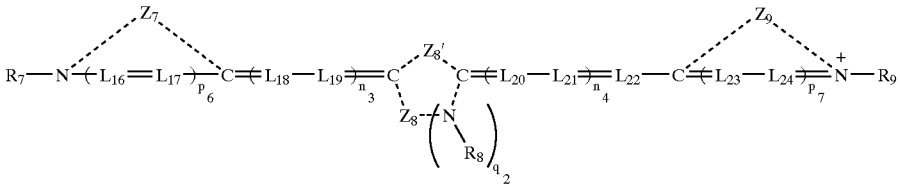

$M_1m_1$ wherein $L_{16}$, $L_{17}$, $L_{18}$, $L_{19}$, $L_{20}$, $L_{21}$, $L_{22}$, $L_{23}$ and $L_{24}$ each represents a methine group, $p_6$ and $p_7$ each represents 0 or 1, $q_2$ represents 0 or 1, $n_3$ and $n_4$ each represents 0, 1, 2, 3 or 4, $Z_7$ and $Z_9$ each represents an atomic group necessary for forming a nitrogen-containing heterocyclic ring, $Z_8$ and $Z_8'$ each represents an atomic group necessary for forming a heterocyclic ring together with $(N—R_8)_{q2}$, provided that a ring may be condensed to $Z_7$ $Z_8$, $Z_8'$ and $Z_9$, $R_7$, $R_8$ and $R_9$ each represents an alkyl group, an aryl group or a heterocyclic group, and $M_1$ and $m_1$ have the same meanings as in formula (I), provided that $R_7$, $R_8$, $R_9$, $Z_7$, $Z_8$, $Z_8'$, $Z_9$ and $L_{16}$ to $L_{24}$ each has no anionic substituent when the dye (I-3) is a cationic dye, and has an anionic substituent when the dye (I-3) is a betaine dye.

The anionic dye represented by formula (II) is more preferably represented by the following formula (II-1), (II-2) or (II-3):

(II-1)

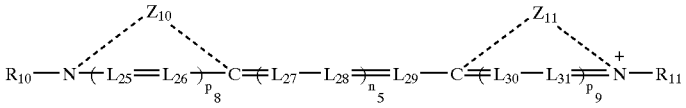

$M_2m_2$ wherein $L_{25}$, $L_{26}$, $L_{27}$, $L_{28}$, $L_{29}$, $L_{30}$ and $L_{31}$ each represents a methine group, $p_8$ and $p_9$ each represents 0 or 1, $n_5$ represents 0, 1, 2, 3 or 4, $Z_{10}$ and $Z_{11}$ each represents an atomic group necessary for forming a nitrogen-containing heterocyclic ring, provided that a ring may be condensed to $Z_{10}$ and $Z_{11}$, $R_{10}$ and $R_{11}$ each represents an alkyl group, an aryl group or a heterocyclic group, and $M_2$ and $m_2$ have the same meanings as in formula (II), provided that $R_{10}$ and $R_{11}$ each has an anionic substituent;

(II-2)

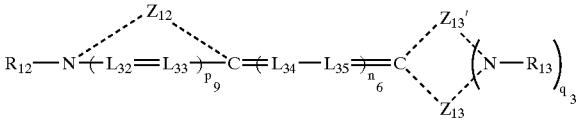

$M_2m_2$ wherein $L_{32}$, $L_{33}$, $L_{34}$ and $L_{35}$ each represents a methine group, $p_9$ represents 0 or 1, $q_3$ represents 0 or 1, $n_6$ represents 0, 1, 2, 3 or 4, $Z_{12}$ represents an atomic group necessary for forming a nitrogen-containing heterocyclic ring, $Z_{13}$ and $Z_{13}'$ each represents an atomic group necessary for forming a heterocyclic or acyclic acidic terminal group together with $(N—R_{13})_{q3}$, provided that a ring may be condensed to $Z_{12}$, $Z_{13}$ and $Z_{13}'$, $R_{12}$ and $R_{13}$ each represents an alkyl group, an aryl group or a heterocyclic group, and $M_2$ and $m_2$ have the same meanings as in formula (II), provided that at least one of $R_{12}$ and $R_{13}$ has an anionic substituent;

(II-3)

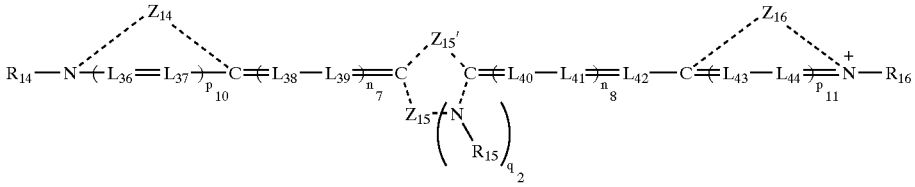

$M_2m_2$ wherein $L_{36}$, $L_{37}$, $L_{38}$, $L_{39}$, $L_{40}$, $L_{41}$, $L_{42}$, $L_{43}$ and $L_{44}$ each represents a methine group, $p_{10}$ and $p_{11}$ each represents 0 or 1, $q_4$ represents 0 or 1, $n_7$ and $n_8$ each represents 0, 1, 2, 3 or 4, $Z_{14}$ and $Z_{16}$ each represents an atomic group necessary for forming a nitrogen-containing heterocyclic ring, $Z_{15}$ and $Z_{15}'$ each represents an atomic group necessary for forming a heterocyclic ring together with $(N—R_{15})_{q4}$, provided that a ring may be condensed to $Z_{14}$, $Z_{15}$, $Z_{15}'$ and $Z_{16}$, $R_{14}$, $R_{15}$ and $R_{16}$ each represents an alkyl group, an aryl group or a heterocyclic group, and $M_2$ and $m_2$ have the same meanings as in formula (II), provided that at least two of $R_{14}$, $R_{15}$ and $R_{16}$ have an anionic substituent.

In the case where the compound represented by formula (I-1), (I-2) or (I-3) is used alone, at least one and preferably both of $R_3$ and $R_4$ is(are) a group having an aromatic ring, at least one and preferably both of $R_5$ and $R_6$ is(are) a group having an aromatic ring, and at least one, preferably two and more preferably all three of $R_7$, $R_8$ and $R_9$ is(are) a group having an aromatic ring.

In the case where the compound represented by formula (I-1), (I-2) or (I-3) and the compound represented by formula (II-1), (II-2) or (II-3) are used in combination, at least one, preferably two, more preferably three and still more preferably four or more of $R_3$ to $R_9$ or $R_{10}$ to $R_{16}$ is(are) a group having an aromatic group.

By the above-described preferred method, a silver halide grain having a spectral absorption maximum wavelength of less than 500 nm and a light absorption strength of 60 or more or having a spectral absorption maximum wavelength of 500 nm or more and a light absorption strength of 100 or more may be obtained. However, the dye in the second layer is usually adsorbed in the state of a monomer and the absorption width and the spectral sensitivity width thereof are broader than respective desired ranges in most cases. For realizing high sensitivity in the desired wavelength region, the dye adsorbed in the second layer must form a J-association product. The J-association product is high in the fluorescence yield and small in the Stokes' shift, therefore, this is advantageous in transferring the light energy absorbed by the dye in the second layer to the dye in the first layer, which are approximated in the light absorption wavelength, utilizing the Forster-type energy transfer.

In the present invention, the dye in the second and upper layers means a dye which is adsorbed to a silver halide grain but not adsorbed directly to the silver halide.

In the present invention, the J-association product of a dye in the second or upper layer is defined as a product such that the absorption width in the longer wavelength side of absorption shown by a dye adsorbed to the second or upper layer is 2 times or less the absorption width in the longer wavelength side of absorption shown by the dye solution in the monomer state where an interaction between dye chromophores does not occur. The absorption width in the longer wavelength side as used herein means an energy width between the absorption maximum wavelength and a wavelength being longer than the absorption maximum wavelength and showing absorption as small as ½ of the absorption maximum. It is well-known that when a J-association product is formed, the absorption width in the longer wavelength side is generally reduced as compared with the case in the monomer state. When a dye is adsorbed to the second layer in the monomer state, the absorption width increases as large as 2 times or more the absorption width in the longer wavelength side of absorption shown by the dye solution in the monomer state because the adsorption site and the adsorption state are not uniform. Accordingly, the J-association product of the dye in the second or upper layer can be defined as above.

The spectral absorption of a dye adsorbed to the second or upper layer can be determined by subtracting the spectral absorption attributable to the first layer dye from the entire spectral absorption of the emulsion.

The spectral absorption attributable to the first layer dye can be determined by measuring the absorption spectrum when only the first layer dye is added. The spectral absorption spectrum attributable to the first layer dye may also be measured by adding a dye desorbing agent to the emulsion having adsorbed thereto a sensitizing dye in multiple layers and thereby desorbing the dyes in the second and upper layers.

In the experiment of desorbing dyes from the grain surface using a dye desorbing agent, the first layer dye is usually desorbed after the dyes in the second and upper layers are desorbed. Therefore, by selecting appropriate desorption conditions, the spectral absorption attributable to the first layer dye can be obtained and thereby the spectral absorption of the dyes in the second and upper layers may be obtained. The method of using a dye desorbing agent is described in Asanuma et al., *Journal of Physical Chemistry B,* Vol. 101, pp. 2149–2153 (1997).

In order to form a J-association product of the second layer dye using the cationic dye, betaine dye or nonionic dye represented by formula (I) and the anionic dye represented by formula (II), the dye adsorbed to form the first layer and the dye adsorbed to form the second or upper layer are preferably added separately and it is more preferred that the first layer dye and the dye used for the second or upper layer have different structures from each other. The dye in the second or upper layer preferably comprises a cationic dye, a betaine dye or a nonionic dye alone or comprises a combination of a cationic dye and an anionic dye.

For the first layer dye, any dye may be used, however, the dye represented by formula (I) or (II) is preferred and the dye represented by formula (I) is more preferred.

For the second layer dye, the cationic dye, betaine dye or nonionic dye represented by formula (I) is preferably used alone. In the case of using a cationic dye and an anionic dye in combination which is another preferred embodiment of the second layer dye, either one of the dyes used is preferably the cationic dye represented by formula (I) or the anionic dye represented by formula (II), and it is more preferred that the cationic dye represented by formula (I) and the anionic dye represented by formula (II) both are contained. The ratio of cationic dye/anionic dye as the second layer dye is preferably from 0.5 to 2, more preferably from 0.75 to 1.33, most preferably from 0.9 to 1.11.

In the present invention, a dye other than the dyes represented by formulae (I) and (II) may be added, however, the dye represented by formula (I) or (II) preferably occupies 50% or more, more preferably 70% or more, most preferably 90% or more, of the total amount of dyes added.

By adding the second layer dye as such, the interaction between second layer dyes can be increased while promoting the rearrangement of second layer dyes and thereby, the J-association product can be formed.

In the case of using the dye represented by formula (I) or (II) as the first layer dye, $Z_1$ and $Z_2$ each is preferably a basic nucleus substituted by an aromatic group or a basic nucleus resulting from the condensation of three or more rings. In the case of using the dye represented by formula (I) or (II) as the dye in the second or upper layer, $Z_1$ and $Z_2$ each is preferably a basic nucleus resulting from the condensation of three or more rings.

The number of rings condensed in the basic nucleus is, for example, 2 in the benzoxazole nucleus and 3 in the naphthoxazole nucleus. Even if the benzoxazole nucleus is substituted by a phenyl group, the number of rings condensed is 2. The basic nucleus resulting from the condensation of three or more rings may be any as long as it is a polycyclic condensation-type heterocyclic basic nucleus obtained by the condensation of three or more rings, however, a tricyclic condensation-type heterocyclic ring and a tetracyclic condensation-type heterocyclic ring are preferred. Preferred examples of the tricyclic condensation-type heterocyclic ring include naphtho[2,3-d]-oxazole, naphtho[1,2-d]oxazole, naphtho[2,1-d]oxazole, naphtho[2,3-d]thiazole, naphtho[1,2-d]thiazole, naphtho-[2,1-d]thiazole, naphtho[2,3-d]imidazole, naphtho[1,2-d]-imidazole, naphtho[2,1-d]imidazole, naphtho[2,3-d]selenazole, naphtho[1,2-d]selenazole, naphtho[2,1-d]selenazole, indolo[5,6-d]oxazole, indolo[6,5-d]oxazole, indolo[2,3-d]oxazole, indolo[5,6-d]thiazole, indolo[6,5-d]thiazole, indolo[2,3-d]thiazole, benzofuro[5,6-d]oxazole, benzofuro[6,5-d]oxazole, benzofuro[2,3-d]oxazole, benzofuro[5,6-d]thiazole, benzofuro[6,5-d]thiazole, benzofuro[2,3-d]thiazole, benzothieno[5,6-d]oxazole, benzothieno[6,5-d]oxazole and benzothieno[2,3-d]oxazole. Preferred examples of the tetracyclic condensation-type heterocyclic ring include anthra[2,3-d]oxazole, anthra[1,2-d]oxazole, anthra[2,1-d]oxazole, anthra[2,3-d]thiazole, anthra[1,2-d]thiazole, phenanthro[2,1-d]thiazole, phenanthro[2,3-d]imidazole, anthra[1,2-d]imidazole, anthra[2,1-d]imidazole, anthra[2,3-d]selenazole, phenanthro[1,2-d]selenazole, phenanthro[2,1-d]selenazole, carbazolo[2,3-d]oxazole, carbazolo[3,2-d]oxazole, dibenzofuro[2,3-d]oxazole, dibenzofuro[3,2-d]oxazole, carbazolo[2,3-d]thiazole, carbazolo[3,2-d]thiazole, dibenzofuro[2,3-d]thiazole, dibenzofuro[3,2-d]thiazole, benzofuro[5,6-d]oxazole, dibenzothieno[2,3-d]oxazole, dibenzothieno[3,2-d]oxazole, tetrahydrocarbazolo[6,7-d]oxazole, tetrahydrocarbazolo[7,6-d]oxazole, dibenzothieno[3,2-d]thiazole, dibenzothieno[3,2-d]thiazole and tetrahydrocarbazolo[6,7-d]thiazole. More preferred examples of the basic nucleus resulting from the condensation of three or more rings include naphtho[2,3-d]oxazole, naphtho[1,2-d]oxazole, naphtho[2,1-d]oxazole, naphtho[2,3-d]thiazole, naphtho[1,2-d]thiazole, naphtho[2,1-d]thiazole, indolo[5,6-d]oxazole, indolo[6,5-d]oxazole, indolo[2,3-d]oxazole, indolo[5,6-d]thiazole, indolo[2,3-d]thiazole, benzofuro[5,6-d]oxazole, benzofuro[6,5-d]oxazole, benzofuro[2,3-d]oxazole, benzofuro[5,6-d]thiazole, benzofuro[2,3-d]thiazole, benzothieno[5,6-d]oxazole, anthra[2,3-d]oxazole, anthra[1,2-d]oxazole, anthra[2,3-d]thiazole, anthra[1,2-d]thiazole, carbazolo[2,3-d]oxazole, carbazolo[3,2-d]oxazole, dibenzofuro[2,3-d]oxazole, dibenzofuro[3,2-d]oxazole, carbazolo[2,3-d]thiazole, carbazolo[3,2-d]thiazole, dibenzofuro[2,3-d]thiazole, dibenzofuro[3,2-d]thiazole, dibenzothieno[2,3-d]oxazole and dibenzothieno[3,2-d]oxazole. Among these, still more preferred are naphtho[2,3-d]oxazole, naphtho[1,2-d]oxazole, naphtho[2,3-d]thiazole, indolo[5,6-d]oxazole, indolo[6,5-d]oxazole, indolo[5,6-d]thiazole, benzofuro[5,6-d]oxazole, benzofuro[5,6-d]thiazole, benzofuro[2,3-d]thiazole, benzothieno[5,6-d]oxazole, carbazolo[2,3-d]oxazole, carbazolo[3,2-d]oxazole, dibenzofuro[2,3-d]oxazole, dibenzofuro[3,2-d]oxazole, carbazolo[2,3-d]thiazole, carbazolo[3,2-d]thiazole, dibenzofuro[2,3-d]thiazole, dibenzofuro[3,2-d]thiazole, dibenzothieno[2,3-d]oxazole and dibenzothieno[3,2-d]oxazole.

Another preferred example of the method for realizing an adsorption state such that a dye chromophore is coated in multiple layers on a silver halide grain surface is a method of using a dye compound having two or more dye chromophore moieties linked by covalent bonding though a linking group. In the present invention, however, the above-described other sensitizing dye is more preferred than the sensitizing dye in which the first layer dye and the sensitizing dye in the second or upper layer are linked by the covalent bonding. The dye chromophore which can be used may be any and examples thereof include those described above with respect to the dye chromophore. Among those, preferred are the polymethine dye chromophores described above for the dye chromophore, more preferred are cyanine dyes, merocyanine dyes, rhodacyanine dyes and oxonol dyes, still more preferred are cyanine dyes, rhodacyanine dyes and merocyanine dyes, and most preferred are cyanine dyes.

Preferred examples of the above-described method include a method of using a dye linked through a methine chain described in JP-A-9-265144, a method of using a dye having linked thereto an oxonol dye described in JP-A-10-226758, a method of using a linked dye having a specific structure described in JP-A-10-110107, JP-A-10-307358, JP-A-10-307359 and JP-A-10-310715, a method of using a linked dye having a specific linking group described in Japanese Patent Application No. 8-31212 and JP-A-10-204306, a method of using a linked dye having a specific structure described in Japanese Patent Application Nos. 11-34444, 11-34463 and 11-34462, and a method of using a dye having a reactive group and producing a linked dye in an emulsion described in Japanese Patent Application No. 10-249971.

The linked dye is preferably a dye represented by the following formula (III):

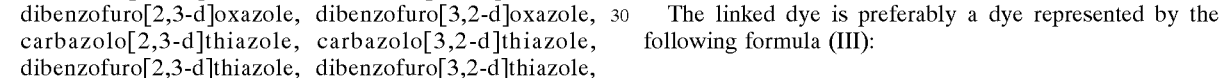

$$D_1—(La—[D_2]_q)_r \quad (III)$$

$$M_3m_3$$

wherein $D_1$ and $D_2$ each represents a dye chromophore, La represents a linking group or a single bond, q and r each represents an integer of from 1 to 100, $M_3$ represents a charge-balancing counter ion, and $m_3$ represents a number necessary for neutralizing the electric charge of the molecule.

$D_1$, $D_2$ and La are described below.

The dye chromophore represented by $D_1$ and $D_2$ may be any dye chromophore. Specific examples thereof include those described above for the dye chromophore. Among those, preferred are the polymethine dye chromophores described above for the dye chromophore, more preferred are cyanine dyes, merocyanine dyes, rhodacyanine dyes and oxonol dyes, still more preferred are cyanine dyes, merocyanine dyes and rhodacyanine dyes, and most preferred are cyanine dyes.

Examples of the formulae of preferred dyes include the formula described in U.S. Pat. No. 5,994,051, pp. 32–36 and the formula described in U.S. Pat. No. 5,747,236, pp. 30–34. For cyanine dyes, merocyanine dyes and rhodacyanine dyes, formulae (XI), (XII) and (XIII) described in U.S. Pat. No. 5,340,694, columns 21 to 22, are preferred on the condition that the numbers of n12, n15, n17 and n18 are not limited and each is an integer of 0 or more (preferably 4 or less).

In the present invention, in the case where a linked dye represented by formula (III) is adsorbed to a silver halide grain, $D_2$ is preferably a chromophore not directly adsorbed to silver halide.

In other words, $D_2$ is preferably lower than $D_1$ in the adsorption strength to a silver halide grain. The adsorption strength to a silver halide grain is most preferably in the order of $D_1$>La>$D_2$.

As such, $D_1$ is preferably a sensitizing dye moiety having adsorptivity to a silver halide grain, however, the adsorption may also be attained by either physical adsorption or chemical adsorption.

$D_2$ is preferably weak in the adsorptivity to a silver halide grain and is also preferably a light-emitting dye. With respect to the kind of the light-emitting dye, those having a skeleton structure of dyes used for dye laser are preferred. These are described, for example, in Mitsuo Maeda, *Laser Kenkyu* (*Study of Laser*), Vol. 8, page 694, page 803 and page 958 (1980), ibid., Vol. 9, page 85 (1981), and F. Schaefer, *Dye Lasers,* Springer (1973).

The absorption maximum wavelength of $D_1$ in a silver halide photographic light-sensitive material is preferably longer than the absorption maximum wavelength of $D_2$. Furthermore, the light emission of $D_2$ preferably overlaps the absorption of $D_1$. In addition, $D_1$ preferably forms a J-association product. In order to allow the linked dye represented by formula (I) to have absorption and spectral sensitivity in a desired wavelength range, $D_2$ also preferably forms a J-association product.

$D_1$ and $D_2$ each may have any reduction potential and any oxidation potential, however, the reduction potential of $D_1$ is preferably higher than the value obtained by subtracting 0.2 V from the reduction potential of $D_2$.

La represents a linking group (preferably a divalent linking group) or a single bond. This linking group preferably comprises an atom or atomic group containing at least one of carbon atom, nitrogen atom, sulfur atom and oxygen atom. La preferably represents a linking group having from 0 to 100 carbon atoms, more preferably from 1 to 20 carbon atoms, constituted by one or a combination of two or more of an alkylene group (e.g., methylene, ethylene, propylene, butylene, pentylene), an arylene group (e.g., phenylene, naphthylene), an alkenylene group (e.g., ethenylene, propenylene), an alkynylene group (e.g., ethynylene, propynylene), an amido group, an ester group, a sulfoamido group, a sulfonic acid ester group, a ureido group, a sulfonyl group, a sulfinyl group, a thioether group, an ether group, a carbonyl group, —N(Va)— (wherein Va represents hydrogen atom or a monovalent substituent; examples of the monovalent group include those represented by V which is described later) and a heterocyclic divalent group (e.g., 6-chloro-1,3,5-triazine-2,4-diyl, pyrimidine-2,4-diyl, quinoxaline-2,3-diyl).

The above-described linking groups each may have a substituent represented by V which is described later. Furthermore, these linking groups each may contain a ring (aromatic or non-aromatic hydrocarbon or heterocyclic ring).

La more preferably represents a divalent linking group having from 1 to 10 carbon atoms, constituted by one or a combination of two or more of an alkylene group having from 1 to 10 carbon atoms (e.g., methylene, ethylene, propylene, butylene), an arylene group having from 6 to 10 carbon atoms (e.g., phenylene, naphthylene), an alkenylene group having from 2 to 10 carbon atoms (e.g., ethenylene, propenylene), an alkynylene group having from 2 to 10 carbon atoms (e.g., ethynylene, propynylene), an ether group, an amido group, an ester group, a sulfonamido group and a sulfonic acid ester group. These linking groups each may be substituted by V which is described later.

La is a linking group which may perform energy transfer or electron transfer by a through-bond interaction. The through-bond interaction includes a tunnel interaction and a super-exchange interaction. In particular, a through-bond interaction based on a super-exchange interaction is preferred. The through-bond interaction and the super-exchange interaction are interactions defined in Shammai Speiser, *Chem. Rev.,* Vol. 96, pp. 1960–1963 (1996). As the linking group which performs the energy transfer or electron transfer by such an interaction, those described in Shammai Speiser, *Chem. Rev.,* Vol. 96, pp. 1967–1969 (1996) are preferred.

q and r each represents an integer of from 1 to 100, preferably from 1 to 5, more preferably from 1 to 2, still more preferably 1. When q and r each is 2 or more, a plurality of linking groups La contained may be different from each other and a plurality of dye chromophores $D_2$ contained may also be different from each other.

The dye represented by formula (III) as a whole preferably has an electric charge of −1.

The dye is more preferably a methine dye where $D_1$ and $D_2$ in formula (III) each is independently represented by the following formula (IV), (V), (VI) or (VII):

(IV)

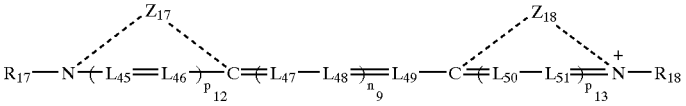

$M_4m_4$ wherein $L_{45}$, $L_{46}$, $L_{47}$, $L_{48}$, $L_{49}$, $L_{50}$ and $L_{51}$ each represents a methine group, $p_{12}$ and $p_{13}$ each represents 0 or 1, $n_9$ represents 0, 1, 2, 3 or 4, $Z_{17}$ and $Z_{18}$ each represents an atomic group necessary for forming a nitrogen-containing heterocyclic ring, provided that a ring may be condensed to $Z_{17}$ and $Z_{18}$, $M_4$ represents a charge-balancing counter ion, $m_4$ represents a number of 0 or more necessary for neutralizing the electric charge of the molecule, and $R_{17}$ and $R_{18}$ each represents an alkyl group, an aryl group or a heterocyclic group;

(V)

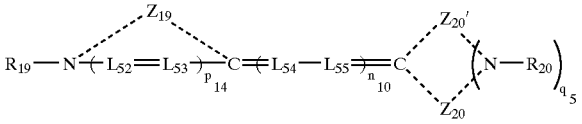

$M_5m_5$ wherein $L_{52}$, $L_{53}$, $L_{54}$ and $L_{55}$ each represents a methine group, $p_{14}$ represents 0 or 1, $q_5$ represents 0 or 1, $n_{10}$ represents 0, 1, 2, 3 or 4, $Z_{19}$ represents an atomic group necessary for forming a nitrogen-containing heterocyclic ring, $Z_{20}$ and $Z_{20}'$ each represents an atomic group necessary for forming a heterocyclic or acyclic acidic terminal group together with $(N—R_{20})_{q5}$, provided that a ring may be condensed to $Z_{19}$, $Z_{20}$ and $Z_{20}'$, $M_5$ represents a charge-balancing counter ion, $m_5$ represents a number of 0 or more necessary for neutralizing the electric charge of the molecule, and $R_{19}$ and $R_{20}$ each represents an alkyl group, an aryl group or a heterocyclic group;

(VI)

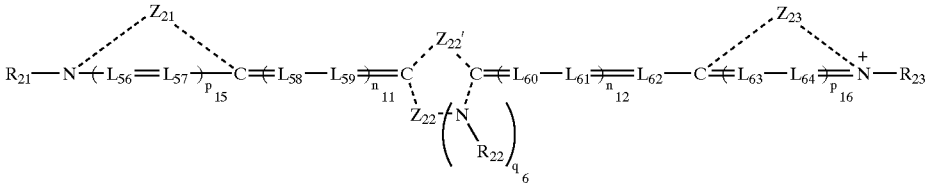

$M_6m_6$ wherein $L_{56}$, $L_{57}$, $L_{58}$, $L_{59}$, $L_{60}$, $L_{61}$, $L_{62}$, $L_{63}$ and $L_{64}$ each represents a methine group, $p_{15}$ and $p_{16}$ each represents 0 or 1, $q_6$ represents 0 or 1, $n_{11}$ and $n_{12}$ each represents 0, 1, 2, 3 or 4, $Z_{21}$ and $Z_{23}$ each represents an atomic group necessary for forming a nitrogen-containing heterocyclic ring, $Z_{22}$ and $Z_{22}'$ each represents an atomic group necessary for forming a heterocyclic ring together with $(N—R_{22})_{q6}$, provided that a ring may be condensed to $Z_{21}$, $Z_{22}$, $Z_{22}'$ and $Z_{23}$, $M_6$ represents a charge-balancing counter ion, $m_6$ represents a number of 0 or more necessary for neutralizing the electric charge of the molecule, and $R_{21}$, $R_{22}$ and $R_{23}$ each represents an alkyl group, an aryl group or a heterocyclic group.

(VII)

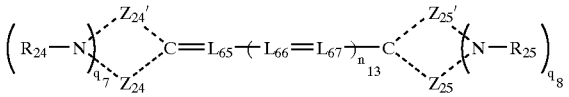

$M_7m_7$ wherein $L_{65}$, $L_{66}$ and $L_{67}$ each represents a methine group, $q_7$ and $q_8$ each represents 0 or 1, $n_{13}$ represents 0, 1, 2, 3 or 4, $Z_{24}$ and $Z_{24}'$ each represents an atomic group necessary for forming a heterocyclic ring or an acyclic acidic terminal group together with $(N—R_{24})_{q7}$, $Z_{25}$ and $Z_{25}'$ each represents an atomic group necessary for forming a heterocyclic ring or an acyclic acidic terminal group together with $(N—R_{25})_{q8}$, provided that a ring may be condensed to $Z_{24}$, $Z_{24}'$, $Z_{25}$ and $Z_{25}'$, $M_7$ represents a charge-balancing counter ion, $m_7$ represents a number of 0 or more necessary for neutralizing the electric charge of the molecule, and $R_{24}$ and $R_{25}$ each represents an alkyl group, an aryl group or a heterocyclic group.

$D_1$ in formula (III) is preferably a methine dye represented by formula (IV), (V) or (VI), more preferably a methine dye represented by formula (IV). $D_2$ in formula (III) is preferably a methine dye represented by formula (IV), (V) or (VII), more preferably a methine dye represented by formula (IV) or (V), still more preferably a methine dye represented by formula (IV).

Between the method using the dyes represented by formulae (I) and (II) and the method using the dye represented by formula (III), the method using the dyes represented by formulae (I) and (II) is preferred.

The methine compounds represented by formulae (I) (including formulae (I-1), (I-2) and (I-3)), (II) (including formulae (II-1), (II-2) and (II-3)), (IV), (V), (VI) and (VII) are described in detail below.

In formulae (I) and (II), $Q_1$ and $Q_2$ each represents a group necessary for forming a methine dye. By the groups $Q_1$ and $Q_2$, any methine dye can be formed but examples thereof include methine dyes described above as examples of the dye chromophore.

Among those, preferred are cyanine dyes, merocyanine dyes, rhodacyanine dyes, trinuclear merocyanine dyes, tetranuclear merocyanine dyes, allopolar dyes, hemicyanine dyes and styryl dyes, more preferred are cyanine dyes, merocyanine dyes and rhodacyanine dyes, still more preferred are cyanine dyes. These dyes are described in detail in F. M. Harmer, *Heterocyclic Compounds—Cyanine Dyes and Related Compounds,* John Wiley & Sons, New York, London (1964), D. M. Sturmer, *Heterocyclic Compounds—Special topics in heterocyclic chemistry,* Chap. 18, Section 14, pp. 482–515.

Examples of the formulae of preferred dyes include the formula described U.S. Pat. No. 5,994,051, pages 32 to 36, and the formula described in U.S. Pat. No. 5,747,236, pages 30 to 34. For cyanine dyes, merocyanine dyes and rhodacyanine dyes, formulae (XI), (XII) and (XIII) described in U.S. Pat. No. 5,340,694, columns 21 to 22, are preferred on the condition that the numbers of n12, n15, n17 and n18 are not limited and each is an integer of 0 or more (preferably 4 or less).

In the case where a cyanine dye or a rhodacyanine dye is formed by $Q_1$ or Q2, formulae (I) and (II) may be expressed by the following resonance formulae:

(I)

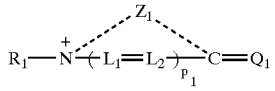

$M_1m_1$ (II)

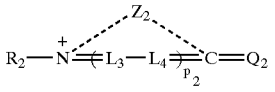

$M_2m_2$

In formulae (I), (II), (IV), (V) and (VI), $Z_1$, $Z_2$, $Z_3$, $Z_4$, $Z_5$, $Z_7$, $Z_9$, $Z_{10}$, $Z_{11}$, $Z_{12}$, $Z_{14}$, $Z_{16}$, $Z_{17}$, $Z_{18}$, $Z_{19}$, $Z_{21}$ and $Z_{23}$ each represents an atomic group necessary for forming a nitrogen-containing heterocyclic ring, preferably a 5- or 6-membered nitrogen-containing heterocyclic ring. However, a ring may be condensed to each of these groups. The ring may be either an aromatic ring or a non-aromatic ring, but an aromatic ring is preferred and examples thereof include hydrocarbon aromatic rings such as benzene ring and naphthalene ring, and heteroaromatic rings such as pyrazine ring and thiophene ring.

Examples of the nitrogen-containing heterocyclic ring include thiazoline nucleus, thiazole nucleus, benzothiazole nucleus, oxazoline nucleus, oxazole nucleus, benzoxazole nucleus, selenazoline nucleus, selenazole nucleus, benzoselenazole nucleus, 3,3-dialkylindolenine nucleus (e.g., 3,3-dimethylindolenine), imidazoline nucleus, imidazole nucleus, benzimidazole nucleus, 2-pyridine nucleus, 4-pyridine nucleus, 2-quinoline nucleus, 4-quinoline nucleus, 1-isoquinoline nucleus, 3-isoquinoline nucleus, imidazo[4,5-b]quinoxaline nucleus, oxadiazole nucleus, thiadiazole nucleus, tetrazole nucleus and pyrimidine nucleus. Among these, preferred are benzothiazole nucleus, benzoxazole nucleus, 3,3-dialkylindolenine nucleus (e.g., 3,3-dimethylindolenine), benzimidazole nucleus, 2-pyridine nucleus, 4-pyridine nucleus, 2-quinoline nucleus, 4-quinoline nucleus, 1-isoquinoline nucleus and 3-isoquinoline nucleus; more preferred are benzothiazole nucleus, benzoxazole nucleus, 3,3-dialkylindolenine nucleus (e.g., 3,3-dimethylindolenine) and benzimidazole nucleus; still more preferred are benzoxazole nucleus, benzothiazole nucleus and benzimidazole nucleus; and most preferred are benzoxazole nucleus and benzothiazole nucleus.

Assuming that the substituent on the nitrogen-containing heterocyclic ring is V, the substituent represented by V is not particularly limited, however, examples thereof include a halogen atom, an alkyl group (including a cycloalkyl group and a bicycloalkyl group), an alkenyl group (including a cycloalkenyl group and a bicycloalkenyl group), an alkynyl group, an aryl group, a heterocyclic group, a cyano group, a hydroxy group, a nitro group, a carboxyl group, an alkoxy group, an aryloxy group, a silyloxy group, a heterocyclic oxy group, an acyloxy group, a carbamoyloxy group, an alkoxycarbonyloxy group, an aryloxycarbonyloxy group, an amino group (including an anilino group), an acylamino group, an aminocarbonylamino group, an alkoxycarbonylamino group, an aryloxycarbonylamino group, a sulfamoylamino group, an alkylsulfonylamino group, an arylsulfonylamino group, a mercapto group, an alkylthio group, an arylthio group, a heterocyclic thio group, a sulfamoyl group, a sulfo group, an alkylsulfinyl group, an arylsulfinyl group, an alkylsulfonyl group, an arylsulfonyl group, an acyl group, an aryloxycarbonyl group, an alkoxycarbonyl group, a carbamoyl group, an arylazo group, a heterocyclic azo group, an imido group, a phosphino group, a phosphinyl group, a phosphinyloxy group, a phosphinylamino group and a silyl group.

More specifically, examples of V include a halogen atom (e.g., chlorine atom, bromine atom, iodine atom), an alkyl group [in other words, a linear, branched, cyclic substituted or unsubstituted alkyl group; the alkyl group includes an alkyl group (preferably an alkyl group having from 1 to 30 carbon atoms, e.g., methyl, ethyl, n-propyl, isopropyl, t-butyl, n-octyl, eicosyl, 2-chloroethyl, 2-cyanoethyl, 2-ethylhexyl), a cycloalkyl group (preferably a substituted or unsubstituted cycloalkyl group having from 3 to 30 carbon atoms, e.g., cyclohexyl, cyclopentyl, 4-n-dodecylcyclohexyl) and a bicycloalkyl group (preferably a substituted or unsubstituted bicycloalkyl group having from 5 to 30 carbon atoms, namely, a monovalent group resulting from removing one hydrogen atom from bicycloalkane having from 5 to 30 carbon atoms, e.g., bicyclo[1,2,2]heptan-2-yl, bicyclo[2,2,2]octan-3-yl), and a tricyclo structure having many ring structures; the alkyl group in the substituents described below (for example, the alkyl group in an alkylthio group) has such a concept and further includes an alkenyl group and an alkynyl group], an alkenyl group [in other words, a linear, branched, cyclic substituted or unsubstituted alkenyl group; the alkenyl group includes an alkenyl group (preferably a substituted or unsubstituted alkenyl group having from 2 to 30 carbon atoms, e.g., vinyl, allyl, prenyl, geranyl, oleyl), a cycloalkenyl group (preferably a substituted or unsubstituted cycloalkenyl group having from 3 to 30 carbon atoms, namely, a monovalent group resulting from removing one hydrogen atom from cycloalkene having from 3 to 30 carbon atoms, e.g., 2-cyclopenten-1-yl, 2-cyclohexen-1-yl) and a bicycloalkenyl group (a substituted or unsubstituted bicycloalkenyl group, preferably a substituted or unsubstituted bicycloalkenyl group having from 5 to 30 carbon atoms, namely, a monovalent group resulting from removing one hydrogen atom from bicycloalkene having one double bond, e.g., bicyclo[2,2,1]hept-2-en-1-yl, bicyclo[2,2,2]oct-2-en-4-yl)], an alkynyl group (preferably a substituted or unsubstituted alkynyl group having from 2 to 30 carbon atoms, e.g., ethynyl, propargyl, trimethylsilylethynyl), an aryl group (preferably a substituted or unsubstituted aryl group having from 6 to 30 carbon atoms, e.g., phenyl, p-tolyl, naphthyl, m-chlorophenyl, o-hexadecanoylaminophenyl), a heterocyclic group (preferably a monovalent group resulting from removing one hydrogen atom from a 5- or 6-membered substituted or unsubstituted aromatic or non-aromatic heterocyclic compound, more preferably a 5- or 6-membered aromatic heterocyclic group having from 3 to 30 carbon atoms, e.g., 2-furyl, 2-thienyl, 2-pyrimidinyl, 2-benzothiazolyl), a cyano group, a hydroxyl group, a nitro group, a carboxyl group, an alkoxy group (preferably a substituted or unsubstituted alkoxy group having from 1 to 30 carbon atoms, e.g., methoxy, ethoxy, isopropoxy, t-butoxy, n-octyloxy, 2-methoxyethoxy), an aryloxy group (preferably a substituted or unsubstituted aryloxy group having from 6 to 30 carbon atoms, e.g., phenoxy, 2-methylphenoxy, 4-t-butylphenoxy, 3-nitrophenoxy, 2-tetradecanoylaminophenoxy), a silyloxy group (preferably a silyloxy group having from 3 to 20 carbon atoms, e.g., trimethylsilyloxy, t-butyldimethylsilyloxy), a heterocyclic oxy group (preferably a substituted or unsubstituted heterocyclic oxy group having from 2 to 30 carbon atoms, e.g., 1-phenyltetrazol-5-oxy, 2-tetrahydropyranyloxy), an acyloxy group (preferably a formyloxy group, a substituted or unsubstituted alkylcarbonyloxy group having from 2 to 30 carbon atoms and a substituted or unsubstituted arylcarbonyloxy group having from 6 to 30 carbon atoms, e.g., formyloxy, acetyloxy, pivaloyloxy, stearoyloxy, benzoyloxy, p-methoxyphenylcarbonyloxy), a carbamoyloxy group (preferably a substituted or unsubstituted carbamoyloxy group having from 1 to 30 carbon atoms, e.g., N,N-dimethylcarbamoyloxy, N,N-diethylcarbamoyloxy, morpholinocarbonyloxy, N,N-di-n-octylaminocarbonyloxy, N-n-octylcarbamoyloxy), an alkoxycarbonyloxy group (preferably a substituted or unsubstituted alkoxycarbonyloxy group having from 2 to 30 carbon atoms, e.g., methoxycarbonyloxy, ethoxycarbonyloxy, t-butoxycarbonyloxy, n-octylcarbonyloxy), an aryloxycarbonyloxy group (preferably a substituted or unsubstituted aryloxycarbonyloxy group having from 7 to 30 carbon atoms, e.g., phenoxycarbonyloxy, p-methoxyphenoxycarbonyloxy, p-n-hexadecyloxyphenoxycarbonyloxy), an amino group (preferably an amino group, a substituted or unsubstituted alkylamino group having from 1 to 30 carbon atoms and a substituted or unsubstituted anilino group having from 6 to 30 carbon atoms, e.g., amino, methylamino, dimethylamino, anilino, N-methylanilino, diphenylamino), an acylamino group (preferably a formylamino group, a substituted or unsubstituted alkylcarbonylamino group having from 1 to 30 carbon atoms and a substituted or unsubstituted arylcarbonylamino group having from 6 to 30 carbon atoms, e.g., formylamino, acetylamino, pivaloylamino, lauroylamino, benzoylamino, 3,4,5-tri-n-octyloxyphenylcarbonylamino), an aminocarbonylamino group (preferably a substituted or unsubstituted aminocarbonylamino group having from 1 to 30 carbon atoms, e.g., carbamoylamino, N,N-dimethylaminocarbonylamino, N,N-diethylaminocarbonylamino, morpholinocarbonylamino), an alkoxycarbonylamino group (preferably a substituted or unsubstituted alkoxycarbonylamino group having from 2 to 30 carbon atoms, e.g., methoxycarbonylamino, ethoxycarbonylamino, t-butoxycarbonylamino, n-octadecyloxycarbonylamino, N-methylmethoxycarbonylamino), an aryloxycarbonylamino group (preferably a substituted or unsubstituted aryloxycarbonylamino group having from 7 to 30 carbon atoms, e.g., phenoxycarbonylamino, p-chlorophenoxycarbonylamino, m-n-octyloxyphenoxycarbonylamino), a sulfamoylamino group (preferably a substituted or unsubstituted sulfamoylamino group having from 0 to 30 carbon atoms, e.g., sulfamoylamino, N,N-dimethylaminosulfonylamino, N-n-octylaminosulfonylamino), an alkyl- or aryl-sulfonylamino group (preferably a substituted or unsubstituted alkylsulfonylamino group having from 1 to 30 carbon atoms and a substituted or unsubstituted arylsulfonylamino group having from 6 to 30 carbon atoms, e.g., methylsulfonylamino, butylsulfonylamino, phenylsulfonylamino, 2,3,5-trichlorophenylsulfonylamino, p-methylphenylsulfonylamino), a mercapto group, an alkylthio group (preferably a substituted or unsubstituted alkylthio group having from 1 to 30 carbon atoms, e.g., methylthio, ethylthio, n-hexadecylthio), an arylthio group (preferably a substituted or unsubstituted arylthio group having from 6 to 30 carbon atoms, e.g., phenylthio, p-chlorophenylthio, m-methoxyphenylthio), a heterocyclic thio group (preferably a substituted or unsubstituted heterocyclic thio group having from 2 to 30 carbon atoms, e.g., 2-benzothiazolylthio, 1-phenyltetrazol-5-ylthio), a sulfamoyl group (preferably a substituted or unsubstituted sulfamoyl group having from 0 to 30 carbon atoms, e.g., N-ethylsulfamoyl, N-(3-dodecyloxypropyl)sulfamoyl, N,N-dimethylsulfamoyl, N-acetylsulfamoyl, N-benzoylsulfamoyl, N-(N'-phenylcarbamoyl)sulfamoyl), a sulfo group, an alkyl- or arylsulfinyl group (preferably a substituted or unsubstituted alkylsulfinyl group having from 1 to 30 carbon atoms and a substituted or unsubstituted arylsulfinyl group having from 6 to 30 carbon atoms, e.g., methylsulfinyl, ethylsulfinyl, phenylsulfinyl, p-methylphenylsulfinyl), an alkyl- or arylsulfonyl group (preferably a substituted or unsubstituted alkylsulfonyl group having from 1 to 30 carbon atoms and a substituted or unsubstituted arylsulfonyl group having from 6 to 30 carbon atoms, e.g., methylsulfonyl, ethylsulfonyl, phenylsulfonyl, p-methylphenylsulfonyl), an acyl group (preferably a formyl group, a substituted or unsubstituted alkylcarbonyl group having from 2 to 30 carbon atoms, a substituted or unsubstituted arylcarbonyl group having from 7 to 30 carbon atoms and a substituted or unsubstituted heterocyclic carbonyl group having from 4 to 30 carbon atoms in which the carbonyl group is bonded through a carbon atoms, e.g., acetyl, pivaloyl, 2-chloroacetyl, stearoyl, benzoyl, p-n-octyloxyphenylcarbonyl, 2-pyridylcarbonyl, 2-furylcarbonyl), an aryloxycarbonyl group (preferably a substituted or unsubstituted aryloxycarbonyl group having from 7 to 30 carbon atoms, e.g., phenoxycarbonyl, o-chlorophenoxy-carbonyl, m-nitrophenoxycarbonyl, p-t-butylphenoxycarbonyl), an alkoxycarbonyl group (preferably a substituted or unsubstituted alkoxycarbonyl group having from 2 to 30 carbon atoms, e.g., methoxycarbonyl, ethoxycarbonyl, t-butoxycarbonyl, n-octadecyloxycarbonyl), a carbamoyl group (preferably a substituted or unsubstituted carbamoyl group having from 1 to 30 carbon atoms, e.g., carbamoyl, N-methylcarbamoyl, N,N-dimethylcarbamoyl, N,N-di-n-octylcarbamoyl, N-(methylsulfonyl)carbamoyl), an aryl- or heterocyclic-azo group (preferably a substituted or unsubstituted arylazo group having from 6 to 30 carbon atoms and a substituted or unsubstituted heterocyclic azo group having from 3 to 30 carbon atoms, e.g., phenylazo, p-chlorophenylazo, 5-ethylthio-1,3,4-thiadiazol-2-ylazo), an imido group (preferably N-succinimido and N-phthalimido), a phosphino group (preferably a substituted or unsubstituted phosphino group having from 2 to 30 carbon atoms, e.g., dimethylphosphino, diphenylphosphino, methylphenoxyphosphino), a phosphinyl group (preferably a substituted or unsubstituted phosphinyl group having from 2 to 30 carbon atoms, e.g., phosphinyl, dioctyloxyphosphinyl, diethoxyphosphinyl), a phosphinyloxy group (preferably a substituted or unsubstituted phosphinyloxy group having from 2 to 30 carbon atoms, e.g., diphenoxyphosphinyloxy, dioctyloxyphosphinyloxy), a phosphinylamino group (preferably a substituted or unsubstituted phosphinylamino group having from 2 to 30 carbon atoms, e.g., dimethoxyphosphinylamino, dimethylaminophosphinylamino) and a silyl group (preferably a substituted or unsubstituted silyl group having from 3 to 30 carbon atoms, e.g., trimethylsilyl, t-butyldimethylsilyl, phenyldimethylsilyl).

Also, the substituent may have a structure such that a ring (an aromatic or non-aromatic hydrocarbon or heterocyclic ring; these rings may further be combined to form a polycyclic condensed ring; examples thereof include a benzene ring, a naphthalene ring, an anthracene ring, a quinoline ring, a phenanthrene ring, a fluorene ring, a triphenylene ring, a naphthacene ring, a biphenyl ring, a pyrrole ring, a furan ring, a thiophene ring, an imidazole ring, an oxazole ring, a thiazole ring, a pyridine ring, a pyrazine ring, a pyrimidine ring, a pyridazine ring, an indolizine ring, an indole ring, a benzofuran ring, a benzothiophene ring, an isobenzofuran ring, a quinolizine ring, a quinoline ring, a phthalazine ring, a naphthylizine ring, a quinoxaline ring, a quinoxazoline ring, a quinoline ring, a carbazole ring, a phenanthridine ring, an acridine ring, a phenanthroline ring, a thianthrene ring, a chromene ring, a xanthene ring, a phenoxathiine ring, a phenothiazine ring and a phenazine ring) is condensed.

When those functional groups have hydrogen atom, the hydrogen atom may be removed and the functional group may be further substituted by the above-described group. Examples of such a functional group include an alkylcarbonylaminosulfonyl group, an arylcarbonylaminosulfonyl group, an alkylsulfonylaminocarbonyl group and an arylsulfonylaminocarbonyl group. Examples thereof include methylsulfonylaminocarbonyl, p-methylphenylsulfonylaminocarbonyl, acetylaminosulfonyl and benzoylaminosulfonyl.

Among the above-described substituents, preferred are the alkyl group, the aryl group, the alkoxy group, the halogen atom, the aromatic ring condensation product, the sulfo group, the carboxy group and the hydroxy group.

The substituent V on $Z_1$, $Z_2$, $Z_3$, $Z_4$, $Z_5$, $Z_7$, $Z_9$, $Z_{10}$, $Z_{11}$, $Z_{12}$, $Z_{14}$ and $Z_{16}$ is more preferably the aromatic group and the aromatic ring condensation product.

In the case where the chromophore represented by $D_1$ in formula (III) is the methine dye represented by formula (IV), (V) or (VI), the substituent V on $Z_{17}$, $Z_{18}$, $Z_{19}$, $Z_{21}$ and $Z_{23}$ is more preferably the aromatic group or the aromatic ring condensation product.

In the case where the chromophore represented by $D_2$ in formula (III) is the methine dye represented by formula (IV), (V) or (VI), the substituent V on $Z_{17}$, $Z_{18}$, $Z_{19}$, $Z_{21}$ and $Z_{23}$ is more preferably the carboxy group, the sulfo group or the hydroxy group, still more preferably the sulfo group.

$Z_6$, $Z_6'$ and $(N—R_6)_{q1}$, $Z_{13}$, $Z_{13}'$ and $(N—R_{13})_{q3}$, $Z_{20}$, $Z_{20}'$ and $(N—R_{20})_{q5}$, $Z_{24}$, $Z_{24}'$ and $(N—R_{24})_{q7}$, and $Z_{25}$, $Z_{25}'$ and $(N—R_{25})_{q8}$ in respective sets of three each represents an atomic group necessary for forming a heterocyclic or acyclic acidic terminal group by combining with each other. Any heterocyclic ring (preferably 5- or 6-membered heterocyclic ring) may be formed but an acidic nucleus is preferred. The acidic nucleus and the acyclic acidic terminal group are described below. The acidic nucleus and the acyclic acidic terminal group each may have any acidic nucleus or acyclic acidic terminal group form of ordinary merocyanine dyes. In preferred forms, $Z_6$, $Z_{13}$, $Z_{20}$, $Z_{24}$ and $Z_{25}$ each is a thiocarbonyl group, a carbonyl group, an ester group, an acyl group, a carbamoyl group, a cyano group or a sulfonyl group, more preferably a thiocarbonyl group or a carbonyl group. $Z_6'$, $Z_{13}'$, $Z_{20}'$, $Z_{24}'$ and $Z_{25}'$ each represents a remaining atomic group necessary for forming an acidic nucleus or an acyclic acidic terminal group. In the case of forming an acyclic acidic terminal group, $Z_6'$, $Z_{13}'$, $Z_{20}'$, $Z_{24}'$ and $Z_{25}'$ each is preferably a thiocarbonyl group, a carbonyl group, an ester group, an acyl group, a carbamoyl group, a cyano group or a sulfonyl group.

$q_1$, $q_3$, $q_5$, $q_7$ and $q_9$ each is 0 or 1, preferably 1.

The "acidic nucleus and acyclic acidic terminal group" as used herein are described, for example, in James (compiler), *The Theory of the Photographic Process,* 4th ed., pages 198–200, Macmillan (1977). The acyclic acidic terminal group as used herein means an acidic, namely, electron-accepting terminal group which does not form a ring.

Specific examples of the acidic nucleus and acyclic acidic terminal group include those described in U.S. Pat. Nos. 3,567,719, 3,575,869, 3,804,634, 3,837,862, 4,002,480 and 4,925,777, JP-A-3-167546, and U.S. Pat. Nos. 5,994,051 and 5,747,236.

The acidic nucleus preferably forms a heterocyclic ring (preferably a 5- or 6-membered nitrogen-containing heterocyclic ring) comprising carbon, nitrogen and/or chalcogen (typically oxygen, sulfur, selenium and tellurium) atoms, more preferably forms a 5- or 6-membered nitrogen-containing heterocyclic ring comprising carbon, nitrogen and/or chalcogen (typically oxygen, sulfur, selenium and tellurium) atoms. Specific examples thereof include the following nuclei:

nuclei of 2-pyrazolin-5-one, pyrazolidine-3,5-dione, imidazolin-5-one, hydantoin, 2- or 4-thiohydantoin, 2-iminooxazolidin-4-one, 2-oxazolin-5-one, 2-thiooxazoline-2,5-dione, 2-thiooxazoline-2,4-dione, isooxazolin-5-one, 2-thiazolin-4-one, thiazolidin-4-one, thiazolidine-2,4-dione, rhodanine, thiazolidine-2,4-dione, isorhodanine, indane-1,3-dione, thiophen-3-one, thiophen-3-one-1,1-dioxide, indolin-2-one, indolin-3-one, 2-oxoindazolinium, 3-oxoindazolinium, 5,7-dioxo-6,7-dihydrothiazolo[3,2-a]pyrimidine, cyclohexane-1,3-dione, 3,4-dihydroisoquinolin-4-one, 1,3-dioxane-4,6-dione, barbituric acid, 2-thiobarbituric acid, chroman-2,4-dione, indazolin-2-one, pyrido[1,2-a]pyrimidine-1,3-dione, pyrazolo[1,5-b]quinazolone, pyrazolo[1,5-a]benzimidazole, pyrazolopyridone, 1,2,3,4-tetrahydroquinoline-2,4-dione, 3-oxo-2,3-dihydrobenzo[d]thiophene-1,1-dioxide and 3-dicyanomethine-2,3-dihydrobenzo[d]thiophene-1,1-dioxide;

additionally include nuclei having an exomethylene structure in which the carbonyl or thiocarbonyl group constituting the above-described nuclei is substituted at the active methylene position of the acidic nucleus, and nuclei having an exomethylene structure in which an active methylene compound having a structure such as ketomethylene or cyanomethylene as a starting material of the an acyclic acidic terminal group is substituted at the active methylene position.

These acidic nuclei and acyclic acidic terminal groups each may be substituted by a substituent represented by V described above or condensed with a ring.

$Z_6$, $Z_6'$ and $(N—R_6)_{q1}$, $Z_{13}$, $Z_{13}'$ and $(N—R_{13})_{q3}$, $Z_{20}$, $Z_{20}'$ and $(N—R_{20})_{q5}$, $Z_{24}$, $Z_{24}'$ and $(N—R_{24})_{q7}$, and $Z_{25}$, $Z_{25}'$ and $(N—R_{25})_{q8}$ in respective sets of three preferably form hydantoin, 2- or 4-thiohydantoin, 2-oxazolin-5-one, 2-thiooxazolin-2,4-dione, thiazolidine-2,4-dione, rhodanine, thiazolidine-2,4-dithione, barbituric acid or 2-thiobarbituric acid, more preferably hydantoin, 2- or 4-thiohydantoin, 2-oxazolin-5-one, rhodanine, barbituric acid or 2-thiobarbituric acid, still more preferably 2- or 4-thiohydantoin, 2-oxazolin-5-one, rhodanine or barbituric acid.

Examples of the heterocyclic ring formed by each set of three of $Z_8$, $Z_8'$ and $(N—R_8)_{q2}$, $Z_{15}$, $Z_{15}'$ and $(N—R_{15})_{q4}$, and $Z_{22}$, $Z_{22}'$ and $(N—R_{22})_{q6}$ are the same as those described for the heterocyclic ring formed by $Z_6$, $Z_6'$ and $(N—R_6)_{q1}$, $Z_{13}$, $Z_{13}'$ and $(N—R_{13})_{q3}$, $Z_{20}$, $Z_{20}'$ and $(N—R_{20})_{q5}$, $Z_{24}$, $Z_{24}'$ and $(N—R_{24})_{q7}$, or $Z_{25}$, $Z_{25}'$, and $(N—R_{25})_{q8}$. Among these, preferred are the acidic nuclei described above for the heterocyclic ring formed by $Z_6$, $Z_6'$ and $(N—R_6)_{q1}$, $Z_{13}$, $Z_{13}'$ and $(N—R_{13})_{q3}$, $Z_{20}$, $Z_{20}'$ and $(N—R_{20})_{q5}$, $Z_{24}$, $Z_{24}'$ and $(N—R_{24})_{q7}$, or $Z_{25}$, $Z_{25}'$ and $(N—R_{25})_{q8}$, from which an oxo group or a thioxo group is removed More preferred are the acidic nuclei described above as specific examples of the ring formed by $Z_6$, $Z_6'$ and $(N—R_6)_{q1}$, $Z_{13}$, $Z_{13}'$ and $(N—R_{13})_{q3}$, $Z_{20}$, $Z_{20}'$ and $(N—R_{20})_{q5}$, $Z_{24}$, $Z_{24}'$ and $(N—R_{24})_{q7}$, or $Z_{25}$, $Z_{25}'$ and $(N—R_{25})_{q8}$, from which an oxo group or a thioxo group is removed.

Still more preferred are hydantoin, 2- or 4-thiohydantoin, 2-oxazolin-5-one, 2-thiooxazolin-2,4-dione, thiazolidine-2,4-dione, rhodanine, thiazolidine-2,4-dione, barbituric acid and 2-thiobarbituric acid, from which an oxo group or a thioxo group is removed; particularly preferred are hydantoin, 2- or 4-thiohydantoin, 2-oxazolin-5-one, rhodanine, barbituric acid and 2-thiobarbituric acid, from which an oxo group or a thioxo group is removed; and most preferred are 2- or 4-thiohydantoin, 2-oxazolin-5-one and rhodanine, from which an oxo group or a thioxo group is removed.

$q_2$, $q_4$ and $q_6$ each is 0 or 1, preferably 1.

$R_1$, $R_2$, $R_3$, $R_4$, $R_5$, $R_6$, $R_7$, $R_8$, $R_9$, $R_{10}$, $R_{11}$, $R_{12}$, $R_{13}$, $R_{14}$, $R_{15}$, $R_{16}$, $R_{17}$, $R_{18}$, $R_{19}$, $R_{20}$, $R_{21}$, $R_{22}$, $R_{23}$, $R_{24}$ and $R_{25}$ each represents an alkyl group, an aryl group or a heterocyclic group. Specific examples thereof include an unsubstituted alkyl group having from 1 to 18, preferably from 1 to 7, more preferably from 1 to 4, carbon atoms (e.g., methyl, ethyl, propyl, isopropyl, butyl, isobutyl, hexyl, octyl, dodecyl, octadecyl), a substituted alkyl group having from 1 to 18, preferably from 1 to 7, more preferably from 1 to 4, carbon atoms {for example, an alkyl group substituted by the above-described substituent V, preferably an aralkyl group (e.g., benzyl, 2-phenylethyl), an unsaturated hydrocarbon group (e.g., allyl), a hydroxyalkyl group (e.g., 2-hydroxyethyl, 3-hydroxypropyl), a carboxyalkyl group (e.g., 2-carboxyethyl, 3-carboxypropyl, 4-carboxybutyl, carboxymethyl), an alkoxyalkyl group (e.g., 2-methoxyethyl, 2-(2-methoxyethoxy)ethyl), aryloxyalkyl group (e.g., 2-phenoxyethyl, 2-(1-naphthoxy)ethyl), an alkoxycarbonylalkyl group (e.g., ethoxycarbonylmethyl, 2-benzyloxycarbonylethyl), an aryloxycarbonylalkyl group (e.g., 3-phenoxycarbonylpropyl), an acyloxyalkyl group (e.g., 2-acetyloxyethyl), an acylalkyl group (e.g., 2-acetylethyl), a carbamoylalkyl group (e.g., 2-morpholinocarbonylethyl), a sulfamoylalkyl group (e.g., N,N-dimethylsulfamoylmethyl), a sulfoalkyl group (e.g., 2-sulfoethyl, 3-sulfopropyl, 3-sulfobutyl, 4-sulfobutyl, 2-[3-sulfopropoxy]ethyl, 2-hydroxy-3-sulfopropyl, 3-sulfopropoxyethoxyethyl), a sulfoalkenyl group, a sulfatoalkyl group, (e.g., 2-sulfatoethyl, 3-sulfatopropyl, 4-sulfatobutyl), a heterocyclic ring-substituted alkyl group (e.g., 2-(pyrrolidin-2-on-1-yl)ethyl, tetrahydrofurfuryl), an alkylsulfonylcarbamoylalkyl group (e.g., methanesulfonylcarbamoylmethyl), an acylcarbamoylalkyl group (e.g., acetylcarbamoylmethyl), an acylsulfamoylalkyl group (e.g., acetylsulfamoylmethyl) and an alkylsulfonylsulfamoylalkyl group (e.g., methanesulfonylsulfamoylmethyl)}, an unsubstituted aryl group having from 6 to 20, preferably from 6 to 10, more preferably from 6 to 8, carbon atoms (e.g., phenyl, 1-naphthyl), a substituted aryl group having from 6 to 20, preferably from 6 to 10, more preferably from 6 to 8, carbon atoms (e.g., an aryl group substituted by V described above as examples of the substituent; specifically, p-methoxyphenyl, p-methylphenyl, p-chlorophenyl), an unsubstituted heterocyclic group having from 1 to 20, preferably from 3 to 10, more preferably from 4 to 8, carbon atoms (e.g., 2-furyl, 2-thienyl, 2-pyridyl, 3-pyrazolyl, 3-isooxazolyl, 3-isothiazolyl, 2-imidazolyl, 2-oxazolyl, 2-thiazolyl, 2-pyridazyl, 2-pyrimidyl, 3-pyrazyl, 2-(1,3,5-triazolyl), 3-(1,2,4-triazolyl), 5-tetrazolyl) and a substituted heterocyclic group having from 1 to 20, preferably from 3 to 10, more preferably from 4 to 8, carbon atoms (e.g., a heterocyclic group substituted by V described above as examples of the substituent; specifically, 5-methyl-2-thienyl, 4-methoxy-2-pyrimidyl).

$R_1$, $R_3$, $R_4$, $R_5$, $R_6$, $R_7$, $R_8$ and $R_9$ each is preferably a group having an aromatic ring. Examples of the aromatic ring include a hydrocarbon aromatic ring and a heteroaromatic ring. These rings each may be a polycyclic condensation ring resulting from the condensation of hydrocarbon aromatic rings or heteroaromatic rings to each other, or a polycyclic condensation ring resulting from the combining of an aromahydrocarbon ring and an aromatic heterocyclic ring. These rings each may be substituted by the above-described substituent V or the like. Preferred examples of the aromatic ring include those described above as examples of the aromatic ring for the aromatic group.

The group having an aromatic ring can be represented by —Lb—$A_1$, wherein Lb represents a single bond or a linking group, and $A_1$ represents an aromatic group. Preferred examples of the linking group represented by Lb include the linking groups described above for La and the like. Examples of the aromatic group represented by $A_1$ include those described above as examples of the aromatic group.

Preferred examples of the alkyl group having a hydrocarbon aromatic ring include an aralkyl group (e.g., benzyl, 2-phenylethyl, naphthylmethyl, 2-(4-biphenyl)ethyl), an aryloxyalkyl group (e.g., 2-phenoxyethyl, 2-(1-naphthoxy)ethyl, 2-(4-biphenyloxy)ethyl, 2-(o-, m- or p-halophenoxy)ethyl, 2-(o-, m- or p-methoxyphenoxy)ethyl) and an aryloxycarbonylalkyl group (e.g., 3-phenoxycarbonylpropyl, 2-(1-naphthoxycarbonyl)ethyl). Preferred examples of the alkyl group having a heteroaromatic ring include 2-(2-pyridyl)ethyl, 2-(4-pyridyl)ethyl, 2-(2-furyl)ethyl, 2-(2-thienyl)ethyl and 2-(2-pyridylmethoxy)ethyl. Preferred examples of the hydrocarbon aromatic group include 4-methoxyphenyl, phenyl, naphthyl and biphenyl. Preferred examples of the heteroaromatic group include 2-thienyl, 4-chloro-2-thienyl, 2-pyridyl and 3-pyrazolyl.

Among these, more preferred are the substituted or unsubstituted alkyl group having a hydrocarbon aromatic ring or heteroaromatic ring, still more preferred are the substituted or unsubstituted alkyl group having a hydrocarbon aromatic ring.

$R_2$, $R_{10}$, $R_{11}$, $R_{12}$, $R_{13}$, $R_{14}$, $R_{15}$ and $R_{16}$ each is preferably a group having an aromatic ring. Both of $R_{10}$ and $R_{11}$, at least one of $R_{12}$ and $R_{13}$, and at least two of $R_{14}$, $R_{15}$ and $R_{16}$ have an anionic substituent. $R_2$ preferably has an anionic substituent. Examples of the aromatic ring include a hydrocarbon aromatic ring and a heteroaromatic ring. These rings each may be a polycyclic condensation ring resulting from the condensation of hydrocarbon aromatic rings or heteroaromatic rings to each other, or a polycyclic condensation ring resulting from the combining of an aromahydrocarbon ring and an aromatic heterocyclic ring. These rings each may be substituted by the above-described substituent V or the like. Preferred examples of the aromatic ring include those described above as examples of the aromatic ring for the aromatic group.

The group having an aromatic ring can be represented by —Lc—$A_2$, wherein Lc represents a single bond or a linking group, and $A_2$ represents an aromatic group. Preferred examples of the linking group represented by Lc include the linking groups described above for La and the like. Preferred examples of the aromatic group represented by $A_2$ include those described above as examples of the aromatic group. Lc or $A_2$ is preferably substituted by at least one anionic substituent.

Preferred examples of the alkyl group having a hydrocarbon aromatic ring include an aralkyl group substituted by a sulfo group, a phosphoric acid group or a carboxyl group (e.g., 2-sulfobenzyl, 4-sulfobenzyl, 4-sulfophenethyl, 3-phenyl-3-sulfopropyl, 3-phenyl-2-sulfopropyl, 4,4-diphenyl-3-sulfobutyl, 2-(4'-sulfo-4-biphenyl)ethyl, 4-phosphobenzyl), an aryloxycarbonylalkyl group substituted by a sulfo group, a phosphoric acid group or a carboxyl group (e.g., 3-sulfophenoxycarbonylpropyl) and an aryloxyalkyl group substituted by a sulfo group, a phosphoric acid group or a carboxyl group (e.g., 2-(4-sulfophenoxy)ethyl, 2-(2-phosphophenoxy)ethyl, 4,4-diphenoxy-3-sulfobutyl).

Preferred examples of the alkyl group having a heteroaromatic ring include 3-(2-pyridyl)-3-sulfopropyl, 3-(2-furyl)-3-sulfopropyl and 2-(2-thienyl)-2-sulfopropyl.

Preferred examples of the hydrocarbon aromatic group include an aryl group substituted by a sulfo group, a phosphoric acid group or a carboxyl group (e.g., 4-sulfophenyl, 4-sulfonaphthyl). Preferred examples of the heteroaromatic group include a heterocyclic group substituted by a sulfo group, a phosphoric acid group or a carboxyl group (e.g., 4-sulfo-2-thienyl, 4-sulfo-2-pyridyl).

Among these, more preferred is the alkyl group having a hydrocarbon aromatic ring or heteroaromatic ring substituted by a sulfo group, a phosphoric acid group or a carboxyl group, still more preferred is the alkyl group having a hydrocarbon aromatic ring substituted by a sulfo group, a phosphoric acid group or a carboxyl group, and most preferred are 2-sulfobenzyl, 4-sulfobenzyl, 4-sulfophenethyl, 3-phenyl-3-sulfopropyl and 4-phenyl-4-sulfobutyl.

In the case where the chromophore represented by $D_1$ in formula (III) is the methine dye represented by formula (IV), (V), (VI) or (VII), the substituents represented by $R_{17}$, $R_{18}$, $R_{19}$, $R_{20}$, $R_{21}$, $R_{22}$, $R_{23}$, $R_{24}$ and $R_{25}$ each is preferably the above-described unsubstituted alkyl group or substituted alkyl group (e.g., carboxyalkyl, sulfoalkyl, aralkyl, aryloxyalkyl).

In the case where the chromophore represented by $D_2$ in formula (III) is the methine dye represented by formula (IV), (V), (VI) or (VII), the substituents represented by $R_{17}$, $R_{18}$, $R_{19}$, $R_{20}$, $R_{21}$, $R_{22}$, $R_{23}$, $R_{24}$ and $R_{25}$ each is preferably an unsubstituted alkyl group or substituted alkyl group, more preferably an alkyl group having an anionic substituent (e.g., carboxyalkyl, sulfoalkyl), still more preferably a sulfoalkyl group.

$L_1$, $L_2$, $L_3$, $L_4$, $L_5$, $L_6$, $L_7$, $L_8$, $L_9$, $L_{10}$, $L_{11}$, $L_{12}$, $L_{13}$, $L_{14}$, $L_{15}$, $L_{16}$, $L_{17}$, $L_{18}$, $L_{19}$, $L_{20}$, $L_{21}$, $L_{22}$, $L_{23}$, $L_{24}$, $L_{25}$, $L_{26}$, $L_{27}$, $L_{28}$, $L_{29}$, $L_{30}$, $L_{31}$, $L_{32}$, $L_{33}$, $L_{34}$, $L_{35}$, $L_{36}$, $L_{37}$, $L_{38}$, $L_{39}$, $L_{40}$, $L_{41}$, $L_{42}$, $L_{43}$, $L_{44}$, $L_{45}$, $L_{46}$, $L_{47}$, $L_{48}$, $L_{49}$, $L_{50}$, $L_{51}$, $L_{52}$, $L_{53}$, $L_{54}$, $L_{55}$, $L_{56}$, $L_{57}$, $L_{58}$, $L_{59}$, $L_{60}$, $L_{61}$, $L_{62}$, $L_{63}$, $L_{64}$, $L_{65}$, $L_{66}$ and $L_{67}$ each independently represents a methine group. The methine group represented by $L_1$ to $L_{67}$ may have a substituent. Examples of the substituent include V described above, such as a substituted or unsubstituted alkyl group having from 1 to 15, preferably from 1 to 10, more preferably from 1 to 5, carbon atoms (e.g., methyl, ethyl, 2-carboxyethyl), a substituted or unsubstituted aryl group having from 6 to 20, preferably from 6 to 15, more preferably from 6 to 10, carbon atoms (e.g., phenyl, o-carboxyphenyl), a substituted or unsubstituted heterocyclic group having from 3 to 20, preferably from 4 to 15, more preferably from 6 to 10, carbon atoms (e.g., N,N-dimethylbarbituric acid), a halogen atom (e.g., chlorine, bromine, iodine, fluorine), an alkoxy group having from 1 to 15, preferably from 1 to 10, more preferably from 1 to 5, carbon atoms (e.g., methoxy, ethoxy), an amino group having from 0 to 15, preferably from 2 to 10, more preferably from 4 to 10, carbon atoms (e.g., methylamino, N,N-dimethylamino, N-methyl-N-phenylamino, N-methylpiperazino), an alkylthio group having from 1 to 15, preferably from 1 to 10, more preferably from 1 to 5, carbon atoms (e.g., methylthio, ethylthio) and an arylthio group having from 6 to 20, preferably from 6 to 12, more preferably from 6 to 10, carbon atoms (e.g., phenylthio, p-methylphenylthio). A ring may be formed with another methine group or a ring may be formed together with $Z_1$ to $Z_{25}$ or $R_1$ to $R_{25}$.

$L_1$, $L_2$, $L_3$, $L_4$, $L_5$, $L_6$, $L_{10}$, $L_{11}$, $L_{12}$, $L_{13}$, $L_{16}$, $L_{17}$, $L_{23}$, $L_{24}$, $L_{25}$, $L_{26}$, $L_{30}$, $L_{31}$, $L_{32}$, $L_{33}$, $L_{36}$, $L_{37}$, $L_{43}$, $L_{44}$, $L_{45}$, $L_{46}$, $L_{50}$, $L_{51}$, $L_{52}$, $L_{53}$, $L_{56}$, $L_{57}$, $L_{63}$ and $L_{64}$ each is preferably an unsubstituted methine group.

$n_1$, $n_2$, $n_3$, $n_4$, $n_5$, $n_6$, $n_7$, $n_8$, $n_9$, $n_{10}$, $n_{11}$, $n_{12}$ and n13 each independently represents 0, 1, 2, 3 or 4, preferably 0, 1, 2 or 3, more preferably 0, 1 or 2, still more preferably O or 1. When $n_1$, $n_2$, $n_3$, $n_4$, $n_5$, $n_6$, $n_7$, $n_8$, $n_9$, $n_{10}$, $n_{11}$, n12 and $n_{13}$ each is 2 or more, the methine group is repeated but these methine groups need not be the same.

$p_1$, $p_2$, $p_3$, $p_4$, $p_5$, $p_6$, $p_7$, $p_8$, $p_9$, $p_{10}$, $p_{11}$, $p_{12}$, $p_{13}$, $p_{14}$, $p_{15}$ and $p_{16}$ each independently represents 0 or 1, preferably 0.

$M_1$, $M_2$, $M_3$, $M_4$, $M_5$, $M_6$ and $M_7$ each is included in the formulae so as to show the presence of a cation or anion when required for neutralizing the ion charge of the dye. Typical examples of the cation include inorganic cation such as hydrogen ion ($H^+$), alkali metal ion (e.g., sodium ion, potassium ion, lithium ion) and alkaline earth metal ion (e.g., calcium ion), and organic cation such as ammonium ion (e.g., ammonium ion, tetraalkylammonium ion, triethylammonium ion, pyridinium ion, ethylpyridinium ion, 1,8-diazabicyclo[5.4.0]-7-undecenium ion). The anion may be either inorganic anion or organic anion and examples thereof include halogen anion (e.g., fluoride ion, chloride ion, iodide ion), substituted arylsulfonate ion (e.g., p-toluenesulfonate ion, p-chlorobenzenesulfonate ion), aryldisulfonate ion (e.g., 1,3-benzenesulfonate ion, 1,5-naphthalenedisulfonate ion, 2,6-naphthalenedisulfonate ion), alkylsulfate ion (e.g., methylsulfate ion), sulfate ion, thiocyanate ion, perchlorate ion, tetrafluoroborate ion, picrate ion, acetate ion and trifluoromethanesulfonate ion. Also, an ionic polymer or another dye having a charge opposite to the dye may be used. When the counter ion is hydrogen ion, $CO_2^-$ and $SO_3^-$ may be denoted as $CO_2H$ and $SO_3H$, respectively.

$m_1$, $m_2$, $m_3$, $m_4$, $m_5$, $m_6$ and $m_7$ each represents a number of 0 or greater necessary for balancing the electric charge, preferably a number of from 0 to 4, more preferably from 0 to 1, and is 0 when an inner salt is formed.

Specific examples only of the dyes used in preferred techniques described in Detailed Description of the Invention are set forth below, however, needless to say, the present invention is by no means limited thereto.

Specific Examples of Compound Represented by Formula (I) of the Present Invention (Including Lower Concept Structures)

| | $X_1$ | $X_2$ | $V_1$ | $V_2$ | $R_1$ | $R_2$ | Y |
|---|---|---|---|---|---|---|---|
| | | | | 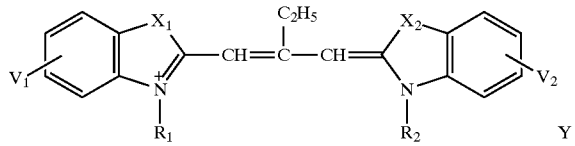 | | | |
| D-1 | O | O | 5-Ph | 5'-Ph | 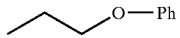 | 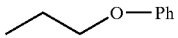 | 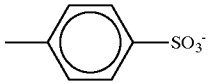 |
| D-2 | " | " | " | " | 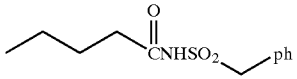 | 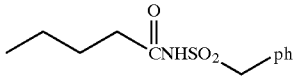 | $Br^-$ |
| D-3 | " | S | " | " | " | " | 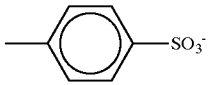 |
| D-4 | " | " | " | " | 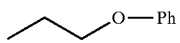 | 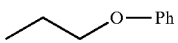 | $Br^-$ |
| D-5 | " | O | 4,5-Benzo | 4',5'-Benzo | 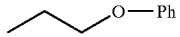 | 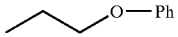 | 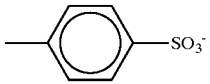 |
| D-6 | " | " | 5,6-Benzo | 5',6'-Benzo | 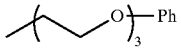 | 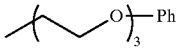 | " |
| D-7 | " | " | " | " | 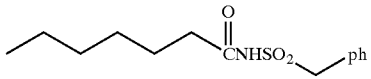 | 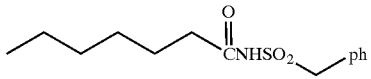 | " |
| D-8 | " | " | 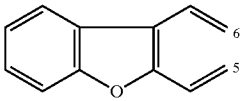 | 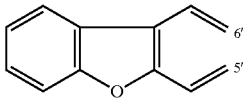 | " | " | " |
| D-9 | " | " | " | " | 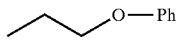 | 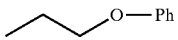 | " |

-continued
| | $X_1$ | $X_2$ | $V_1$ | $V_2$ | $R_1$ | $R_2$ | Y |
|---|---|---|---|---|---|---|---|
| D-10 | " | " | 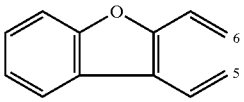 | 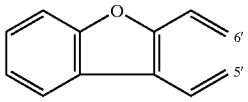 | " | " | " |
| D-11 | S | S | 5-Ph | 5'-Ph | " | " | " |
| D-12 | " | " | 5-Cl | 5'-Cl | 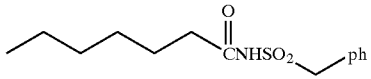 | 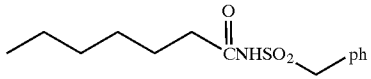 | " |
| D-13 | " | " | 5,6-Benzo | 5',6'-Benzo | " | " | " |
| | | | 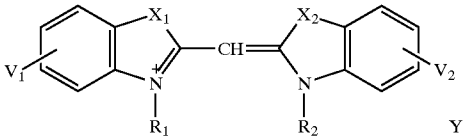 | | | | |
| D-14 | S | S | 5-Ph | 5-Ph | 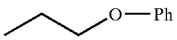 | 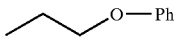 | 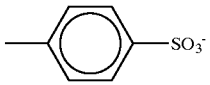 |
| D-15 | " | " | 5-Ph | 5-Ph | 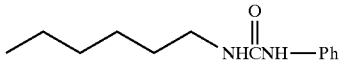 | 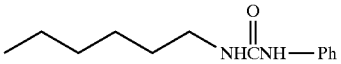 | " |
| D-16 | " | " | 5,6-Benzo | 5',6'-Benzo | 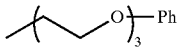 | 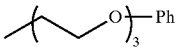 | " |
| D-17 | " | O | " | " | 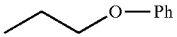 | 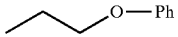 | " |
| D-18 | O | " | " | " | " | " | " |
| D-19 | S | S | 5,6-Benzo | 5',6'-Benzo | 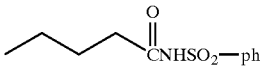 | 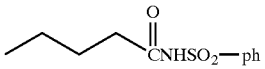 | " |
| D-20 | " | " | 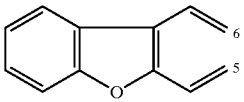 | 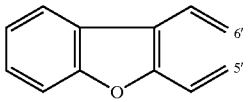 | 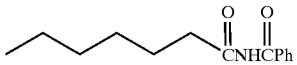 | 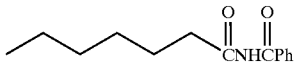 | " |

Specific Examples of Compound Represented by Formula (II) of the Present Invention (Including Lower Concept Structures)
| | $X_1$ | $X_2$ | $V_1$ | $V_2$ | $R_1$ | $R_2$ | Y |
|---|---|---|---|---|---|---|---|
| | | | 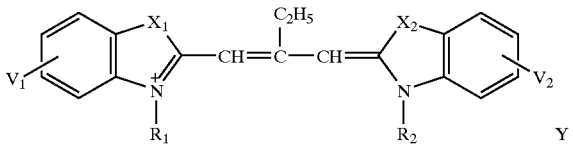 | | | | |
| D-21 | O | O | 5-Ph | 5'-Ph | 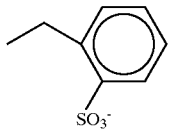 | 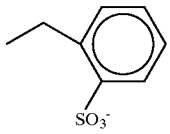 | $Na^+$ |
| D-22 | " | " | " | " | 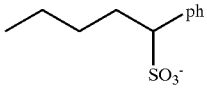 | 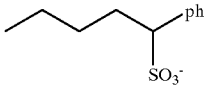 | " |
| D-23 | " | S | " | " | " | " | $\overset{+}{H}N(C_2H_5)_3$ |
| D-24 | S | " | " | " | " | " | " |
| D-25 | " | " | " | " | 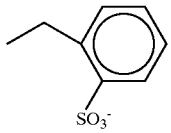 | 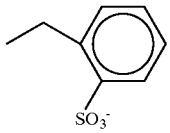 | " |
| D-26 | O | O | 5,6-Benzo | 5',6'-Benzo | " | " | " |
| D-27 | " | " | 4,5-Benzo | " | " | " | " |
| D-28 | " | " | 5,6-Benzo | 5',6'-Benzo | 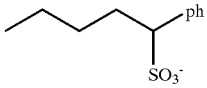 | 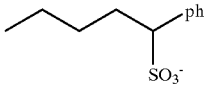 | " |
| D-29 | " | " | 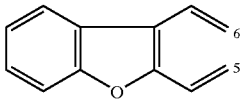 | 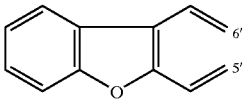 | 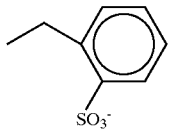 | 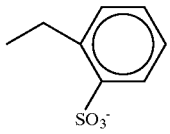 | " |
| D-30 | S | S | 5-Cl | 5'-Cl | " | " | " |
| | | | 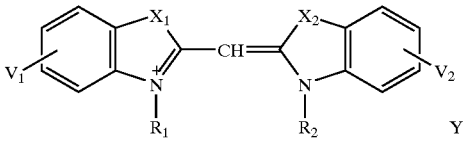 | | | | |
| D-31 | S | S | 5-Ph | 5-Ph | 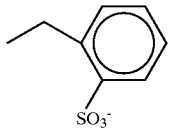 | 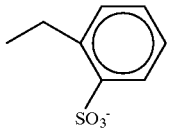 | $Na^+$ |
| D-32 | " | " | 5,6-Benzo | 5',6'-Benzo | " | " | " |
| D-33 | " | O | " | " | " | " | " |
| D-34 | O | " | " | " | " | " | " |

-continued

| | $X_1$ | $X_2$ | $V_1$ | $V_2$ | $R_1$ | $R_2$ | Y |
|---|---|---|---|---|---|---|---|
| D-35 | S | " | 5,6-Benzo | 5-Ph | 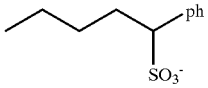 | 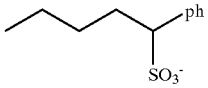 | " |

Specific Examples of Compound Represented by Formula (III) of the Present Invention

D-36

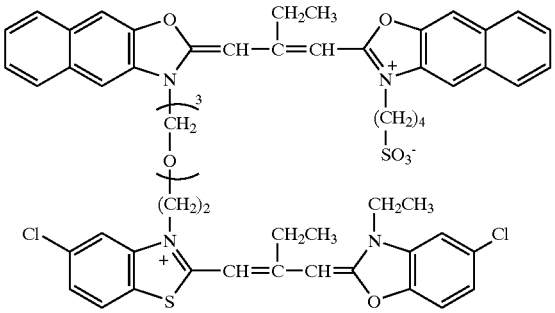

The dyes of the present invention can be synthesized by the methods described in F. M. Harmer, *Heterocyclic Compounds—Cyanine Dyes and Related Compounds,* John Wiley & Sons, New York, London (1964), D. M. Sturmer, *Heterocyclic Compounds—Special topics in heterocyclic chemistry,* Chap. 18, Sec. 14, pp. 482–515, John Wiley & Sons, New York, London (1977), *Rodd's Chemistry of Carbon Compounds,* 2nd ed., Vol. IV, Part B, Chap. 15, pp. 369–422, Elsevier Science Publishing Company Inc., New York (1977), and patents and literatures described above (cited for describing specific examples).

The present invention is not limited only to the use of sensitizing dyes of the present invention but a sensitizing dye other than those of the present invention may also be used in combination. Among the dyes which can be used, preferred are cyanine dyes, merocyanine dyes, rhodacyanine dyes, trinuclear merocyanine dyes, tetranuclear merocyanine dyes, allopolar dyes, hemicyanine dyes and styryl dyes, more preferred are cyanine dyes, merocyanine dyes and rhodacyanine dyes, still more preferred are cyanine dyes. These dyes are described in detail in F. M. Harmer, *Heterocyclic Compounds—Cyanine Dyes and Related Compounds,* John Wiley & Sons, New York, London (1964), D. M. Sturmer, *Heterocyclic Compounds—Special topics in heterocyclic chemistry,* Chap. 18, Section 14, pp. 482–515.

Examples of preferred dyes include the sensitizing dyes represented by the formulae or as specific examples in U.S. Pat. No. 5,994,051, pp. 32–55, and U.S. Pat. No. 5,747,236, pp. 30–39.

For cyanine dyes, merocyanine dyes and rhodacyanine dyes, formulae (XI), (XII) and (XIII) described in U.S. Pat. No. 5,340,694, columns 21 to 22, are preferred on the condition that the numbers of n12, n15, n17 and n18 are not limited and each is an integer of 0 or more (preferably 4 or less).

These sensitizing dyes may be used either individually or in combination of two or more thereof. The combination of sensitizing dyes is often used for the purpose of supersensitization. Typical examples thereof are described in U.S. Pat. Nos. 2,688,545, 2,977,229, 3,397,060, 3,522,052, 3,527,641, 3,617,293, 3,628,964, 3,666,480, 3,672,898, 3,679,428, 3,303,377, 3,769,301, 3,814,609, 3,837,862 and 4,026,707, British Patents 1,344,281 and 1,507,803, JP-B-43-49336 and JP-B-53-12375, JP-A-52-110618 and JP-A-52-109925.

Together with the sensitizing dye, a dye which itself has no spectral sensitization effect or a substance which absorbs substantially no visible light, but which exhibits supersensitization may be contained in the emulsion.

Examples of the supersensitizing agent (for example, pyrimidylamino compounds, triazinylamino compounds, azolium compounds, aminostyryl compounds, aromatic organic formaldehyde condensate, azaindene compounds, cadmium salts) useful in the spectral sensitization of the present invention and examples of the combination of a supersensitizing agent with a sensitizing dye are described in U.S. Pat. Nos. 3,511,664, 3,615,613, 3,615,632, 3,615,641, 4,596,767, 4,945,038, 4,965,182, 2,933,390, 3,635,721, 3,743,510 and 3,617,295. With respect to the use method thereof, those described in these patents are also preferred.

The sensitizing dyes (the same applies to other sensitizing dyes and supersensitizing agents) of the present invention may be added to the silver halide emulsion according to the present invention in any process during the preparation of the emulsion, which is heretofore recognized as useful. The addition may be performed at any time or step as long as it is before the coating of the emulsion, for example, during the formation and/or before the desalting of silver halide grains, during the desalting and/or after the desalting but before the initiation of chemical ripening as disclosed in U.S. Pat. Nos. 2,735,766, 3,628,960, 4,183,756 and 4,225,666, JP-A-58-184142 and JP-A-60-196749, immediately before or during the chemical ripening, or after the chemical ripening but before the coating as disclosed in JP-A-58-113920. Also, as disclosed in U.S. Pat. No. 4,225,666 and JP-A-58-7629, the same compound solely or in combination with a compound having a different structure may be added in parts, for example, during the grain formation and during or after the completion of chemical ripening, or before or during the chemical ripening and after the completion of chemical ripening. When added in parts, the kind of the compound or the combination of compounds may be varied.

The added amount of the sensitizing dye (the same applies to other sensitizing dyes and supersensitizing dyes) according to the present invention varies depending on the shape and size of silver halide grain, however, the sensitizing dye can be used in an amount of from $1\times10^{-6}$ to $8\times10^{-3}$ mol per mol of silver halide. For example, when the silver halide grain size is from 0.2 to 1.3 $\mu$m, the added amount is preferably from $2\times10^{-6}$ to $3.5\times10^{-3}$, more preferably from $7.5\times10^{-6}$ to $1.5\times10^{-3}$ mol, per mol of silver halide.

However, in the case of adsorbing in multiple layers, the sensitizing dye of the present invention is added in an amount necessary for attaining the multilayer adsorption.

The sensitizing dye of the present invention (the same applies to other sensitizing dyes and supersensitizing dyes) according to the present invention can be dispersed directly in the emulsion or can be added to the emulsion in the form of a solution after dissolving the dye in an appropriate solvent such as methyl alcohol, ethyl alcohol, methyl cellosolve, acetone, water or pyridine or in a mixed solvent thereof. At this time, additives such as base, acid or surfactant can be added and allowed to be present together. For the dissolving, an ultrasonic wave may also be used. With respect to the addition method of the compound, a method of dissolving the compound in a volatile organic solvent, dispersing the solution in a hydrophilic colloid and adding the dispersion to the emulsion described in U.S. Pat. No. 3,469,987, a method of dispersing the compound in a water-soluble solvent and adding the dispersion to the emulsion described in JP-B-46-24185, a method of dissolving the compound in a surfactant and adding the solution to the emulsion described in U.S. Pat. No. 3,822,135, a method of dissolving the compound using a compound capable of red shifting and adding the solution to the emulsion described in JP-A-51-74624, and a method of dissolving the compound in an acid substantially free of water and adding the solution to the emulsion described in JP-A-50-80826 may be used. In addition, for the addition to the emulsion, the methods described in U.S. Pat. Nos. 2,912,343, 3,342,605, 2,996,287 and 4,429,835 may be used.

By virtue of the silver halide photographic emulsion having a high light absorption strength in which a sensitizing dye is adsorbed in multiple layers as described above, high sensitivity can be attained. However, the problems incurred by such an emulsion have been heretofore not known at all.

As a result of extensive investigations, the present inventors have found that when the optical density at a spectral absorption maximum wavelength before the photographic processing of the photographic emulsion is assumed to be G0 and the optical density at a spectral absorption maximum wavelength after the photographic processing is assumed to be G1, if A represented by A=G1/G0 exceeds 0.9, the photographic capability is seriously impaired. When A is 0.9 or less, the problems are reduced. A is preferably 0.7 or less, more preferably 0.5 or less, still more preferably 0.3 or less, particularly preferably 0.1 or less.

In the above, G1 and G0 each means an optical density attributable to the sensitizing dye which takes part in the spectral absorption.

For example, when the optical density attributable to an azomethine dye produced from a coupler upon color development or to a coloring material overlaps the optical density attributable to the sensitizing dye, the optical density resulting from subtracting the absorption of azomethine dye or the coloring material is G0 or G1.

In order to eliminate the effect of the azomethine dye, for example, G1 in the unexposed area undergoing no color formation may be evaluated. In order to eliminate the effect of the coloring material, after estimating the optical density of the coloring material from a light-sensitive material in which the sensitizing dye is not added, the estimated optical density may be subtracted from the optical density of a light-sensitive material in which the sensitizing dye is added.

The above-described newly found problem is described below. In conventional light-sensitive materials, the sensitizing dye has a small light absorption strength, therefore, the optical density at a spectral absorption maximum wavelength is not so greatly changed between before and after the photographic processing. In other words, even if A exceeds 0.9, the problems described below do not come out to a fatal problem.

The problems are dispersion in the image quality of silver halide light-sensitive materials and when printed from a color negative light-sensitive material, dispersion in the color balance described in JP-A-11-160836.

As a result of extensive investigations, the present inventors have found that when the optical density at a spectral absorption maximum wavelength before the photographic processing of the silver halide photographic light-sensitive material is assumed to be G0 and the optical density at a spectral absorption maximum wavelength after the photographic processing is assumed to be G1, if A represented by A=G1/G0 is 0.9 or less, those problems can be solved.

For reducing A to 0.9 or less, any method may be used, however, for example, the following methods may be used.

1. Method of designing the structure of sensitizing dye:

By designing the structure of the sensitizing dye, A can be set to 0.9 or less. Examples of such a dye include a dye having a dissociative group and being capable of changing in the hydrophilicity/hydrophobicity by the change in the environment (for example, pH), a dye capable of changing in the coloring state by the change in the environment (for example, pH) (for example, a dye which decolorizes at a predetermined pH) and a dye capable of reacting with the components in the processing solution and changing in the coloring state (for example, a dye which decolorizes).

Specific examples of the dye having a dissociative group and being capable of changing in the hydrophilicity/hydrophobicity by the change of pH are shown below but the present invention is not limited thereto by any means.

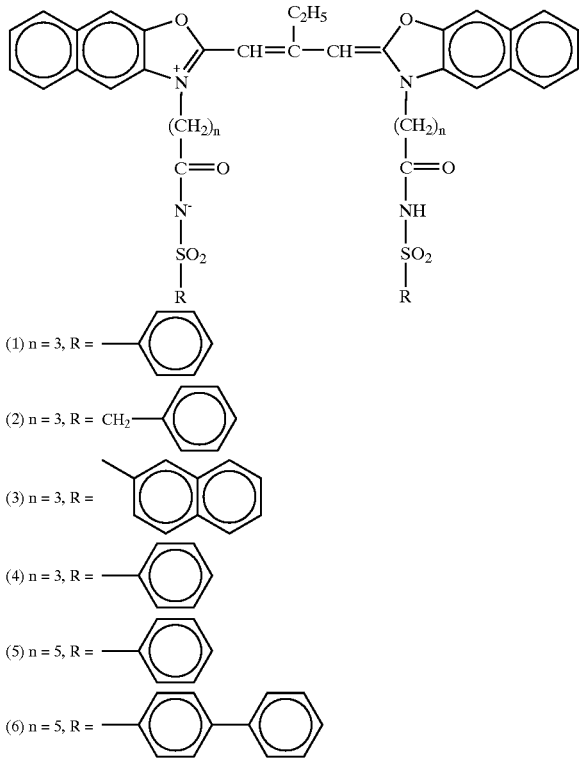

-continued (7) n = 5, R =

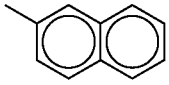

2. The following methods described, for example, in *Research Disclosure,* Vol. 207, No. 20733 (July, 1981):

(1) method of adding a water-soluble stilbene compound, a nonionic surfactant or a mixture of both to a developer;

(2) method of treating a photographic element after the bleaching and fixing with an oxidizing agent to destroy the dye; and (3) method of using a persulfate bleaching bath as the bleaching bath.

3. Method of decolorizing the dye

This method is described in JP-A-64-4739, JP-A-64-15734, JP-A-64-35440, JP-A-1-9451, JP-A-1-21444, JP-A-1-35441 and JP-A-1-159645. These all are a method of adding additives to a development processing solution or the like.

4. Method of destroying association of sensitizing dye:

This method is described in JP-A-2-50151 and JP-A-2-71260. These are a method of destroying the association of a sensitizing dye and thereby attaining decolorization.

These methods 1 to 4 may be used in combination.

In the present invention, the silver halide-adsorbing compound (a photographically useful compound which adsorbs to a silver halide grain) other than the sensitizing dye includes an antifoggant, a stabilizer and a nucleating agent. Examples of the antifoggant and stabilizer which can be used include the compounds described in *Research Disclosure,* Vol. 176, Item 17643 (RD17643), ibid., Vol. 187, Item 18716 (RD18716), and ibid., Vol. 308, Item 308119 (RD308119). Examples of the nucleating agent which can be used include hydrazines described in U.S. Pat. Nos. 2,563,785 and 2,588,982, hydrazides and hydrazones described in U.S. Pat. No. 3,227,552, heterocyclic quaternary salt compounds described in British Patent 1,283,835, JP-A-52-69613, JP-A-55-138742, JP-A-60-11837, JP-A-62-210451, JP-A-62-291637, U.S. Pat. Nos. 3,615,515, 3,719,494, 3,734,738, 4,094,683, 4,115,122, 4,306,016 and 4,471,044, sensitizing dyes containing within the dye molecule a substituent having nucleation activity described in U.S. Pat. No. 3,718,470, thiourea bonding-type acylhydrazine-base compounds described in U.S. Pat. Nos. 4,030,925, 4,031,127, 4,245,037, 4,255,511, 4,266,013 and 4,276,364 and British Patent 2,012,443, and acylhydrazine-base compounds having bonded thereto a thioamide ring or a heterocyclic group such as triazole or tetrazole as the adsorbing group described in U.S. Pat. Nos. 4,080,270 and 4,278,748 and British Patent 2,011,391B.

In the present invention, preferred examples of the silver halide-adsorbing compound include nitrogen-containing heterocyclic compounds such as thiazole and benzotriazole, mercapto compounds, thioether compounds, sulfinic acid compounds, thiosulfonic acid compounds, thioamide compounds, urea compounds, selenourea compounds and thiourea compounds. Among these, more preferred are nitrogen-containing heterocyclic compounds, mercapto compounds, thioether compounds and thiourea compounds, and still more preferred are nitrogen-containing heterocyclic compounds. The nitrogen-containing heterocyclic compounds are preferably nitrogen-containing heterocyclic compounds represented by formulae (VIII) to (XI).

(VIII)

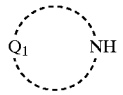

(IX)

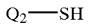

(X)

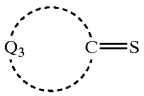

(XI)

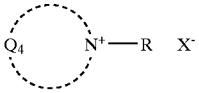

The compound represented by formula (VIII) is a nitrogen-containing heterocyclic compound containing an (tautomerizable) imino group in the heterocyclic ring, the compound represented by formula (IX) is a nitrogen-containing heterocyclic compound containing a (tautomerizable) mercapto group, the compound represented by formula (X) is a nitrogen-containing heterocyclic compound containing a (non-tautomerizable) thione group, and the compound represented by formula (XI) is a nitrogen-containing heterocyclic compound containing a quaternary ammonium group. These compounds each may be in an appropriate salt form.

In the formulae, $Q_1$, $Q_2$, $Q_3$ and $Q_4$ each represents a nitrogen-containing heterocyclic ring and examples thereof include an imidazole ring, a benzimidazole ring, a naphthoimidazole ring, a thiazole ring, a benzothiazole ring, a naphthothiazole ring, an oxazole ring, a benzoxazole ring, a naphthoxazole ring, a benzoselenazole ring, a triazole ring, a benzotriazole ring, a tetrazole ring, an azaindene ring (e.g., diazaindene ring, triazaindene ring, tetrazaindene ring, pentazaindene ring), a purine ring, a thiadiazole ring, an oxadiazole ring, a selenazole ring, an indazole ring, a triazine ring, a pyrazole ring, a pyrimidine ring, a pyridazine ring, a quinoline ring, a rhodanine ring, a thiohydantoin ring, an oxazolidinedione ring and a phthalazine ring.

Among these, preferred are an azaindene ring, a (benzo) triazole ring, an indazole ring, a triazine ring, a purine ring and a tetrazole ring for formula (VIII), a tetrazole ring, a triazole ring, a (benz)imidazole ring, a (benzo)thiazole ring, a (benz)oxazole ring, a thiadiazole ring, an azaindene ring and a pyrimidine ring for formula (IX), a (benzo)thiazole ring, a (benz)imidazole ring, a (benz)oxazole ring, a triazole ring and a tetrazole ring for formula (X), and a (benzo, naphtho)thiazole ring, a (benz, naphtho)imidazole ring and a (benz, naphtho)oxazole ring for formula (XI). The "(benzo, naphtho)thiazole ring" above means "a thiazole ring, a benzothiazole ring or a naphthothiazole ring" (the same applies for others).

These heterocyclic rings each may have an appropriate substituent such as a hydroxyl group, an alkyl group (e.g., methyl, ethyl, pentyl), an alkenyl group (e.g., allyl), an alkylene group (e.g., ethynyl), an aryl group (e.g., phenyl, naphthyl), an aralkyl group (e.g., benzyl), an amino group, a hydroxyamino group, an alkylamino group (e.g., ethylamino), a dialkylamino group (e.g., dimethylamino), an arylamino group (e.g., phenylamino), an acylamino group (e.g., acetylamino), an acyl group (e.g., acetyl), an alkylthio group (e.g., methylthio), a carboxy group, a sulfo group, an alkoxyl group (e.g., ethoxy), an aryloxy group (e.g., phenoxy), an alkoxycarbonyl group (e.g., methoxycarbonyl), a carbamoyl group which may be substituted, a sulfamoyl group which may be substituted, a ureido group which may be substituted, a cyano group, a halogen atom (e.g. , chlorine, bromine), a nitro group, a mercapto group and a heterocyclic ring (e.g., pyridyl).

In the formulae, R represents an alkyl group (e.g., methyl, ethyl, hexyl), an alkenyl group (e.g., allyl, 2-butenyl), an alkylene group (e.g., ethynyl), an aryl group (e.g., phenyl) or an aralkyl group (e.g., benzyl), which may have an appropriate substituent.

$X^-$ represents an anion (for example, an inorganic anion such as halogen ion or an organic anion such as paratoluene sulfonate).

Among those compounds, preferred are the compounds represented by formulae (VIII), (IX) and (XI), more preferred are hydroxyl group-substituted tetrazaindenes (which is tautomerizable and may have an imino group) for formula (VIII), mercaptotetrazoles having an acidic group (e.g., carboxy group, sulfo group) for formula (IX), and benzothiazoles for formula (XI).

Among those compounds, the compounds represented by formulae (VIII) and (IX) each bonds with silver ion to form a silver salt. In this case, the nitrogen-containing heterocyclic compound preferably forms a silver salt having a solubility product in water in the vicinity of room temperature of $10^{-9}$ to $10^{-20}$, more preferably $5\times10^{-10}$ to $10^{-18}$.

The photographically useful compound may be added before the addition of sensitizing dyes, after the completion of the addition, or in the time period between the initiation of the addition and the completion of the addition, but the photographically useful compound is preferably added before the addition of sensitizing dyes or in the time period between the initiation and the completion of the addition, more preferably in the time period between the initiation and the completion of the addition of sensitizing dyes.

The amount of the photographically useful compound added varies depending on the function of the additive or the kind of the emulsion, however, it is typically from $5\times10^{-5}$ to $5\times10^{-3}$ mol/mol-Ag.

Specific examples of the photographically useful compound adsorptive to a silver halide grain are shown below. Needless to say, the present invention is by no means limited thereto.

C-1

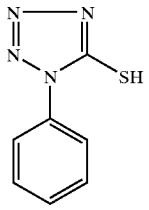

C-2

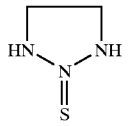

C-3

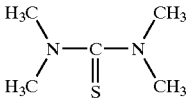

-continued

C-4

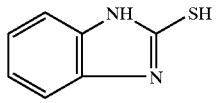

C-5

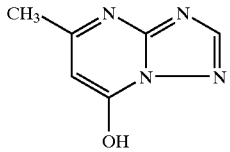

C-6

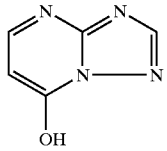

C-7

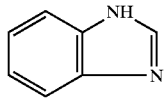

C-8

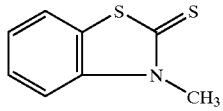

C-9

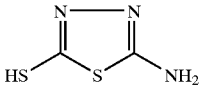

C-10

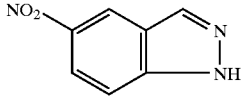

C-11

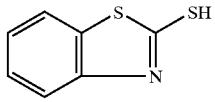

C-12

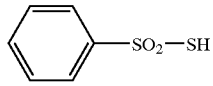

C-13

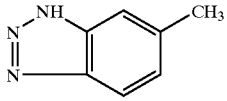

C-14

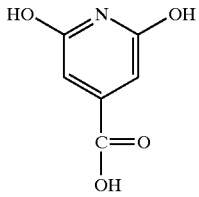

C-15

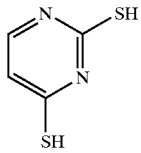

-continued

C-16

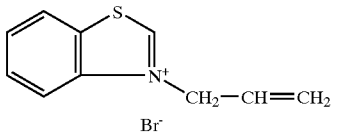

C-17

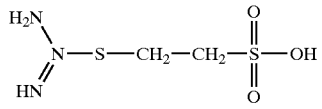

C-18

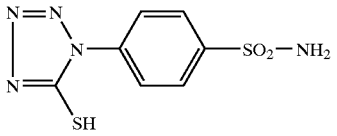

C-19

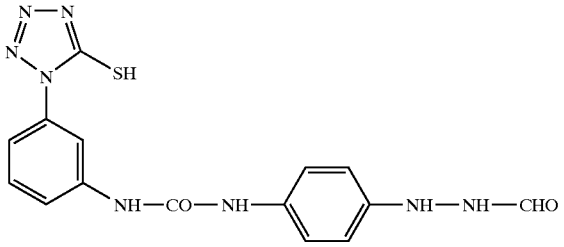

C-20

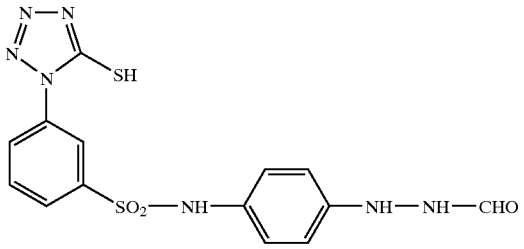

C-21

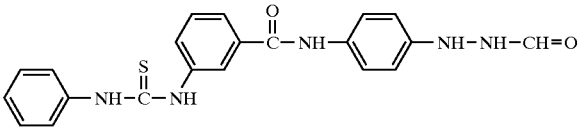

C-22

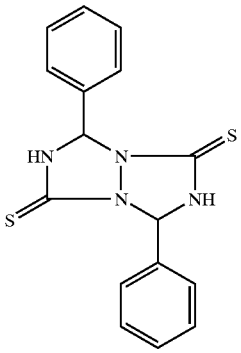

-continued

C-23

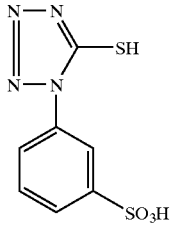

C-24

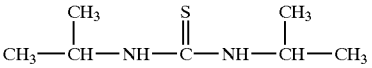

C-25

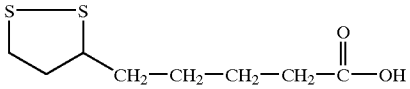

For the photographic emulsion undertaking the photosensitive mechanism in the present invention, any of silver bromide, silver iodobromide, silver chlorobromide, silver iodide, silver iodochloride, silver iodobromochloride and silver chloride may be used. However, the halogen composition on the outermost surface of emulsion preferably has an iodide content of 0.1 mol % or more, more preferably 1 mol % or more, still more preferably 5 mol % or more, whereby the multilayer adsorption structure can be more firmly constructed.

The grain size distribution may be either broad or narrow but narrow distribution is preferred.

The silver halide grain of the photographic emulsion may be a grain having a regular crystal form such as cubic, octahedral, tetradecahedral or rhombic dodecahedral form, a grain having an irregular crystal form such as spherical or tabular form, a grain having a high-order face ((hkl) face), or a mixture of grains having these crystal forms, however, a tabular grain is preferred. The tabular grain is described in detail later. The grain having a high-order face is described in *Journal of Imaging Science,* Vol. 30, pp. 247–254 (1986).

For the silver halide photographic emulsion for use in the present invention, the above-described silver halide grains may be used either individually or in mixture. The silver halide grain may have different phases between the interior and the surface layer, may have a multi-phase structure, for example, with a junction structure, may have a localized phase on the grain phase or may have a uniform phase throughout the grain. These grains may also be present in mixture.

These various emulsions each may be either a surface latent image-type emulsion in which a latent image is mainly formed on the surface, or an internal latent image-type emulsion in which a latent image is formed inside the grain.

In the present invention, a silver halide tabular grain having a halogen composition of silver chloride, silver bromide, silver chlorobromide, silver iodobromide, silver chloroiodobromide or silver iodochloride is preferably used. The tabular grain preferably has a main surface of (100) or (111). The tabular grain having a (111) main surface is hereinafter referred to as a (111) tabular grain and this grain usually has a triangular or hexangular face. In general, when the distribution becomes more uniform, tabular grains having a hexangular face occupy a higher ratio. JP-B-5-61205 describes the monodisperse hexangular tabular grains.

The tabular grain having a (100) face as the main surface is hereinafter called a (100) tabular grain and this grain has a rectangular or square form. In the case of this emulsion, a grain having a ratio of adjacent sides of less than 5:1 is called a tabular grain rather than an acicular grain. When the tabular grain is silver chloride or a grain having a large silver chloride content, the (100) tabular grain is higher in the stability of the main surface than that of the (111) tabular grain. The (111) tabular grain must be subjected to stabilization of the (111) main surface and the method therefor is described in JP-A-9-80660, JP-A-9-80656 and U.S. Pat. No. 5,298,388.

The (111) tabular grain comprising silver chloride or having a high silver chloride content for use in the present invention is disclosed in the following patents:

U.S. Pat. Nos. 4,414,306, 4,400,463, 4,713,323, 4,783,398, 4,962,491, 4,983,508, 4,804,621, 5,389,509, 5,217,858 and 5,460,934.

The (111) tabular grain having a high silver bromide content for use in the present invention is described in the following patents:

U.S. Pat. Nos. 4,425,425, 4,425,426, 4,434,226, 4,439,520, 4,414,310, 4,433,048, 4,647,528, 4,665,012, 4,672,027, 4,678,745, 4,684,607, 4,593,964, 4,722,886, 4,755,617, 4,755,456, 4,806,461, 4,801,522, 4,835,322, 4,839,268, 4,914,014, 4,962,015, 4,977,074, 4,985,350, 5,061,609, 5,061,616, 5,068,173, 5,132,203, 5,272,048, 5,334,469, 5,334,495, 5,358,840 and 5,372,927.

The (100) tabular grain for use in the present invention is described in the following patents: U.S. Pat. Nos. 4,386,156, 5,275,930, 5,292,632, 5,314,798, 5,320,938, 5,319,635 and 5,356,764, European Patents 569,971 and 737,887, JP-A-6-308648 and JP-A-9-5911.

The silver halide emulsion for use in the present invention is preferably a tabular silver halide grain having adsorbed thereto a sensitizing dye disclosed in the present invention and having a higher surface area/volume ratio, and the emulsion in which grains having the aspect ratio of 2 or more (preferably 100 or less), preferably from 5 to 80, more preferably from 8 to 80 occupy 50% or more (area) of all silver halide grains is preferred.

The thickness of the tabular grain is preferably less than 0.2 $\mu$m, more preferably less than 0.1 $\mu$m, still more preferably less than 0.07 $\mu$m. For preparing a tabular grain having such a high aspect ratio and a small thickness, the following technique is applied.

The tabular grain for use in the present invention is preferably uniform in the dislocation line amount distribution among grains. In the emulsion of the present invention, silver halide grains having 10 or more dislocation lines per one grain preferably occupy from 50 to 100% (by number), more preferably from 70 to 100%, still more preferably from 90 to 100%, of all grains.

If this ratio is less than 50%, disadvantageous results come out in view of homogeneity among grains.

In the present invention, when determining the ratio of grains having a dislocation line and the number of dislocation lines, the dislocation line is preferably observed directly on at least 100 grains, more preferably 200 grains or more, still more preferably 300 grains or more.

As a protective colloid used in the preparation of the emulsion of the present invention and as a binder of other hydrophilic colloids, gelatin is advantageously used, however, a hydrophilic colloid other than gelatin can also be used.

Examples of other hydrophilic colloids which can be used include proteins such as gelatin derivatives, graft polymers of gelatin to other polymer, albumin and casein; sugar derivatives such as cellulose derivatives (e.g., hydroxyethyl cellulose, carboxymethyl cellulose, cellulose sulfuric acid esters), sodium arginate and starch derivatives; and various synthetic hydrophilic polymer materials such as homopolymers and copolymers of polyvinyl alcohol, polyvinyl alcohol partial acetal, poly-N-vinylpyrrolidone, polyacrylic acid, polymethacrylic acid, polyacrylamide, polyvinyl imidazole and polyvinyl pyrazole.

The gelatin may be a lime-processed gelatin, an acid-processed gelatin or an enzyme-processed gelatin described in *Bull. Soc. Photo. Japan,* No. 16, p. 30 (1966), and a hydrolysate or enzymolysate of gelatin can also be used.

The emulsion of the present invention is preferably washed with water for desilvering to form a newly prepared protective colloid dispersion. The water washing temperature may be selected according to the purpose but is preferably selected in the range of from 5° C. to 50° C. The pH at the water washing can also be selected according to the purpose but is preferably selected in the range of from 2 to 10, more preferably from 3 to 8. The pAg at the water washing can also be selected according to the purpose but is preferably selected in the range of from 5 to 10. The water washing method may be selected from noodle water washing, dialysis using a diaphragm, centrifugal separation, coagulating precipitation and ion exchanging. In the case of coagulating precipitation, the method may be selected from a method of using a sulfate, a method of using an organic solvent, a method of using a water-soluble polymer and a method of using a gelatin derivative.

During the preparation of the emulsion of the present invention, a salt of metal ion is preferably allowed to be present according to the purpose, for example, during the grain formation, at the desalting, at the chemical sensitization or before the coating. The metal ion salt is preferably added during the grain formation when it is doped into a grain, and preferably added after the grain formation but before the completion of chemical sensitization when it is used to modify the grain surface or used as a chemical sensitizer. In doping, the metal ion salt may be doped throughout a grain or may be doped only into the core or shell part of a grain. Examples of the metal which can be used in the present invention include Mg, Ca, Sr, Ba, Al, Sc, Y, La, Cr, Mn, Fe, Co, Ni, Cu, Zn, Ga, Ru, Rh, Pd, Re, Os, Ir, Pt, Au, Cd, Hg, Tl, In, Sn, Pb and Bi. These metals each may be added if it is in the form of a salt which can be dissolved during the grain formation, such as ammonium salt, acetate, nitrate, sulfate, phosphate, hydroxide, six-coordinate complex salt and four-coordinate complex salt. Examples thereof include $CdBr_2$, $CdCl_2$, $Cd(NO_3)_2$, $Pb(NO_3)_2$, $Pb(CH_3COO)_2$, $K_3[Fe(CN)_6]$, $(NH_4)_4[Fe(CN)_6]$, $K_3IrCl_6$, $(NH_4)_3RhCl_6$ and $K_4Ru(CN)_6$. The ligand of the coordination compound may be selected from halo, aco, cyano, cyanate, thiocyanate, nitrosyl, oxo and carbonyl. Only one of these metal compounds may be used or two or more of these metal compounds may be used in combination.

The metal compound is preferably added after dissolving it in water or an appropriate organic solvent such as methanol and acetone. In order to stabilize the solution, a method of adding an aqueous solution of hydrogen halide (e.g., HCl HBr) or alkali halide (e.g., KCl NaCl, KBr, NaBr) may be used. If desired, an acid, an alkali or the like may also be added. The metal compound may also be charged into the reaction vessel before the grain formation or may be added during the grain formation. Also, it is possible to add the metal compound to a water-soluble silver salt (e.g., $AgNO_3$)

or aqueous solution of alkali halide (e.g., NaCl, KBr, KI) and then continuously add the solution during the formation of silver halide grains. Furthermore, a solution may be prepared independently of a water-soluble silver salt or an alkali halide and then continuously added in an appropriate timing during the grain formation of grains. Use of these various addition methods in combination is also preferred.

A method of adding a chalcogen compound during the preparation of the emulsion described in U.S. Pat. No. 3,772,031 is also useful depending on the case. Other than S, Se and Te, a cyanate, a thiocyanate, a selenocyanic acid, a carbonate, a phosphate or an acetate may also be present in the system.

The silver halide grain of the present invention may be subjected to at least one of sulfur sensitization, selenium sensitization, gold sensitization, palladium sensitization, noble metal sensitization and reduction sensitization at any step during the preparation of the silver halide emulsion. A combination of two or more sensitization methods is preferred. Various types of emulsions can be prepared by varying the step at which the chemical sensitization is performed. Examples thereof include a type where a chemical sensitization speck is embedded inside the grain, a type where a chemical sensitization speck is embedded in the shallow position from the grain surface, and a type where a chemical sensitization speck is formed on the surface. The position of the chemical sensitization speck can be selected according to the purpose. In general, at least one kind of chemical sensitization speck is preferably formed in the vicinity of the grain surface.

One of the chemical sensitization methods which can be preferably performed in the present invention is the sole use of chalcogenide sensitization method or noble metal sensitization method or a combination use thereof. The chemical sensitization may be performed using active gelatin as described in T. H. James, *The Theory of the Photographic Process,* 4th ed., pp. 67–76, Macmillan (1977), or may be performed using sulfur, selenium, tellurium, gold, platinum, palladium, iridium or a combination of two or more of these sensitizing dyes at a pAg of from 5 to 10, a pH of from 5 to 8 and a temperature of from 30 to 80° C. as descried in *Research Disclosure,* Vol. 120, 12008 (April 1974), *Research Disclosure,* Vol. 34, 13452 (June 1975), U.S. Pat. Nos. 2,642,361, 3,297,446, 3,772,031, 3,857,711, 3,901,714, 4,266,018 and 3,904,415, and British Patent 1,315,755. In the noble metal sensitization, a salt of noble metal such as gold, platinum, palladium and iridium may be used. Among these, gold sensitization, palladium sensitization and a combination use thereof are preferred. In the gold sensitization, a known compound such as chloroauric acid, potassium chloroaurate, potassium aurithiocyanate, gold sulfide and gold selenide may be used. The palladium compound means a divalent or tetravalent palladium salt. A preferred palladium compound is represented by $R_2PdX_6$ or $R_2PdX_4$, wherein R represents hydrogen atom, an alkali metal atom or an ammonium group, and X represents a halogen atom such as chlorine, bromine and iodine.

More specifically, $K_2PdCl_4$, $(NH_4)_2PdCl_6$, $Na_2PdCl_4$, $(NH_4)_2PdCl_4$, $Li_2PdCl_4$, $Na_2PdCl_6$ and $K_2PdBr_4$ are preferred. The gold compound or palladium compound is preferably used in combination with a thiocyanate or selenocyanate.

Examples of the sulfur sensitizer which can be used include hypo, thiourea compounds, rhodanine compounds and sulfur-containing compounds as described in U.S. Pat. Nos. 3,857,711, 4,266,018 and 4,054,457. The chemical sensitization may also be performed in the presence of a so-called chemical sensitization aid. Compounds known to inhibit fogging during the chemical sensitization and increase the sensitivity, such as azaindene, azapyridazine and azapyrimidine, are useful as the chemical sensitization aid. Examples of the chemical sensitization aid modifier are described in U.S. Pat. Nos. 2,131,038, 3,411,914 and 3,554,757, JP-A-58-126526 and Duffin, *Chemistry of Photographic Emulsion,* pp. 138–143.

The emulsion of the present invention is preferably subjected additionally to gold sensitization. The amount of the gold sensitizer is preferably from $1\times10^{-4}$ to $1\times10^{-7}$ mol, more preferably from $1\times10^{-5}$ to $5\times10^{-7}$ mol, per mol of silver halide. The amount of the palladium compound is preferably from $1\times10^{-3}$ to $5\times10^{-7}$ mol. The amount of the thiocyanic compound or selenocyanic compound is preferably from $5\times10^{-2}$ to $1\times10^{-6}$.

The amount of the sulfur sensitizer used for the silver halide grain of the present invention is preferably from $1\times10^{-4}$ to $1\times10^{-7}$ mol, more preferably from $1\times10^{-5}$ to $5\times10^{-7}$ mol, per mol of silver halide.

The sensitization method preferred for the emulsion of the present invention is selenium sensitization. The selenium sensitization uses a known labile selenium compound. More specifically, selenium compounds such as colloidal metallic selenium, selenoureas (e.g., N,N-dimethylselenourea, N,N-diethylselenourea), selenoketones and selenoamides may be used. In some cases, the selenium sensitization method is preferably used in combination with sulfur sensitization, noble metal sensitization or a combination thereof.

The silver halide emulsion of the present invention is preferably subjected to reduction sensitization during the grain formation, between after the grain formation and before or during the chemical sensitization, or after the chemical sensitization.

The reduction sensitization may be performed by any method selected from a method of adding a reduction sensitizer to a silver halide emulsion, a method called silver ripening where silver halide grains are grown or ripened in an atmosphere of a low pAg of from 1 to 7, and a method called high pH ripening where silver halide grains are grown or ripened in an atmosphere of a high pH of from 8 to 11. A combination of two or more methods may also be used.

The method of adding a reduction sensitizer is advantageous in that the level of reduction sensitization can be delicately controlled.

Known examples of the reduction sensitizer include stannous salts, ascorbic acid and derivatives thereof, amines, polyamines, hydrazine derivative, formamidine-sulfinic acid, silane compounds and borane compounds. The reduction sensitizer for use in the present invention may be selected from these known reduction sensitizers. Also, two or more of these compounds may be used in combination. Preferred compounds as the reduction sensitizer are stannous chloride, thiourea dioxide, dimethylamineborane, and ascorbic acid and derivatives thereof. The amount of the reduction sensitizer added varies depending on the production conditions of the emulsion, therefore, needs to be selected but it is suitably from $10^{-7}$ to $10^{-3}$ mol per mol of silver halide.

The reduction sensitizer is added during the growth of grains after dissolving it in water or an organic solvent such as an alcohol, a glycol, a ketone, an ester or an amide. The reduction sensitizer may be previously added to the reaction vessel but a method of adding it at an appropriate time during the growth of grains is preferred. The reduction sensitizer may also be previously added to an aqueous solution of a water-soluble silver salt or water-soluble alkali halide and using the aqueous solution, silver halide grains may be precipitated. Furthermore, a method of adding in parts or continuously adding over a long time a solution of the reduction sensitization along the growth of grains is also preferred.

During the preparation of the emulsion of the present invention, an oxidizing agent for silver is preferably used. The term "oxidizing agent for silver" as used herein means a compound having a function of acting on metal silver to convert it into silver ion. In particular, a compound capable of converting very small silver grains by-produced during the formation and chemical sensitization of silver halide grains into silver ion is useful. The silver ion produced here may form a silver salt difficultly soluble in water, such as silver halide, silver sulfide and silver selenide, or may form a silver salt easily soluble in water, such as silver nitrate. The oxidizing agent for silver may be an inorganic or organic compound. Examples of the inorganic oxidizing agent include ozone, hydrogen peroxide, adducts thereof (e.g., $NaBO_2.H_2O_2.3H_2O$, $2NaCO_3.3H_2O_2$, $Na_4P_2O_7.2H_2O_2$, $2Na_2SO_4.H_2O_2.2H_2O$), peroxy acid salts (e.g., $K_2S_2O_8$, $K_2C_2O_6$, $K_2P_2O_8$), peroxy complex compounds (e.g, $K_2[Ti(O_2)C_2O_4].3H_2O$, $4K_2SO_4.Ti(O_2)OH.SO_4.2H_2O$, $Na_3[VO(O_2)(C_2H_4)_2].6H_2O$) oxygen acid salts such as permanganate (e.g., $KMnO_4$) and chromate (e.g., $K_2Cr_2O_7$), halogen elements such as iodine and bromine, perhalogenates (e.g., potassium periodate), salts of metal having a high valency (e.g., potassium hexacyanoferrate), and thiosulfonates.

Examples of the organic oxidizing agent include quinones such as p-quinone, organic peroxides such as peracetic acid and perbenzoic acid, and compounds which release active halogen (for example, N-bromosuccimide, chloramine T, Chloramine B).

Among these oxidizing agents, preferred in the present invention are inorganic oxidizing agents such as ozone, hydrogen peroxide and an adduct thereof, halogen element and thiosulfonate, and organic oxidizing agents such as quinone. In a preferred embodiment, the above-described reduction sensitization is used in combination with the oxidizing agent for silver. The method may be selected from a method of using the oxidizing agent and then performing the reduction sensitization, a method reversed thereto and a method of allowing both to be present at the same time. The method may be selected and used at the grain formation or the chemical sensitization.

The photographic emulsion of the present invention may contain various compounds other than the aforementioned compounds adsorptive to silver halide for the purpose of preventing fogging during the preparation, storage or photographic processing of the light-sensitive material or for stabilizing the photographic properties. The antifoggant and the stabilizer may be added at various times according to the purpose, such as before, during or after the grain formation, during the water washing, at the dispersion after the water washing, before, during or after the chemical sensitization, and before the coating. These antifoggants and stabilizers each is added during the preparation of the emulsion not only to bring out its inherent antifogging or stabilizing effect but also for various purposes such as control of the crystal habit of grain, reduction of the grain size, decrease in the solubility of the grain, control of the chemical sensitization and control of the dye arrangement.

The light-sensitive material produced using the silver halide emulsion obtained according to the present invention is sufficient if at least one light-sensitive layer of blue-sensitive layer, green-sensitive layer or red-sensitive layer is provided on a support. The number and order of the silver halide emulsion layers and light-insensitive layers are not particularly limited. A typical example thereof is a silver halide photographic light-sensitive material comprising a support having thereon at least one color sensitive layer consisting of a plurality of silver halide emulsion layers having substantially the same spectral sensitivity but different in the light sensitivity. This light-sensitive layer is a unit light-sensitive layer having spectral sensitivity to any of blue light, green light and red light. In the case of a multi-layer silver halide color photographic light-sensitive material, the unit light-sensitive layers are generally arranged in the order of a red-sensitive layer, a green-sensitive layer and a blue-sensitive layer from the support side. However, depending upon the purpose, this arrangement order may be reversed or a layer having different light sensitivity may be interposed between layers having the same spectral sensitivity.

A light-insensitive layer such as interlayer between respective layers may also be provided between the above-described silver halide light-sensitive layers or as an uppermost or lowermost layer.

The interlayer may contain a coupler and a DIR compound described in JP-A-61-43748, JP-A-59-113438, JP-A-59-113440, JP-A-61-20037 and JP-A-61-20038, and may contain a color mixing inhibitor which is commonly used.

The plurality of silver halide emulsion layers constituting each unit light-sensitive layer preferably employ a two-layer structure consisting of a high-sensitivity emulsion layer and a low-sensitivity emulsion layer described in German Patent 1,121,470 and British Patent 923,045. Usually, the layers are preferably arranged such that the light sensitivity sequentially decreases toward the support. A light-insensitive layer may be provided between silver halide emulsion layers. Furthermore, it may be also possible to provide a low-sensitivity emulsion layer farther from the support and provide a high-sensitivity emulsion layer closer to the support as described in JP-A-57-112751, JP-A-62-200350, JP-A-62-206541 and JP-A-62-206543.

Specific examples of the layer arrangement from the side remotest from the support (S) include an order of low-sensitivity blue-sensitive layer (BL)/high-sensitivity blue-sensitive layer (BH)/high-sensitivity green-sensitive layer (GH)/low-sensitivity green-sensitive layer (GL)/high-sensitivity red-sensitive layer (RH)/low-sensitivity red-sensitive layer (RL) (i.e., BL/BH/GH/GL/RH/RL(S)) an order of BH/BL/GL/GH/RH/RL(S) and an order of BH/BL/GH/GL/RL/RH(S).

As described in JP-B-55-34932, the emulsion layers may be arranged in the order of blue-sensitive layer/GH/RH/GL/RL from the side remotest from the support. Also, as described in JP-A-56-25738 and JP-A-62-63936, the emulsion layers may be arranged in the order of blue-sensitive layer/GL/RL/GH/RH from the side remotest from the support.

In addition, an arrangement consisting of three layers different in the light sensitivity may be used as described in JP-B-49-15495, where a silver halide emulsion layer having highest light sensitivity is provided as an upper layer, a silver halide emulsion layer having light sensitivity lower than that of the upper layer is provided as a medium layer and a silver halide emulsion layer having light sensitivity lower than that of the medium layer is provided as a lower layer so as to sequentially decrease the light sensitivity toward the support. Even in this structure consisting of three layers different in the light sensitivity, the layers having the same spectral sensitivity may be provided in the order of medium-sensitivity emulsion layer/high-sensitivity emulsion layer/low-sensitivity emulsion layer from the side remote from the support as described in JP-A-59-202464.

In addition, the layers may be provided in the order of high-sensitivity emulsion layer/low-sensitivity emulsion layer/medium-sensitivity emulsion layer or low-sensitivity emulsion layer/medium-sensitivity emulsion layer/high-sensitivity emulsion layer.

The layer arrangement may be changed as described above also in the case of structures consisting of four or more layers.

As described above, various layer structures and arrangements may be selected according to the purpose of respective light-sensitive materials.

In the light-sensitive material of the present invention, various additives described above are used but various additives other than those may also be used according to the purpose.

These additives are more specifically described in *Research Disclosure,* Item 17643 (December, 1978), ibid., Item 18716 (November, 1979) and ibid., Item 308118 (December, 1989). The pertinent portions are shown together in the table below.

| Kinds of Additives | RD17643 | RD18716 | RD308119 |
|---|---|---|---|
| 1. Chemical sensitizer | p. 23 | p. 648, right col. | p. 996 |
| 2. Sensitivity increasing agent | | p. 648, right col. | |
| 3. Spectral sensitizer, supersensitizer | pp. 23–24 | p. 648, right col. to p. 649, right col. | p. 996, right to p. 998, right |
| 4. Brightening agent | p. 24 | p. 647, right col. | p. 998, right |
| 5. Antifoggant, stabilizer | pp. 24–25 | p. 649, right col. | p. 998, right to p. 1000, right |
| 6. Light absorbent, filter dye, UV absorbent | pp. 25–26 | p. 649, right col. to p. 650, left col. | p. 1003, left to right |
| 7. Stain inhibitor | p. 25, right col. | p. 650, left to right cols. | p. 1002, right |
| 8. Dye Image Stabilizer | p. 25 | | p. 1002, right |
| 9. Hardening agent | p. 26 | p. 651, left col. | p. 1004, right to p. 1005, left |
| 10. Binder | p. 26 | p. 651, left col. | p. 1003, right to p. 1004, right |
| 11. Plasticizer, lubricant | p. 27 | p. 650, right col. | p. 1006, left to p. 1006, right |
| 12. Coating aid, surfactant | pp. 26–27 | p. 650, right col. | p. 1005, left to p. 1006, left |
| 13. Antistatic agent | p. 27 | p. 650, right col. | p. 1006, right to p. 1007, left |
| 14. Matting agent | | | p. 1008, left to p. 1009, left |

Furthermore, in order to prevent the deterioration of the photographic capability due to formaldehyde gas, a compound capable of reacting with and thereby fixing the formaldehyde described in U.S. Pat. Nos. 4,411,897 and 4,435,503 is preferably added to the light-sensitive material.

In the present invention, various color couplers can be used. Specific examples thereof are described in the patents cited in supra *Research Disclosure* No. 17643, VII-C to G, and ibid., No. 307105, VII-C to G.

Preferred examples of the yellow coupler include those described in U.S. Pat. Nos. 3,933,501, 4,022,620, 4,326,024, 4,401,752 and 4,248,961, JP-B-58-10739, British Patents 1,425,020 and 1,476,760, and U.S. Pat. Nos. 3,973,968, 4,314,023 and 4,511,649, and EP-A-249473.

As the magenta coupler, 5-pyrazolone compounds and pyrazoloazole compounds are preferred. In particular, preferred are those described in U.S. Pat. Nos. 4,310,619 and 4,351,897, European Patent 73,636, U.S. Pat. Nos. 3,061,432 and 3,725,067, *Research Disclosure*, No. 24220 (June, 1984), JP-A-60-33552, *Research Disclosure*, No. 24230 (June 1984), JP-A-60-43659, JP-A-61-72238, JP-A-60-35730, JP-A-55-118034, JP-A-60-185951, U.S. Pat. Nos. 4,500,630, 4,540,654 and 4,556,630, and WO88/04795.

The cyan coupler includes naphthol couplers and phenol couplers. Preferred are those described in U.S. Pat. Nos. 4,052,212, 4,146,396, 4,228,233, 4,296,200, 2,369,929, 2,801,171, 2,772,162, 2,895,826, 3,772,002, 3,758,308, 4,334,011 and 4,327,173, German Patent (OLS) No. 3,329,729, EP-A-121365, EP-A-249453, U.S. Pat. Nos. 3,446,622, 4,333,999, 4,775,616, 4,451,559, 4,427,767, 4,690,889, 4,254,212 and 4,296,199, and JP-A-61-42658.

Typical examples of the polymerized dye-forming coupler are described in U.S. Pat. Nos. 3,451,820, 4,080,211, 4,367,282, 4,409,320 and 4,576,910, British Patent 2,102,173, and EP-A-341188.

As the coupler which provides a developed dye having an appropriate diffusibility, those described in U.S. Pat. Nos. 4,366,237, British Patent 2,125,570, European Patent 96,570, and German Patent Application (OLS) No. 3,234,533 are preferred.

As the colored coupler for correcting unnecessary absorption of the developed dye, those described in *Research Disclosure,* No. 17643, Item VII-G, ibid., No. 307105, Item VII-G, U.S. Pat. No. 4,163,670, JP-B-57-39413, U.S. Pat. Nos. 4,004,929 and 4,138,258, and British Patent 1,146,368 are preferred. Also, couplers of correcting unnecessary absorption of the developed dye by a fluorescent dye released upon coupling described in U.S. Pat. No. 4,774,181 and couplers containing as a splitting-off group a dye precursor group capable of reacting with a developing agent to form a dye described in U.S. Pat. No. 4,777,120 may be preferably used.

Compounds which release a photographically useful residue upon coupling can also be preferably used in the present invention. With respect to the DIR coupler which releases a development inhibitor, preferred examples thereof are described in the patents cited in supra RD17643, Item VII-F and ibid., No. 307105, Item VII-F, JP-A-57-151944, JP-A-57-154234, JP-A-60-184248, JP-A-63-37346, JP-A-63-37350, and U.S. Pat. Nos. 4,248,962 and 4,782,012.

With respect to the coupler which imagewise releases a nucleating agent or a developing accelerator at the time of development, those described in British Patents 2,097,140 and 2,131,188, JP-A-59-157638 and JP-A-59-170840 are preferred. Also, compounds which release a fogging agent, a development accelerator, a silver halide solvent or the like by the oxidation-reduction reaction with an oxidation product of a developing agent described in JP-A-60-107029, JP-A-60-252340, JP-A-1-44940 and JP-A-1-45687 are preferred.

Other than these, examples of the compounds which can be used in the light-sensitive material of the present invention include competing couplers described in U.S. Pat. No. 4,130,427, polyequivalent couplers described in U.S. Pat. Nos. 4,283,472, 4,338,393 and 4,310,618, DIR redox compound-releasing couplers, DIR coupler-releasing couplers, DIR coupler-releasing redox compounds and DIR redox-releasing redox compounds described in JP-A-60-185950 and JP-A-62-24252, couplers which release a dye capable of retrieving the color after the release described in EP-A-173302 and EP-A-313308, bleach accelerator-releasing couplers described in RD. Nos. 11449 and 24241, and JP-A-61-201247, ligand-releasing couplers described in U.S. Pat. No. 4,555,477, leuco dye-releasing couplers described in JP-A-63-75747, and fluorescent dye-releasing couplers described in U.S. Pat. No. 4,774,181.

The couplers for use in the present invention can be incorporated into the light-sensitive material by various known dispersion methods.

Examples of the high boiling point solvent which is used in the oil-in-water dispersion method are described, for example, in U.S. Pat. No. 2,322,027.

Specific examples of the high boiling point organic solvent having a boiling point of 175° C. or more at atmospheric pressure, which is used in the oil-in-water dispersion method, include phthalic acid esters (e.g., dibutyl phthalate, dicyclohexyl phthalate, di-2-ethylhexyl phthalate, decyl phthalate, bis(2,4-di-tert-amylphenyl)phthalate, bis(2,4-di-tert-amylphenyl)isophthalate, bis(1,1-diethylpropyl) phthalate); phosphoric acid or phosphonic acid esters (e.g., triphenyl phosphate, tricresyl phosphate, 2-ethylhexyldiphenyl phosphate, tricyclohexyl phosphate, tri-2-ethylhexyl phosphate, tridodecyl phosphate, tributoxyethyl phosphate, trichloropropyl phosphate, di-2-ethylhexylphenyl phosphonate); benzoic acid esters (e.g., 2-ethylhexyl benzoate, dodecyl benzoate, 2-ethylhexyl-p-hydroxy benzoate); amides (e.g., N,N-diethyldodecanamide, N,N-diethyllaurylamide, N-tetradecylpyrrolidone); alcohols or phenols (e.g., isostearyl alcohol, 2,4-di-tert-amylphenol); aliphatic carboxylic acid esters (e.g., bis(2-ethylhexyl) sebacate, dioctyl azerate, glycerol tributylate, isostearyl lactate, trioctyl citrate); aniline derivatives (e.g., N,N-dibutyl-2-butoxy-5-tert-octylaniline); and hydrocarbons (e.g., paraffin, dodecylbenzene, diisopropylnaphthalene). As an auxiliary solvent, for example, an organic solvent having a boiling point of about 30° C. or more, preferably from 50 to about 160° C., may be used. Typical examples thereof include ethyl acetate, butyl acetate, ethyl propionate, methyl ethyl ketone, cyclohexanone, 2-ethoxyethyl acetate and dimethylformamide.

The process and effects of the latex dispersion method and specific examples of the latex for impregnation are described, for example, in U.S. Pat. No. 4,199,363, German Patent Application (OLS) Nos. 2,541,274 and 2,541,230.

The color light-sensitive material of the present invention may contain an antiseptic or fungicide of various types and examples thereof include phenethyl alcohol and those described in JP-A-63-257747, JP-A-62-272248 and JP-A-1-80941, such as 1,2-benzoisothiazolin-3-one, n-butyl-p-hydroxybenzoate, phenol, 4-chloro-3,5-dimethylphenol, 2-phenoxyethanol and 2-(4-thiazolyl)benzimidazole.

The present invention can be applied to various color light-sensitive materials. Representative examples thereof include color negative film for common use or motion picture, color reversal film for slide or television, color paper, color positive film, and color reversal paper. The present invention can also be particularly preferably applied to film for color dupe.

Examples of suitable supports which can be used in the present invention are described in supra RD No. 17643, page 28, ibid., No. 18716, from page 647, right column to page 648, left column, and ibid., No. 307105, page 879.

In the light-sensitive material of the present invention, the total thickness of all hydrophilic colloidal layers on the side having emulsion layers is preferably 28 μm or less, more preferably 23 μm or less, still more preferably 18 μm or less, particularly preferably 16 μpm or less. The film swelling rate T1/2 is preferably 30 seconds or less, more preferably 20 seconds or less. The "film thickness" as used herein means a film thickness determined under the humidity control (2 days) at a temperature of 25° C. and a relative humidity of 55%. The film swelling rate T1/2 can be determined by a method known in this technical field, for example, by means of a swellometer described in A. Green et al., *Photogr. Sci. and Eng.,* Vol. 19, No. 2, pp. 124–129. The film swelling rate T1/2 is defined as a time spent until half the saturated film thickness is reached, where the saturated film thickness is 90% of the maximum swollen film thickness reached on the processing with a color developer at 30° C. for 3 minutes and 15 seconds.

The film swelling rate T1/2 can be adjusted by adding a film hardener to gelatin used as a binder or changing the aging conditions after the coating.

In the light-sensitive material of the present invention, a hydrophilic colloidal layer (hereinafter referred to as a "back layer") having a total dry thickness of from 2 to 20 μm is preferably provided on the side opposite the side having emulsion layers. This back layer preferably contains, for example, the above-described light absorbent, filter dye, ultraviolet absorbent, antistatic agent, hardening agent, binder, plasticizer, lubricant, coating aid and surface active agent. The back layer preferably has a percentage swelling of from 150 to 500%.

The color photographic light-sensitive material according to the present invention can be developed by an ordinary method described in supra RD, No. 17643, pp. 28–29, ibid., No. 18716, page 651, from left to right columns, and ibid., No. 307105, pp. 880–881.

The color developer for use in the development processing of the light-sensitive material of the present invention is preferably an alkaline aqueous solution mainly comprising an aromatic primary amine color developing agent. As the color developing agent, an aminophenol-based compound is useful but a p-phenylenediamine-based compound is preferred and representative examples thereof include 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-β-methoxyethylaniline, and sulfates, hydrochlorides and p-toluenesulfonates thereof. Among these, particularly preferred are sulfates of 3-methyl-4-amino-N-ethyl-N-β-hydroxyethylaniline. If desired, these compounds can be used in combination of two or more thereof.

The color developer in general contains, for example, a pH buffering agent such as carbonate, borate or phosphate of an alkali metal, and a development inhibitor or antifoggant such as chloride, bromide, iodide, benzimidazoles, benzothiazoles and mercapto compound. The color developer may also contain, if desired, a preservative of various types, such as hydroxylamine, diethylhydroxylamine, sulfite, hydrazines (e.g., N,N-biscarboxymethylhydrazine), phenylsemicarbazides, triethanolamine and catecholsulfonic acids; an organic solvent such as ethylene glycol and diethylene glycol; a development accelerator such as benzyl alcohol, polyethylene glycol, a quaternary ammonium salt and amines; a dye-forming coupler; a competing coupler; an auxiliary developing agent such as 1-phenyl-3-pyrazolidone; a tackifying agent; and a chelating agent of various types, including aminopolycarboxylic acid, aminopolyphosphonic acid, alkylphosphonic acid and phosphonocarboxylic acid. Representative examples of the chelating agent include ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N,N-tetramethylenephosphonic acid, ethylenediamine-di(o-hydroxyphenylacetic acid) and salts thereof.

In the case of performing reversal processing, the color development is usually performed after the black-and-white development. The black-and-white developer can use, for example, known black-and-white developing agents individually or in combination, such as dihydoxybenzenes (e.g., hydroquinone), 3-pyrazolidones (e.g., 1-phenyl-3-pyrazolidone) and aminophenols (e.g., N-methyl-p-aminophenols). The color developer and the black-and-white developer each usually has a pH of from 9 to 12. Although the replenishing amount of these developers varies depending on the color photographic light-sensitive material processed, it is generally 3 l or less per $m^2$ of the photographic material and when the bromide ion concentration in the replenisher is decreased, the replenishing amount can be reduced even to 500 ml or less. When the replenishing amount is reduced, the contact area of the processing solution with air is preferably reduced to prevent evaporation or air oxidation of the solution.

The contact area of the photographic processing solution with air in a processing tank can be evaluated by an opening ratio defined below.

Opening ratio=[contact area of the processing solution with air ($cm^2$)]÷[volume of the processing solution ($cm^3$)]

The opening ratio defined as above is preferably 0.1 or less, more preferably from 0.001 to 0.05. The opening ratio can be reduced, for example, by a method of providing a shielding material such as floating lid on the surface of the photographic processing solution in the processing tank, a method of using a movable lid described in JP-A-1-82033 or a slit development method described in JP-A-63-216050. The opening ratio is preferably reduced not only in two steps of color development and black-and-white development but also in all subsequent steps such as bleaching, bleach-fixing, fixing, water washing and stabilization. Furthermore, the replenishing amount can also be reduced by using a means for suppressing the accumulation of bromide ions in the developer.

The color development time is usually set to from 2 to 5 minutes, however, further reduction in the processing time can be achieved by setting high temperature and high pH conditions and using a color developing agent in a high concentration.

After color development, the photographic emulsion layer is usually subjected to bleaching. The bleaching may be performed simultaneously with fixing (bleach-fixing) or these may be performed separately. For the purpose of increasing the processing speed, a processing method of performing bleaching and then bleach-fixing may also be used. Furthermore, a method of performing the processing in a bleach-fixing bath consisting of two continued tanks, a method of performing fixing before the bleach-fixing or a method of performing bleaching after the bleach-fixing may be freely selected according to the purpose. Examples of the bleaching agent include compounds of a polyvalent metal such as iron(III), peracids (particularly, sodium persulfate is suitable for cinematic color negative film), quinones and nitro compounds. Representative examples of the bleaching agent include organic complex salts of iron(III), for example, complex salts with an aminopolycarboxylic acid such as ethylenediaminetetraacetic acid, diethylenetriaminepentaacetic acid, cyclohexanediaminetetraacetic acid, methyliminodiacetic acid, 1,3-diaminopropanetetraacetic acid or glycol ether diaminetetraacetic acid, and complex salts with citric acid, tartaric acid or malic acid. Among these, aminopolycarboxylic acid ferrate complex salts including ethylenediaminetetraacetato ferrate complex salt and 1,3-diaminopropanetetraacetato ferrate complex salt are preferred in view of rapid processing and prevention of environmental pollution. The aminopolycarboxylic acid ferrate complex salts are particularly useful in both the bleaching solution and the bleach-fixing solution. The bleaching solution or bleach-fixing solution using the aminopolycarboxylic acid ferrate complex salt usually has a pH of from 4.0 to 8 but the processing may be performed at a lower pH for increasing the processing speed.

A bleaching accelerator may be used, if desired, in the bleaching solution, the bleach-fixing solution or a prebath thereof. Specific examples of useful bleaching accelerators include compounds described in the following specifications: for example, compounds having a mercapto group or a disulfide group described in U.S. Pat. No. 3,893,858, German Patent Nos. 1,290,812 and 2,059,988, JP-A-53-32736, JP-A-53-57831, JP-A-53-37418, JP-A-53-72623, JP-A-53-95630, JP-A-53-95631, JP-A-53-104232, JP-A-53-124424, JP-A-53-141623, JP-A-53-18426 and *Research Disclosure,* No. 17129 (July, 1978); thiazolidine derivatives described in JP-A-51-140129; thiourea derivatives described in JP-B-45-8506, JP-A-52-20832, JP-A-53-32735 and U.S. Pat. No. 3,706,561; iodide salts described in German Patent 1,127,715 and JP-A-58-16235; polyoxyethylene compounds described in German Patent Nos. 966,410 and 2,748,430; polyamine compounds described in JP-B-45-8836; compounds described in JP-A-49-40943, JP-A-49-59644, JP-A-53-94927, JP-A-54-35727, JP-A-55-26506 and JP-A-58-163940; and bromide ion. Among these, compounds having a mercapto group or a disulfide group are preferred in view of their large acceleration effect and in particular, the compounds described in U.S. Pat. No. 3,893,858, German Patent No. 1,290,812 and JP-A-53-95630 are preferred. Also, the compounds described in U.S. Pat. No. 4,552,884 are preferred. The bleaching accelerator may also be incorporated into the light-sensitive material. The bleaching accelerator is particularly effective in bleach-fixing a color light-sensitive material for photographing.

In addition to the above-described compounds, the bleaching solution or bleach-fixing solution preferably contains an organic acid in order to prevent bleaching stains. A particularly preferred organic acid is a compound having an acid dissociation constant (pKa) of from 2 to 5 and specific examples thereof include acetic acid, propionic acid and hydroxyacetic acid.

Examples of the fixing agent for use in the fixing solution or bleach-fixing solution include thiosulfates, thiocyanates, thioether-base compounds, thioureas and a large quantity of iodides. Among these, a thiosulfate is commonly used and in particular, ammonium thiosulfate can be most widely used. A combination use of a thiosulfate with a thiocyanate, a thioether-base compound or a thiourea is also preferred. As the preservative of the fixing solution or bleach-fixing solution, sulfites, bisulfites, carbonyl bisulfite adducts and sulfinic acid compounds described in EP-A-294769 are preferred. Furthermore, the fixing solution or bleach-fixing solution preferably contains an aminopolycarboxylic acid or organic phosphonic acid of various types for the purpose of stabilizing the solution.

In the present invention, the fixing solution or bleach-fixing solution preferably contains a compound having a pKa of from 6.0 to 9.0 so as to adjust the pH, more preferably an imidazole such as imidazole, 1-methylimidazole, 1-ethylimidazole and 2-methylimidazole, in an amount of from 0.1 to 10 mol/l.

The total desilvering time is preferably as short as possible within the range of not causing desilvering failure. The time is preferably from 1 to 3 minutes, more preferably from 1 to 2 minutes. The processing temperature is from 25 to 50° C., preferably from 35 to 45° C. In this preferred temperature range, the desilvering rate is improved and staining after the processing can be effectively prevented.

In the desilverization, the stirring is preferably intensified as much as possible. Specific examples of the method for intensifying the stirring include a method of colliding a jet stream of a processing solution against the emulsion surface of the light-sensitive material described in JP-A-62-183460, a method of increasing the stirring effect using a rotary means described in JP-A-62-183461, a method of increasing the stirring effect by moving the light-sensitive material while contacting the emulsion surface with a wiper blade disposed in the solution to cause turbulence on the emulsion surface, and a method of increasing the circulation flow rate of the processing solution as a whole. Such means for intensifying the stirring is effective in all of the bleaching solution, the bleach-fixing solution and the fixing solution. The intensification of stirring is considered to increase the supply rate of the bleaching agent or fixing agent into the emulsion layer and, as a result, elevate the desilverization rate. The above-described means for intensifying the stirring is more effective when a bleaching accelerator is used and in this case, the acceleration effect can be remarkably increased or the fixing inhibitory action can be eliminated by the bleaching accelerator.

The automatic developing machine used for developing the light-sensitive material of the present invention preferably has means for transporting a light-sensitive material described in JP-A-60-191257, JP-A-60-191258 and JP-A-60-191259. As described in JP-A-60-191257 above, such transportation means can extremely reduce the amount of a processing solution carried over from a previous bath to a post bath and provides a great effect of preventing the processing solution from deterioration in the capability. This effect is particularly effective for reducing the processing time or decreasing the replenishing amount of a processing solution in each step.

The silver halide color photographic light-sensitive material of the present invention is generally subjected to water washing and/or stabilization after the desilvering. The amount of washing water in the water washing step can be set over a wide range according to the properties (for example, attributable to a material used such as coupler) or use of the light-sensitive material and additionally according to the temperature of washing water, the number of water washing tanks (stage number), the replenishing system such as countercurrent or co-current system, or other various conditions. Among these, the relationship between the number of water washing tanks and the amount of water in a multi-stage countercurrent system can be determined according to the method described in *Journal of the Society of Motion Picture and Television Engineers,* Vol. 64, pp. 248–253 (May, 1955).

According to the multi-stage countercurrent system described in the above-described publication, the amount of washing water may be greatly reduced but due to the increase in the residence time of water in the tank, a problem arises such that bacteria proliferate and the floats generated adhere to the light-sensitive material. In the processing of the color light-sensitive material of the present invention, a method of reducing calcium ion and magnesium ion described in JP-A-62-288838 can be very effectively used for solving such a problem. Furthermore, isothiazolone compounds and thiabendazoles described in JP-A-57-8542, chlorine-base bactericides such as chlorinated sodium isocyanurate, and bactericides such as benzotriazole described in Hiroshi Horiguchi, *Bokin, Bobai-Zai no Kagaku* (*Chemistry of Bactericides and Fungicides*), Sankyo Shuppan (1986), *Biseibutsu no Mekkin, Sakkin, Bobai-Gijutsu* (*Sterilizing, Disinfecting and Fungicidal Technology for Microorganisms*), compiled by Eisei Gijutsu Kai, issued by Kogyo Gijutsu Kai (1982), and *Bokin-Bobai Zai Jiten* (*Handbook of Bactericides and Fungicides*), compiled by Nippon Bokin Bobai Gakkai (1986), can be also used.

The washing water in the processing of the light-sensitive material of the present invention has a pH of from 4 to 9, preferably from 5 to 8. The washing water temperature and the water washing time may be variously set, for example, according to the properties and use of the light-sensitive material but the temperature and the processing time are generally from 15 to 45° C. and from 20 seconds to 10 minutes, preferably from 25 to 40° C. and from 30 seconds to 5 minutes, respectively. The light-sensitive material of the present invention can also be processed directly with a stabilizing solution in place of the above-described water washing. In such a stabilization processing, any known method described in JP-A-57-8543, JP-A-58-14834 and JP-A-60-220345 can be used.

In some cases, the stabilization processing may be further performed following the above-described water washing. An example thereof is a stabilization bath containing a dye stabilizer and a surfactant, which is used as a final bath in the processing of a color light-sensitive material for photographing. Examples of the dye stabilizer include aldehydes such as formalin and glutaraldehyde, N-methylol compounds, and hexamethylenetetramine- or aldehyde sulfite-addition products. This stabilization bath may also contain various chelating agents and fungicides.

The overflow solution accompanying the replenishing of the washing water and/or stabilizing solution can be re-used in other processing steps such as desilvering.

In the processing, for example, using an automatic developing machine, if respective processing solutions are concentrated due to evaporation, water is preferably added to correct the concentration.

In the silver halide color photographic light-sensitive material of the present invention, a color developing agent may be incorporated so as to simplify the processing and increase the processing rate. In order to incorporate the color developing agent, various precursors of the color developing agent are preferably used. Examples thereof include indoaniline compounds described in U.S. Pat. No. 3,342,597, Schiff base-type compounds described in U.S. Pat. No. 3,342,599, *Research Disclosure,* No. 14850 and ibid., No. 15159, aldol compounds described in ibid., No. 13924, metal salt complexes described in U.S. Pat. No. 3,719,492 and urethane-based compounds described in JP-A-53-135628.

In the silver halide color light-sensitive material of the present invention, if desired, 1-phenyl-3-pyrazolidone of various types may be incorporated for the purpose of accelerating the color development. Typical examples of the compound are described in JP-A-56-64339, JP-A-57-144547 and JP-A-58-115438.

In the present invention, each processing solution is used at a temperature of from 10 to 50° C. The standard temperature is usually from 33 to 38° C. but higher temperatures may be used to accelerate the processing and thereby shorten the processing time, or on the contrary, lower temperatures may be used to achieve improved image quality or improved stability of the processing solution.

The silver halide light-sensitive material of the present invention can also be applied to heat developable light-sensitive materials described in U.S. Pat. No. 4,500,626, JP-A-60-133449, JP-A-59-218443, JP-A-61-238056 and EP-A-210660.

Furthermore, the silver halide color photographic light-sensitive material of the present invention can be effectively applied to a film unit with a lens described in JP-B-2-32615 and JP-B-U-3-39784 (the term "JP-B-U" as used herein means an "examined Japanese utility model publication) and if the case is so, the effect is more readily brought out.

Also, the present invention can be suitably applied to a diffusion transfer light-sensitive material.

The present invention is described in greater detail below by referring to the Examples, however, the present invention should not be construed as being limited thereto.

EXAMPLE 1

(Preparation of Seed Emulsion a)

1,164 ml of an aqueous solution containing 0.017 g of KBr and 0.4 g of oxidized gelatin having an average molecular weight of 20,000 was stirred while keeping it at 35° C. Thereto, an aqueous $AgNO_3$ (1.6 g) solution, an aqueous KBr solution and an aqueous solution of oxidized gelatin (2.1 g) having an average molecular weight of 20,000 were added by a triple jet method over 48 seconds. At this time, the silver potential was kept at 13 mV based on the saturated calomel electrode. Then, an aqueous KBr solution was added to make the silver potential to −66 mV and the temperature was elevated to 60° C. After adding thereto 21 g of succinated gelatin having an average molecular weight of 100,000, an aqueous NaCl (5.1 g) solution was added. Furthermore, an aqueous $AgNO_3$ (206.3 g) and an aqueous KBr solution were added by a double jet method while accelerating the flow rate over 61 minutes. At this time, the silver voltage was kept at −44 mV based on the saturated calomel electrode. After the completion of desalting, succinated gelatin having an average molecular weight of 100,000 was added and the pH and the pAg were adjusted to 5.8 and 8.8, respectively, to prepare a seed emulsion. This seed emulsion contained 1 mol of Ag and 80 g of gelatin, per 1 kg of the emulsion, and the emulsion grain was a tabular grain having an average equivalent-circle diameter of 1.46 μm, a variation coefficient of the equivalent-circle diameter of 28%, an average thickness of 0.046 μm and an average aspect ratio of 32.

(Formation of Core)

1,200 ml of an aqueous solution containing 134 g of the seed Emulsion a prepared above, 1.9 g of KBr and 22 g of succinated gelatin having an average molecular weight of 100,000 was stirred while keeping it at 75° C. An aqueous $AgNO_3$ (43.9 g) solution, an aqueous KBr solution and an aqueous gelatin solution having a molecular weight of 20,000 were mixed in a separate chamber having a magnetic coupling induction-type stirrer immediately before the addition and then added over 25 minutes. At this time, the silver potential was kept at −40 mV based on the saturated calomel electrode.

(Formation of First Shell)

After the formation of the core grain, an aqueous $AgNO_3$ (43.9 g) solution, an aqueous KBr solution and an aqueous gelatin solution having a molecular weight of 20,000 were mixed in the same separate chamber as above immediately before the addition and added over 20 minutes. At this time, the silver potential was kept at −40 mV based on the saturated calomel electrode.

(Formation of Second Shell)

After the formation of the first shell, an aqueous $AgNO_3$ (42.6 g) solution, an aqueous KBr solution and an aqueous gelatin solution having a molecular weight of 20,000 were mixed in the same separate chamber as above immediately before the addition and added over 17 minutes. At this time, the silver potential was kept at −20 mV based on the saturated calomel electrode. Thereafter, the temperature was lowered to 55° C.

(Formation of Third Shell)

After the formation of the second shell, the silver potential was adjusted to −55 mV and then, an aqueous $AgNO_3$ (7.1 g) solution, an aqueous KI (6.9 g) solution and an aqueous gelatin solution having a molecular weight of 20,000 were mixed in the same separate chamber as above immediately before the addition and added over 5 minutes.

(Formation of Fourth Shell)

After the formation of the third shell, an aqueous $AgNO_3$ (66.4 g) solution and an aqueous KBr solution were added by a double jet method at a constant flow rate over 30 minutes. On the way of addition, potassium iridium hexachloride and yellow prussiate of potash were added. At this time, the silver potential was kept at 30 mV based on the saturated calomel electrode. Water washing was performed in an ordinary manner, gelatin was added and the pH and the pAg were adjusted at 40° C. to 5.8 and 8.8, respectively. The emulsion obtained was designated as Emulsion b. Emulsion b was a tabular grain having an average equivalent-circle diameter of 3.3 μm, a variation coefficient of the equivalent-circle diameter of 21%, an average thickness of 0.090 μm and an average aspect ratio of 37. Furthermore, 70% or more of the entire projected area was occupied by tabular grains having an equivalent-circle diameter of 3.3 μm or more and a thickness of 0.090 μm or less. Assuming that the dye occupied area is 80 $Å^2$, the one layer saturation coverage was $1.45\times10^{-3}$ mol/mol-Ag.

The temperature of Emulsion b was elevated to 56° C., the first dye shown in Table 1 was added thereto, then C-1, potassium thiocyanate, chloroauric acid, sodium thiosulfate and N,N-dimethylselenourea were added, and chemical sensitization was optimally performed. The second dye was further added and the mixture was stirred for 60 minutes. This chemical sensitization method was designated as Dye Adding Method A. In the dye addition, a method where a sensitizing dye is adjusted to a temperature lower than the room temperature and then an emulsion is added was designated as Dye Adding Method B.

The sensitizing dye was used as a solid fine dispersion prepared according to the method described in JP-A-11-52507. More specifically, 0.8 parts by weight of sodium nitrate and 3.2 parts by weight of sodium sulfate were dissolved in 43 parts of ion exchanged water and thereto 13 parts by weight of a sensitizing dye was added and dispersed using a dissolver blade at 2,000 rpm for 20 minutes under the condition of 60° C. to obtain a solid dispersion of the sensitizing dye.

TABLE 1

| Emulsion No. | Amount of 1st Dye Added ($10^{-3}$ mol/mol-Ag) | Amount of 2nd Dye Added ($10^{-3}$ mol/mol-Ag) | Dye Adding Method | Dye Adsorbed Amount[1)] ($10^{-3}$ mol/mol-Ag) | Number of Adsorbed Layers[2)] | Associated State of Second Layer Dye[3)] |
|---|---|---|---|---|---|---|
| 1 | D-1: 0.58<br>D-4: 0.87 | none | A | 1.39 | 0.96 | — |
| 2 | D-1: 0.58<br>D-4: 0.87 | D-1: 1.45<br>D-21: 1.45 | A | 3.48 | 2.40 | M |
| 3 | D-1: 0.58<br>D-4: 0.87 | D-1: 1.45<br>D-21: 1.45 | B | 3.50 | 2.41 | M |
| 4 | D-1: 0.58<br>D-4: 0.87 | D-6: 2.90 | A | 3.03 | 2.09 | J |
| 5 | D-1: 0.58<br>D-4: 0.87 | D-7: 2.90 | A | 3.11 | 2.14 | J |
| 6 | D-2: 0.58<br>D-3: 0.87 | " | A | 3.18 | 2.19 | J |

[1)]The total adsorbed amount every each dye.
[2)]The number of adsorbed layers when the one layer saturation adsorbed amount is deemed to be $1.45 \times 10^{-3}$ mol/mol-Ag.
[3)]The associated state of the second and upper layer dyes after subtracting the absorption of the first layer dye. Identification is made in accordance with the definition described in the specification.

The light absorption strength per the unit area was measured as follows. The obtained emulsion was thinly coated on a slide glass and the transmission spectrum and the reflection spectrum of individual grains were measured by the following method using a microspectrophotometer MSP65 manufactured by Karl Zweiss to obtain the absorption spectrum. The reference used for the transmission spectrum was the area where grains were absent and as the reference used for the reflection spectrum, silicon carbide of which reflectance is known was measured. The measured part was a circular aperture part having a diameter of 1 $\mu$m. While conditioning the position such that the aperture part did not overlap the contour of a grain, the transmission spectrum and the reflection spectrum were measured in the wave number region of from 14,000 $cm^{-1}$ (714 nm) to 28,000 $cm^{-1}$ (357 nm). From the absorption factor A defined by the formula (1−T (transmittance)−R (reflectance)), the absorption spectrum was obtained. Using the absorption factor A' resulting from subtracting the absorption of silver halide, the light absorption strength per the unit area was obtained by integrating −Log(1−A') with respect to the wave number ($cm^{-1}$) and halving the resulting value. The integration range is from 14,000 to 28,000 $cm^{-1}$. At this time, a tungsten lamp was used as the light source and the light source voltage was 8 V. In order to minimize the damage of the dye by the irradiation of light, the monochromator in the primary side was used and the wavelength distance and the slit width were set to 2 nm and 2.5 nm, respectively. The absorption spectrum and the light absorption strength were determined on 200 grains and the coefficient of variation among grains was determined on the light absorption strength and the wavelength distance showing 50% of Amax. Furthermore, from the absorption maximum wavelength of individual grains, the ratio of grains included in the wavelength range of 10 nm appearing in the highest frequency was determined.

The image quality was evaluated by the graininess. In the evaluation of graininess, a sample under each Test No. was exposed through a pattern for the measurement of RMS value, using a halogen lamp having a color temperature of 3,200° K as the light source. Thereafter, the samples each was subjected to photographic processing such as development, measured by a microdensitometer (measuring aperture diameter: 48 $\mu$m) to obtain the RMS value, and relatively evaluated using ○Δ×. Those having bad image quality were rated as ×, those having allowable image quality were rated as Δ, and those having good image quality were rated as ○.

The adsorbed state of the sensitizing dye was evaluated using AFM manufacture by Nanoscope. The gelatin adsorbed on the grain surface was degraded by a proteolytic enzyme to prepare a sample in the state such that the structure of the sensitizing dye adsorbed layer can be observed. Then, the sample was observed in the non-contact tapping mode with a space resolution of 2 nm under the condition where the damage of sample was reduced to the utmost and the standard deviation of asperities on the grain surface was used as the index for the adsorbed state.

Separately, a gelatin hardening agent and coating aid were added to the emulsion obtained above and coated on a cellulose acetate film support simultaneously with the gelatin protective layer to have a coated silver amount of 3.0 g-Ag/$m^2$. The resulting film was exposed to a tungsten lamp (color temperature: 2854 K) through a continuous wedge color filter for 1 second.

The light was irradiated on the sample while cutting light at 500 nm or less using Fuji Gelatin Filter SC-50 (produced by Fuji Photo Film Co., Ltd. for minus blue exposure, which excites the dye side, as the color filter. The exposed sample was developed at 20° C. for 10 minutes using Surface Developer MAA-1 shown below. The processing where Compound T-1 was not added to the fixing solution was designated as A, the processing where 1.5 g/l of T-1 was added was B, and the processing where 0.2 g/l of T-1 was added was C.

T-1

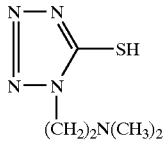

Formulation of Surface Developer MAA-1

| | |
|---|---|
| Metol | 2.5 g |
| L-Ascorbic acid | 10 g |
| Nabox (produced by Fuji Photo Film Co., Ltd.) | 35 g |
| Potassium bromide | 1 g |
| Water to make | 1 l |
| pH | 9.8 |

After the development, fixing with the following fixing solution was performed at 20° C.

Formulation of Fixing Solution

| | |
|---|---|
| Ammonium thiosulfate | 170 g |
| Sodium sulfite (anhydrous) | 15 g |
| Boric acid | 7 g |

-continued

| | |
|---|---|
| Glacial acetic acid | 15 ml |
| Potassium alum | 20 g |
| Ethylenediaminetetraacetic acid | 0.1 g |
| Tartaric acid | 3.5 g |
| Water to make | 1 l |

The processed film was measured on the optical density by Fuji Automatic Densitometer. The sensitivity was shown by a reciprocal of the amount of light required for giving an optical density of (fog+0.2) and the sensitivity of Test No. 1 was taken as 100. The gradation was shown by a reciprocal of the ratio of amounts of light required for giving a density difference of from (fog+0.2) to (fog+1.2). The gradation of Comparative Example 1 was taken as 100. Furthermore, assuming that the optical density at a spectral absorption maximum wavelength before the photographic processing such as development of the light-sensitive material shown in Table 3 was G0 and the optical density at a spectral absorption maximum wavelength after the photographic processing was G1, A was defined as A=G1/G0.

The results are shown in Tables 2 and 3.

TABLE 2

| Emulsion No. | Light Absorption Strength[1)] | Distance for for 50% of Amax[2)] | Variation Among Grains of Absorption Maximum Wavelength; Ratio of Grains within 10 nm (%)[3)] | Standard Deviation of Asperities on Grain Surface (nm)[4)] |
|---|---|---|---|---|
| 1 | 89 (5.7) | 65 (3.6) | 98 | 0.4 |
| 2 | 215 (132.1) | 138 (98.1) | 46 | 2.8 |
| 3 | 224 (86.2) | 128 (45.4) | 59 | 1.7 |
| 4 | 198 (76.7) | 101 (48.9) | 62 | 1.1 |
| 5 | 202 (59.9) | 98 (35.8) | 74 | 0.8 |
| 6 | 208 (31.2) | 97 (28.7) | 87 | 0.7 |

[1)]Average light absorption strength of 200 grains; the value in ( ) is the variation coefficient.
[2)]Average of 200 grains; the value in ( ) is the variation coefficient.
[3)]Ratio of grains having absorption maximum in the wavelength range of 10 nm where the absorption maximum wavelength appears at the highest frequency out of 200 grains.
[4)]Standard deviation of asperities when the asperities on the grain surface is measured by AFM the space resolution in the AFM measurement is 2 nm.

From these, it is found that in the multilayer adsorption system, when the sensitizing dye is adsorbed in the layer state and the adsorbed state is uniform among grains, not only the sensitivity and gradation but also the image quality are remarkably improved. Furthermore, when the change in absorption is made large between before and after the photographic processing, remarkable improvement of the image quality is verified.

EXAMPLE 2

The dye addition and the chemical sensitization were performed in the same. manner as in Example 1 by changing the sensitizing dye of Emulsion A-8 in the 14th layer of Sample 108 of Japanese Patent Application No. 11-168662 to the dye shown in Table 4. Also, the evaluation was performed in the same manner as in Example 1.

TABLE 4

| Emulsion No. | Amount of 1st Dye Added ($10^{-3}$ mol/mol-Ag) | Amount of 2nd Dye Added ($10^{-3}$ mol/mol-Ag) | Dye Adsorbed Amount[1)] ($10^{-3}$ mol/mol-Ag) | Number of Adsorbed Layers[2)] | Associated State of Second Layer Dye[3)] |
|---|---|---|---|---|---|
| 1 | D-14: 1.46 | none | 1.34 | 0.92 | — |
| 2 | D-15: 1.46 | none | 1.30 | 0.89 | — |
| 3 | D-14: 1.46 | D-20: 3.10 | 4.22 | 2.89 | J |
| 4 | D-15: 1.46 | " | 4.30 | 2.95 | J |

[1)]The total adsorbed amount every each dye.
[2)]The number of adsorbed layers when the one layer saturation adsorbed amount is deemed to be $1.45 \times 10^{-3}$ mol/mol-Ag.
[3)]The associated state of the second and upper layer dyes after subtracting the absorption of the first layer dye. Identification is made in accordance with the definition described in the specification.

The results are shown in Tables 5 and 6.

TABLE 5

| Emulsion No. | Light Absorption Strength[1)] | Distance for for 50% of Amax[2)] | Variation Among Grains of Absorption Maximum Wavelength; Ratio of Grains within 10 nm (%)[3)] | Standard Deviation of Asperities on Grain Surface (nm)[4)] |
|---|---|---|---|---|
| 1 | 50 (9.3) | 53 (4.5) | 96 | 0.5 |
| 2 | 51 (9.4) | 54 (4.7) | 97 | 0.5 |

TABLE 3

| Test No. | Emulsion No. | Processing Method | Energy Transfer Efficiency[1)] | A = G1/G0[2)] | Sensitivity (F + 0.2) | Gradation | Graininess | Remarks |
|---|---|---|---|---|---|---|---|---|
| 1 | 1 | A | — | 0.92 | 100 | 100 | ○ | Comparison |
| 2 | 2 | A | 0.67 | 0.96 | 156 | 79 | × | Comparison |
| 3 | 3 | A | 0.89 | 0.87 | 178 | 87 | Δ | Invention |
| 4 | 4 | A | 0.92 | 0.75 | 199 | 94 | Δ | Invention |
| 5 | 4 | B | 0.92 | 0.48 | 199 | 94 | ○ | Invention |
| 6 | 4 | C | 0.92 | 0.40 | 199 | 94 | ○ | Invention |
| 7 | 5 | A | 0.91 | 0.37 | 202 | 96 | ○ | Invention |
| 8 | 6 | A | 0.94 | 0.25 | 204 | 99 | ○ | Invention |

[1)]In the absorption maxmimum wavelength of the second and upper layers, the ratio of energy transferred to the first layer dye out of the excited energy of the excited dyes in the second and upper layers; a ratio between the relative quantum yield (ϕr) in the spectral sensitization at the absorption maximum wavelength and the relative quantum yield (ϕr) of only the first layer dye.
[2)]A value assuming that the optical density at the absorption maximum wavelength attributable to the sensitizing dye of a coated sample before the processing is G0 and the optical density attributable to the sensitizing dye at the above-describe wavelength after the processing is G1.

TABLE 5-continued

| Emulsion No. | Light Absorption Strength[1)] | Distance for for 50% of Amax[2)] | Variation Among Grains of Absorption Maximum Wavelength; Ratio of Grains within 10 nm (%)[3)] | Standard Deviation of Asperities on Grain Surface (nm)[4)] |
|---|---|---|---|---|
| 3 | 121 (105) | 79 (61.4) | 45 | 2.9 |
| 4 | 130 (43.1) | 69 (32.0) | 89 | 1.3 |

[1)]Average light absorption strength of 200 grains; the value in ( ) is the variation coefficient.
[2)]Average of 200 grains; the value in ( ) is the variation coefficient.
[3)]Ratio of grains having absorption maximum in the wavelength range of 10 nm where the absorption maximum wavelength appears at the highest frequency out of 200 grains.
[4)]Standard deviation of asperities when the asperities on the grain surface is measured by AFM; the space resolution in the AEM measurement is 2 nm.

TABLE 6

| Test No. | Emulsion No. | Energy Transfer Efficiency[1)] | A = G1/G0[2)] | Sensitivity (F + 0.2)[3)] | Gradation[3)] | Graininess[3)] | Remarks |
|---|---|---|---|---|---|---|---|
| 1 | 1 | — | 0.92 | 100 | 100 | ○ | Comparison |
| 2 | 2 | — | 0.96 | 99 | 100 | ○ | Comparison |
| 3 | 3 | 0.78 | 0.99 | 219 | 86 | × | Comparison |
| 4 | 4 | 0.95 | 0.43 | 265 | 97 | ○ | Invention |

[1)]In the absorption maximum wavelength of the second and upper layers, the ratio of energy transferred to the first layer dye out of the excited energy of the excited dyes in the second and upper layers; a ratio between the relative quantum yield (φr) in the spectral sensitization at the absorption maximum wavelength and the relative quantum yield (φr) of only the first layer dye.
[2)]A value assuming that the optical density at the absorption maximum wavelength attributable to the sensitizing dye of a coated sample before the processing is G0 and the optical density attributable to the sensitizing dye at the above-describe wavelength after the processing is G1.
[3)]Evaluated in the same manner as in Example 1 except that the film was exposed through Gelatin Filter SC-39 (long wavelength light-transmitting filter having a cut-off wavelength of 390 nm) produced by Fuji Photo Film Co., Ltd. and a continuous wedge for 1/100 second and the yellow color density was measured.

From these, it is found that even in the color negative light-sensitive material system containing an emulsion in which a sensitizing dye is adsorbed in multiple layers, when the sensitizing dye is adsorbed in the layer state and the adsorbed state is uniform among grains, not only the sensitivity and gradation but also the image quality are remarkably improved. Furthermore, when the change in absorption is made large between before and after the photographic processing, remarkable improvement of the image quality is verified.

EXAMPLE 3

The same comparison as in Examples 1 and 2 were performed by evaluating the color negative light-sensitive system in Example 5 of JP-A-8-29904, the color reversal light-sensitive material system in Example 1 of JP-A-7-92601 and JP-A-11-160828, the color paper system in Example 1 of JP-A-6-347944, and the X-ray light-sensitive system in Example 1 of JP-A-8-122954. As a result, similarly to Example 1, it is verified that a light-sensitive material having a small distribution of the sensitizing dye adsorbed amount among grains, favored with high sensitivity and high contrast and reduced in the deterioration of image quality ascribable to the increase in the optical density brought about by the multilayer adsorption can be obtained.

By the present invention, a silver halide photographic emulsion and a photographic light-sensitive material, which are reduced in the problems such as deterioration of image quality ascribable to the multilayer adsorption of a sensitizing dye and favored with high sensitivity and high contrast, can be realized.

While the invention has been described in detail and with reference to specific embodiments thereof, it will be apparent to one skilled in the art that various changes and modifications can be made therein without departing from the spirit and scope thereof.

What is claimed is:

1. A method of preparing a silver halide photographic emulsion comprising silver halide grains having adsorbed on a surface thereof multiple layers of at least one sensitizing dye, wherein the grains have a variation coefficient of light absorption strength distribution of 100% or less and wherein an interaction energy between a sensitizing dye in a first layer and a sensitizing dye in a second layer is 10% or more of an entire adsorption energy of the sensitizing dye in the second layer, comprising a step of adding said at least one sensitizing dye to said silver halide grains at a low temperature and thereafter raising the temperature.

2. A method of preparing a silver halide photographic emulsion comprising silver halide grains having adsorbed on a surface thereof multiple layers of at least one sensitizing dye, wherein when a maximum value of a spectral absorption factor by a sensitizing dye of an individual grain of said silver halide grains is Amax, a variation coefficient of a wavelength distance distribution between a shortest wavelength and a longest wavelength showing 50% of Amax among the silver halide grains is 50% or less, comprising the step of adding said at least one sensitizing dye to said silver halide grains at a low temperature and thereafter raising the temperature.

3. A method of preparing a silver halide photographic emulsion comprising silver halide grains having adsorbed on a surface thereof multiple layers of at least one sensitizing dye, wherein grains corresponding to 50% or more of a projected area of all silver halide grains in the emulsion have a variation width of a spectral absorption maximum wavelength of 10 nm or less, comprising a step of adding said at least one sensitizing dye to said silver halide grains at a low temperature and thereafter raising the temperature.

4. A method of preparing a silver halide photographic emulsion comprising silver halide grains having adsorbed on a surface thereof multiple layers of at least one sensitizing dye, wherein a sensitizing dye in a second layer from the grain surface and a sensitizing dye in layers above the second layer from the grain surface each is present in a layer state, comprising a step of adding said at least one sensitizing dye to said silver halide grains at a low temperature and thereafter raising the temperature.

* * * * *